US006007184A

United States Patent [19]

Terasawa et al.

[11] Patent Number: 6,007,184

[45] Date of Patent: Dec. 28, 1999

[54] INK JET RECORDING HEAD MOUNTING AND POSITIONING ARRANGEMENT

[75] Inventors: Koji Terasawa, Mitaka; Katsuyuki Yokoi, Yokohama; Makoto Takemura, Tokyo; Hideo Fukazawa, Yokohama; Tetsuji Kurata, Yokohama; Koichiro Kawaguchi, Yokohama; Kazuhiko Shinoda, Yokohama, all of Japan

[73] Assignee: Canon Kabushiki Kaisha, Tokyo, Japan

[21] Appl. No.: 08/470,155

[22] Filed: Jun. 6, 1995

Related U.S. Application Data

[63] Continuation of application No. 07/769,399, Oct. 1, 1991, abandoned.

[51] Int. Cl.[6] ..... B41J 2/14

[52] U.S. Cl. ..... 347/50

[58] Field of Search ..... 347/37, 49, 50, 347/86, 87; 346/139 R; 400/175; 361/733, 796, 797, 798, 799, 800, 801, 802

[56] References Cited

U.S. PATENT DOCUMENTS

| | | | |
|---|---|---|---|
| 4,313,124 | 1/1982 | Hara . | |
| 4,345,262 | 8/1982 | Shirato et al. . | |
| 4,459,600 | 7/1984 | Sato et al. . | |
| 4,463,359 | 7/1984 | Ayata et al. . | |
| 4,510,510 | 4/1985 | Terasawa . | |
| 4,558,333 | 12/1985 | Sugitani et al. . | |
| 4,723,129 | 2/1988 | Endo et al. . | |
| 4,740,796 | 4/1988 | Endo et al. . | |
| 4,755,836 | 7/1988 | Ta et al. | 346/140 R |
| 4,853,717 | 8/1989 | Harmon et al. . | |
| 4,952,947 | 8/1990 | Kyoshima . | |
| 5,138,342 | 8/1992 | Kurata et al. | 347/50 |
| 5,173,845 | 12/1992 | Shaw | 361/798 |

FOREIGN PATENT DOCUMENTS

| | | | |
|---|---|---|---|
| 0398347 | 11/1990 | European Pat. Off. . | |
| 54-056847 | 5/1979 | Japan . | |
| 0188661 | 4/1983 | Japan | 346/140 R |
| 59-123670 | 7/1984 | Japan . | |
| 59-138461 | 8/1984 | Japan . | |
| 60-271260 | 4/1985 | Japan . | |
| 0125849 | 6/1986 | Japan | 346/140 R |
| 9110569 | 7/1991 | WIPO . | |

*Primary Examiner*—N. Le
*Assistant Examiner*—Judy Nguyen
*Attorney, Agent, or Firm*—Fitzpatrick, Cella, Harper & Scinto

[57] ABSTRACT

An ink jet recording apparatus includes datum portions for positioning of each of a plurality of recording heads. The carriage has a cover member to protect the ink jet recording heads and to press them against the datum portions. Another cover member includes an electrical connecting member for making electrical connection to the recording head. With this structure, operating the cover members protects the ink jet recording heads, while they are positioned and electrical connection thereto is made.

13 Claims, 35 Drawing Sheets

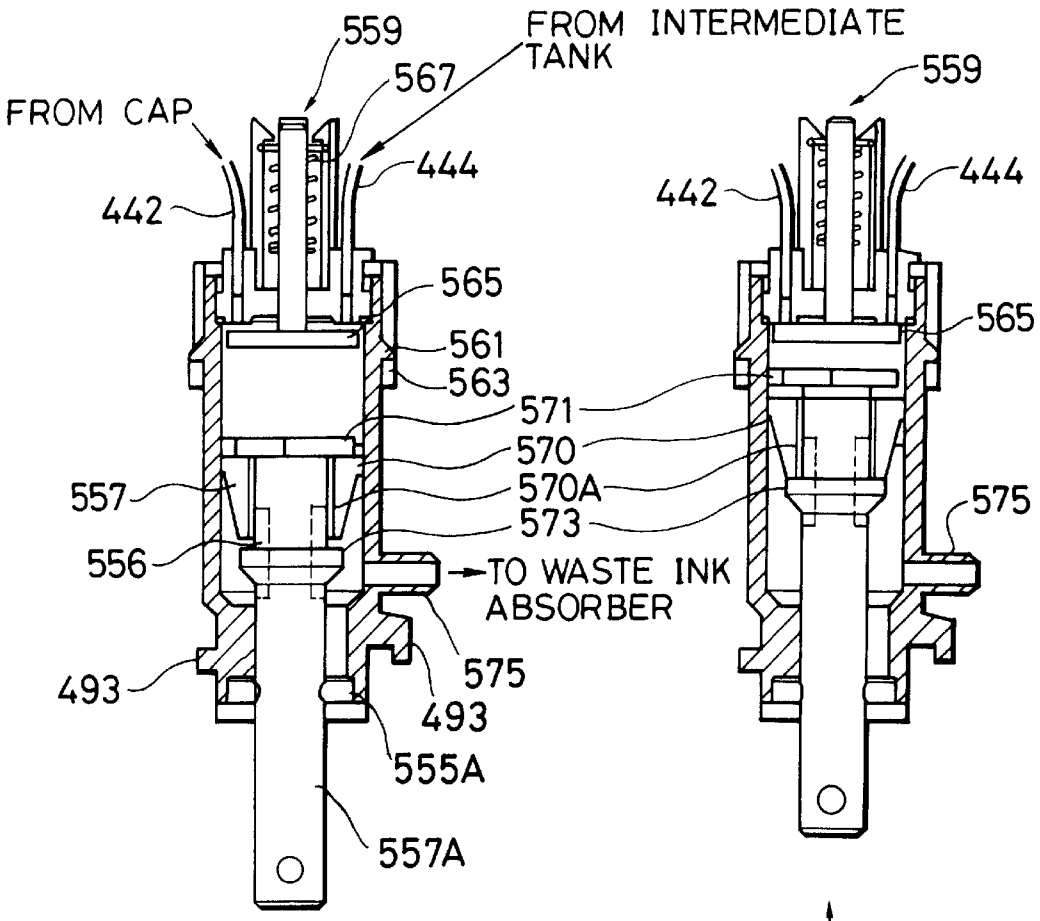
FIG.21C
FIG.21B
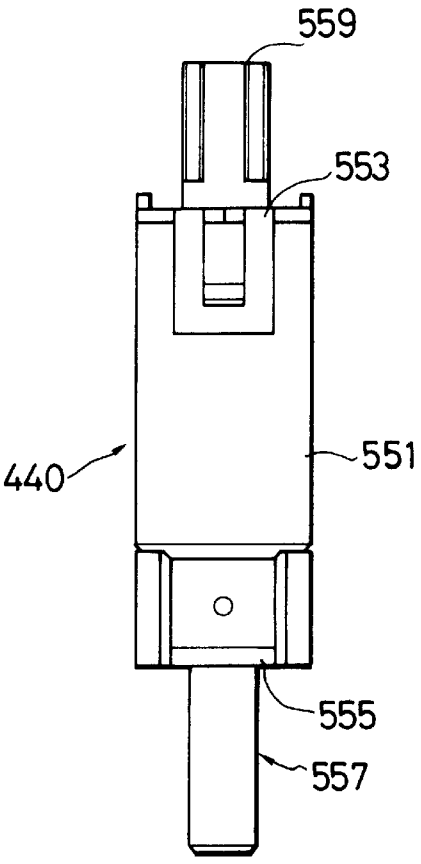
FIG.21A

INK JET RECORDING HEAD MOUNTING AND POSITIONING ARRANGEMENT

This application is a continuation of application Ser. No. 07/769,399 filed Oct. 1, 1991, now abandoned.

BACKGROUND OF THE INVENTION

1. FIELD OF THE INVENTION

The present invention relates to an ink jet recording apparatus, and particularly, to an ink jet recording apparatus used as an information recording apparatus for an electronic typewriter, a word processor, a facsimile, a copying machine and so on.

2. DESCRIPTION OF THE PRIOR ART

There have been proposed recording apparatuses which use various types of recording heads depending on their respective recording methods, and record information on a recording medium such as paper, OHP sheet and so on; the recording medium is hereinafter called simply a recording paper or a paper. These recording methods include a wire-dot recording method, thermal-sensitive paper recording method, thermal transcription recording method and ink jet recording method and so on.

Among these methods, the ink jet recording method, in which ink droplets are ejected to the recording paper, has attracted a great deal of attention with its advantageous aspects such as low fabricating and operating costs and low noises recording.

In addition, in recent ink jet recording apparatus, especially with respect to the recording head used in the ink jet recording apparatus, the recording head can be fabricated using the semiconductor device technologies such as thin film growth technology and microscepic device process technology, and recording heads fabricated in much smaller dimension and with lower costs are realized. In response to this technical progress in fabricating recording heads, a recording apparatus is realized which is capable of color recording or halftone recording by using a plurality of such recording heads. Accordingly, it is required that the structure of the recording apparatus become smaller and more simplified.

The ink jet recording apparatus having the above described advantageous features is used as a recording apparatus in electronic typewriters, word processors, facsimiles and copy machines and so on. In every application, the ink jet recording apparatus is formed so as to be suited to the required functions and the usage specific to the application apparatus.

There has been a recent trend in electronic typewriters and word processors towards being fabricated as small-sized, lightweight and portable device. This trend also requires a compact and much simplified ink jet recording apparatus.

Under the above described trend, that is, toward a compact and simplified ink jet recording apparatus, it is required to simplify units forming the ink jet recording apparatus and furthermore to simplify mechanisms connecting these units to each other.

SUMMARY OF THE INVENTION

An object of the present invention is to improve a recording quality of an ink jet recording apparatus having a plurality of recording heads.

Another object of the present invention is to protect securely the recording head.

And furthermore, another object of the present invention is to establish a simplified structure for positioning securely a plurality of recording heads.

A further other object of the present invention is to provide an apparatus for establishing easily and reliably electric coupling relative to a plurality of recording heads, which are installed in proper positions in order to improve recording quality, without causing degradation of positioning accuracy of the recording heads.

In a first aspect of the present invention, a recording head unit for an ink jet recording apparatus comprises:

a plurality of recording heads, each recording head being installed corresponding to an individual ink whose color or density is different from any other color or density;

a support member having datum portions for positioning of each of the plurality of recording heads when supported the plurality of recording heads being detachably supported by the support member; and a cover member provided on the support member, for covering to protect the plurality of recording heads, and to press each of the recording head against the datum portions.

In a second aspect of the present invention, an ink jet recording apparatus comprises:

a plurality of recording heads, each recording head being installed corresponding to an individual ink whose color or density is different from any other color or density;

a support member having datum portions for positioning of each of the plurality of recording heads when supported the plurality of recording heads being detachably supported by the support member;

a cover member provided on the support member, for covering to protect the plurality of recording heads, and to press each of the recording head against the datum portions; and means for scanning the support member in relative to a recording medium in a predetermined direction.

In these aspects of the present invention, the datum portions for positioning of each of the plurality of recording heads may be formed in correspondence with three directions in the three-dimensional coordinate, and the cover member may have at least one spring corresponding to each of the plurality of recording head, for pressing the recording head against the datum portion.

The recording head may have an electro-thermal converting element for generating thermal energy to cause film boiling in the ink as an element for generating energy used for discharging the ink.

In a third aspect of the present invention, a recording head unit for an ink jet recording apparatus comprises:

a plurality of recording heads, each recording head being installed corresponding to an individual ink whose color or density is different from any other color or density;

a support member for positioning and supporting the plurality of recording heads;

a cover member mounted at the support member and used for protecting the plurality of recording heads by covering the plurality of recording heads when installing the plurality of recording heads; and an electric connection member provided on the cover member in correspondence with an electric connection part of each of the plurality of recording heads, the electric connection member being coupled with an electric connection part responsive to a covering action of the cover member, and being movable relative to the electric connection part of each of the plurality of recording heads positioned and supported on the support member.

In a fourth aspect of the present invention, an ink jet recording apparatus comprises:

a plurality of recording heads, each recording head being installed corresponding to an individual ink whose color or density is different from any other color or density;

a support member for positioning and supporting the plurality of recording heads;

a cover member mounted at the support member and used for protecting the plurality of recording heads by covering the plurality of recording heads when installing the plurality of recording heads;

an electric connection member provided on the cover member in correspondence with an electric connection part of each of the plurality of recording heads, the electric connection member being coupled with an electric connection part responsive to a covering action of the cover member, and being movable relative to the electric connection part of each of the plurality of recording heads positioned and supported on the support member; and means for scanning the support member in relative to a recording medium in a predetermined direction.

In the third and fourth aspects of the present invention, a plurality of the electric connection members each of which is in correspondence with the electric connection part of each of the plurality of recording heads may be integrally supported on a board, the board being mounted on the cover member with a clearance so that the plurality of electric connection members are movable.

The support member may have datum portions for positioning of each of the plurality of recording heads when supported the plurality of recording heads being detachably supported by the support member, further comprising another cover member provided on the support member, for covering to protect the plurality of recording heads, and to press each of the recording head against the datum portions.

The datum portions for positioning of each of the plurality of recording heads may be formed in correspondence with three directions in the three-dimensional coordinate, and the other cover member may have at least one spring corresponding to each of the plurality of recording head, for pressing the recording head against the datum portion.

The recording head may have an electro-thermal converting element for generating thermal energy used to cause film boiling in the ink as an element for generating energy for discharging the ink.

The above and other objects, effects, features and advantages of the present invention will become more apparent from the following description of embodiments thereof taken in conjunction with the accompanying drawings.

BRIEF DESCRIPTION OF THE DRAWINGS

Embodiments of the invention will now be described, by way of example and with reference to the accompanying drawings in which like parts are designated with like numerals throughout, and in which:

FIG. 21A is an elevational view of an appearance of a pump of the ejection recovery unit;

FIGS. 21B and 21C are longitudinal sectional views illustrating different working states of the pump of the ejection recovery unit, respectively;

DETAILED DESCRIPTION OF PREFERRED EMBODIMENTS

As will be described, these and other features of the present invention and one embodiments thereof are more fully described below in the detailed description and with the accompanying drawings.

Figure 1:
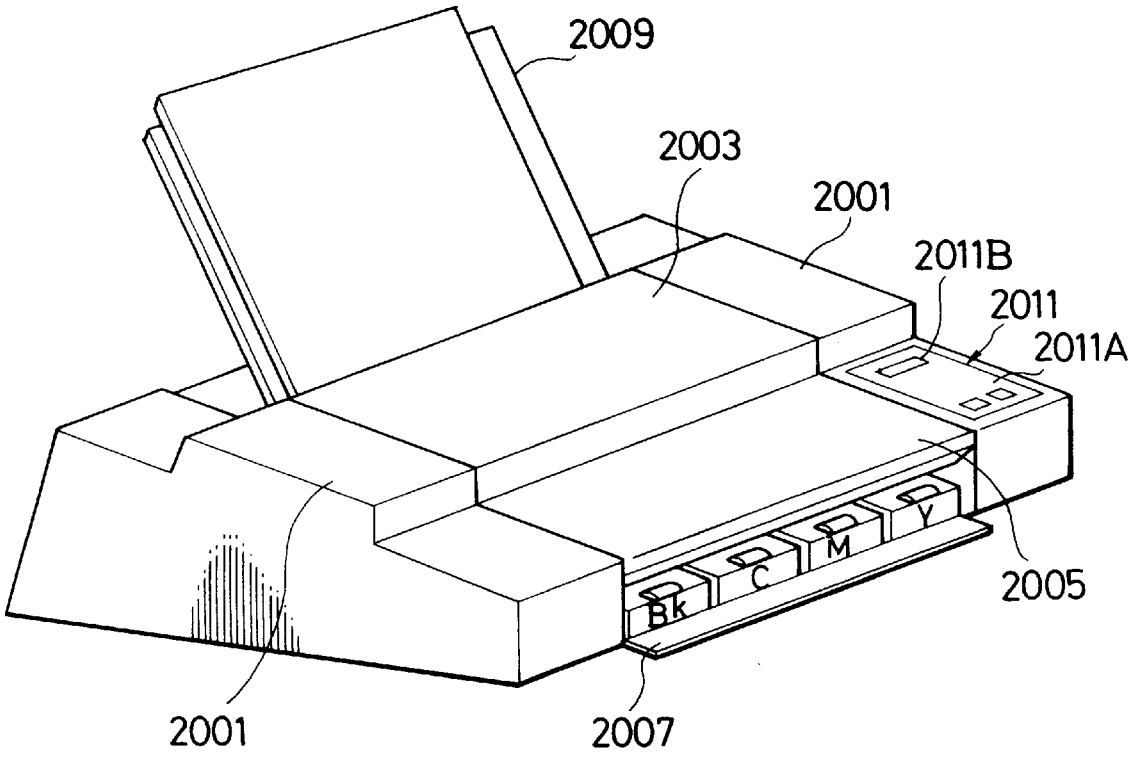
FIG. 1 is a perspective view of an appearance of an ink jet recording apparatus related to an embodiment of the present invention.
Figure 2A:
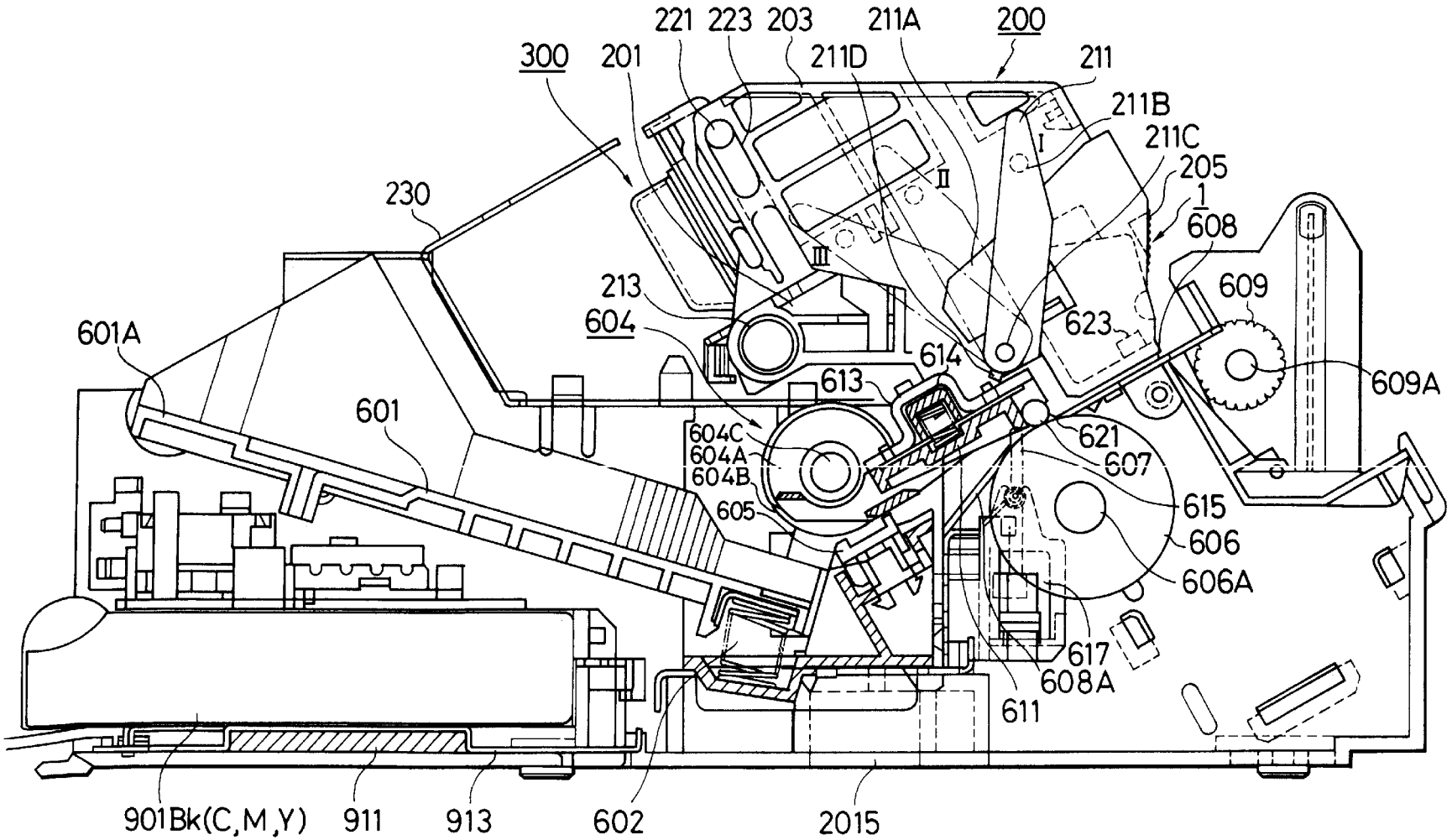
FIGS. 2A and 2B are a cross-sectional side view and a plan view of the ink jet recording apparatus in the embodiment of the present invention with its cover removed, respectively.
Figure 2B:
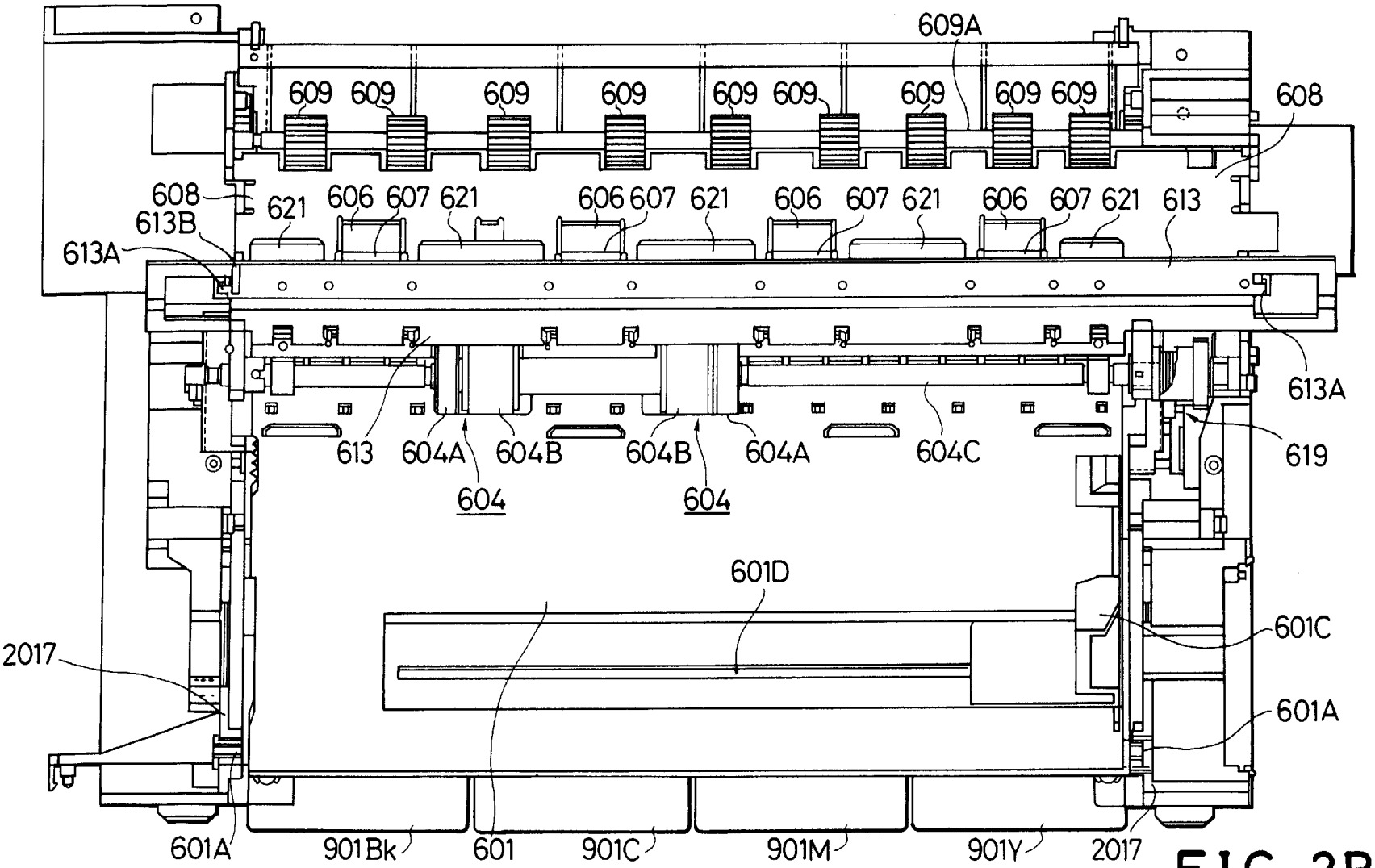

FIG. 1 is a perspective view of an ink jet recording apparatus of one embodiment of the present invention. In FIG. 1, main cases 2001 form parts of an apparatus case. More specifically, the main cases 2001 are fixed in parts of the frame of the ink jet recording apparatus, respectively, which is hereinafter called simply an apparatus, as shown in FIGS. 2A and 2B, so that the main cases 2001 cover both side ends of the apparatus, to form a part thereof the part having a transport path for recording paper. In one of the side ends of the apparatus, the home position of the recording head is defined, where the recording head is positioned when the recording head is not used for recording information, and where there is provided an ejection recovery unit used for recovering the ejection capability of the recording head. By means of the existence of the main cases 2001 at both side ends of the apparatus, it will be appreciated that, in opening a part of the apparatus case for inspecting and maintaining the apparatus, and injection recovery undesired contact with and damage to the recording head can be avoided by moving the recording head from its recording position.

A central case 2003 also forms a part of the apparatus case and covers mainly a region where the recording head moves across. The central case 2003 is mounted so as to be easily removed from the apparatus, and spurs are mounted on the central case 2003 corresponding to feed out rollers to be described later. The central case 2003 is installed to the apparatus so that the spurs mounted on the central case 2003 may press the feed roller with a appropriate force. A paper stocker cover 2005 also forms a part of the apparatus case and is opened and closed freely. The paper stocker cover 2005 is almost shaped as a rectangular and supported at its two corners at both ends of the front side edge thereof so that the paper stocker cover 2005 may be rotated on the front side edge and may be opened upward and held at a predetermined angle. The paper stocker cover 2005 held at the predetermined angle is aligned to a paper feed tray described later, and a stock of papers may be placed on both of the paper feed tray and the paper stocker cover 2005. An ink cover 2007 is provided on the front side of the apparatus and also form a part of the apparatus case. The ink cover 2007 is hinged at the bottom edge on the front side of the apparatus so that the cover 2007 can be opened outwards as required. As a result, an ink cartridge accommodated inside the apparatus can be mounted into and extracted outside the apparatus through the open port formed by the opening of the ink cover 2007.

A fed out paper tray 2009 is installed so as to be removable from the apparatus. The fed out paper tray 2009 is provided on a back side of the apparatus at a predetermined angle so that the recorded papers may be stacked sequentially over the feed out paper tray 2009. An operation part 2011 is provided on the one of the main cases 20001. The operation part 2011 has a display part 2011B for displaying information of operation states of the apparatus and a key 2011A for accepting command inputs to the apparatus.

FIGS. 2A and 2B are a cross-sectional side view and a plan view of the ink jet recording apparatus in one embodiment of the present invention, showing the apparatus without its apparatus cover. In FIG. 2B, the recording head, a carriage on which the recording head is mounted and which can move, and a driving system for moving the carriage are not shown.

In FIGS. 2A and 2B, a paper feed tray 601 and a paper stocker cover 2005 as shown in FIG. 1 with being opened, both not shown in FIGS. 2A and 2B, form a paper feed part. The paper feed tray 601 is hinged by a rotating shaft 601A at the backward end of the paper feed tray 601 in the paper feed direction, the rotating shaft 601A rotatably mounted on the side wall 2017 forming the frame of the apparatus, and the paper feed tray 601 is pushed upward at the forward end of the paper feed tray 601 in the paper feed direction by a coil spring 602. With this structure, a stack of recording papers, not shown in FIGS. 2A and 2B, is pushed upward to a pickup roller 604 and the paper of the most upper side of the stack is pressed against two pickup rollers 604. The recording paper includes synthetic plastic sheets and so on so that the recording paper may mean hereinafter a recording medium. In the above described paper feed mechanism, a component 601C shown in FIG. 2B is a guide plate used for guiding recording papers and moved according to the size of recording papers, and a component 601D is a guide groove in which the guide plate 61C moves in order to adjust its position according to the size of recording papers.

Each of the two pickup rollers 604 is composed of pair of a half-moon-shaped rollers 604A and an idler rollers 604B. The cross section of the half-moon-shaped roller 604A is, as shown in FIG. 2A, circular in shape a part of which is cut, and the idler roller 604B is a circle with its diameter a little less than the diameter of the half-moon-shaped roller 604A. The two pickup rollers 604 are placed at the respective neighboring portion of the forward edge of the paper feed tray 601 and fixed on a pickup roller shaft 604C extending in the direction vertical to the direction in which recording papers are fed. One end of the pickup roller shaft 604C is rotatably supported by a part of a frame 2017 and the other end of the pickup roller shaft 604C is linked to a clutch 619. With this structure, the driving force of a motor, not shown in FIGS. 2A and 2B, is transferred to the pickup roller shaft 604C through the clutch 619 so that the pickup rollers 604 can be rotated.

Recording paper stacked on the paper feed tray 601 is pressed against the pickup rollers 604 as described above. As the pickup rollers 604 rotates, the top sheet of stacked recording papers is pushed forward by the shoulders of the half-moon rollers 604A, the shoulders being formed at the edge of the cut circle shape of the half-moon roller 604A, and furthermore, the top sheet is moved to a paper transport path the combination of the pickup rollers 604 and a separation plate 605 which will be described in detail in FIGS. 15A and 15B.

Paper transport rollers 606 are disposed downward along the paper transport path with respect to the pickup rollers 604. Four paper transport rollers 606 are placed at a predetermined interval in the direction perpendicular to the direction in which the recording paper is fed, and these four paper transport rollers 606 are fixed on a paper transport roller shaft 606A not shown in FIG. 2B. With this structure, the driving force of a paper feed motor not shown in FIGS. 2A and 2B is transferred to the paper transport roller shaft 606A so that the paper transport rollers 606 can be rotated.

Each of pinch rollers 607 is provided in correspondence to each of the paper transport rollers 606, so that its circumference surface is in contact with the circumference surface of the paper transport roller 606. Each pinch roller holder 611 is provided in correspondence to each of the pinch rollers 607, and its one end supports the pinch roller 607 rotatably. A carriage rail 613 is extended over the region on which the carriage, which will be explained later, is moved. The other end of the pinch roller holder 611 is supported by the carriage rail 613 and pressed slantwise and downward by a coil spring 614 mounted between the carriage rail 613 and the pinch roller holder 611 as shown in FIG. 2A. With this structure, recording papers fed between the pinch roller 607 and the paper transport roller 606 is pressed by the pinch roller 607 against the paper transport roller 606, and hence, the friction force between recording paper and the rollers 606 is produced so that the paper transport rollers can transport the paper.

A platen 608 for forming a surface on which recording paper is supported is disposed against the recording head which will be described later and on the downstream of the paper transport path distant from the paper transport roller 606 and so on. And furthermore, on the adjacent downstream of the paper transport path from the platen 608, feed out rollers 609 are provided. Nine feed out rollers 609 are fixed on a feed out roller shaft 609A at an predetermined interval in the direction vertical to the direction in which recording paper is fed as shown in FIG. 2B. The feed out roller shaft 609A is driven by a motor not shown in FIGS. 2A and 2B so that the feed out rollers are rotated. With this structure, in cooperation with the feed out rollers 609 and the spurs supported by the central case 2003 shown in FIG. 1, recording paper is moved to the fed out paper tray 2009 shown in FIG. 1.

In the recording paper transport mechanism as described above, each sheet of recording papers stacked on the paper feed tray 601 is fed to the paper transport path by means of the pickup roller 604 and the separation plate 605, and is forwarded between the paper transport rollers 606 and the pinch rollers 607 while being guided by the paper guide 608A. While the recording papers' is being transported, recording paper contacts one end of a sensor lever 615 for detecting the edge of the recording paper. The movement of the other end of the sensor lever 615 brings the change in detected signals by a photo sensor for detecting the position of the edge of the paper. By this change in detected signals, the edge of recording paper can be sensed. In addition, a reflective sensor 623 for detecting the width of the recording paper is disposed under the carriage to be described later in order to measure the width of the recording paper.

The paper transport rollers 606 transport the recording paper in a predetermined length in response to the recording movement of the recording head, for example, the length in the direction of transporting the paper of one recorded line of the recording head, and thus, characters and images are recorded on the recording paper. At this time, the recording paper is pressed against the platen 608 by a leaf spring 621 so that the recording region for the recording head on the recording paper can be maintained to be flat. The recorded paper is moved forward to the fed out paper tray 2009 by feed out rollers 609.

As shown above, the paper transport path from the paper feed tray 601 to the feed out rollers 609 and furthermore the fed out paper tray 2009 shown in FIG. 1 is extended as shaped in V as shown in FIG. 2A. The recording paper transported through the paper transport path is, therefore, bent so as to fit the platen 608 and the recording region on the recording paper can be maintained to be flat.

Figure 3:
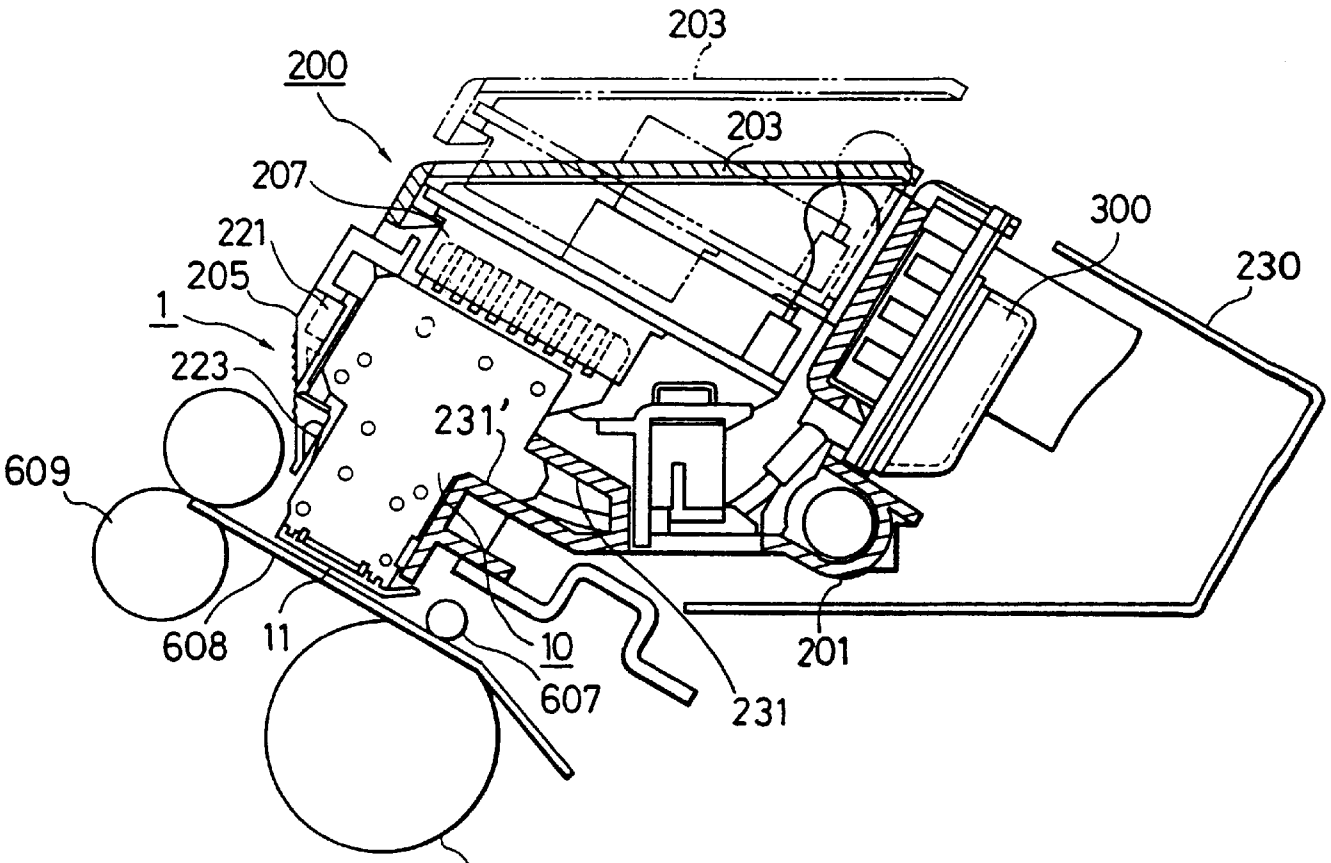
FIG. 3 is a cross-sectional side view of a recording head of the ink jet recording apparatus in the embodiment of the present invention, the recording head unit being mounted on a carriage.
Figure 3A:
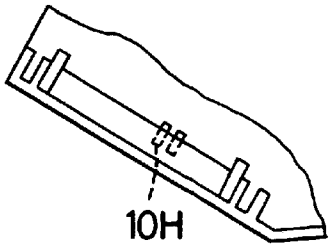
FIG. 3*a* is an enlarged view showing the electro-thermal conversion element in the recording head.

In FIG. 2A, a recording head part 1 has four recording head chips or members, each corresponding to an individual ink color to be described in detail in FIG. 3. These recording head chips are mounted in a carriage body 201 of a carriage part 200 so as to be detached easily. A component 203 is a carriage cover and a component 205 is a head cover. These covers are mounted in the carriage body 201 so that electric connections to the recording head chips and positioning and mounting of the recording head chips are established. An intermediate tank 300 mounted at a part of the carriage body 201 collects bubbles generated in the ink supply system and cushions the pressure deviation occurring in the ink supply system due to the movement of the carriage. With this structure of the intermediate tank 300, it will be appreciated that the adverse effect over the recording head due to the bubbles and the pressure deviation in ink fluid can be eliminated. The carriage body 201 is engaged with the guide shaft 213 so as to slide along the guide shaft 213; in FIG. 2A, only the cross-section of the guide shaft 213 is shown. And furthermore, a belt, a part of which is connected to the carriage body 201, is driven by a carriage motor not shown in FIG. 2A, so that the carriage body 201 and such components mounted in the carriage body 201 as recording head part 1 and so on may be moved along the guide shaft 213.

And in FIG. 2A, a position lever 211 is rotatably supported by a shaft 211C, one end of which is mounted at a part of the carriage body 201. In this structure, an operator of the apparatus may change the position of the position lever 211 by his/her hand. More specifically, on the other end of the position lever 211, a semi-sphere-shaped convex part 211B is formed. The convex part 211B can be linked with three concave parts formed on the side panel, not shown in FIG. 2A, of the carriage part 200 so that the position lever 211 may be fixed on these three points.

In the case that the position lever 211 is located at position I or II as shown in FIG. 2A, the carriage body 201 including the recording head chip is rotated about the guide shaft 213 and is displaced to respective positions in accordance with respective contacting positions between the position lever 211 and the carriage rail 613. More specifically, when the position lever 211 is located at position I as shown in FIG. 2A, a part of the carriage body 201 contacts the upper surface of the carriage rail 613 and moves on this surface as shown in detail in FIG. 3. In this configuration of the carriage body 201 and the carriage rail 613, the recording head chip is located in a relatively adjacent position to the platen 608. On the other hand, in case that the position lever 211 is located at position II, a press member 211A formed integrally or the position lever 211 contacts the upper surface of the carriage rail 613. With this structure, the point of application to the carriage body 201 is established at the contacting part between the press member 211A and the upper surface of the carriage rail 613, so that the carriage body 210 rotates upward about the guide shaft 213 in FIG. 2A, and as a result, the recording head chip is positioned to be relatively far from the platen 608.

In the above described structure of the position lever 211, for example, in the case of using the recording paper composed of materials having a worse capability in absorbing ink, the position of the recording head chip is taken to be relatively far from the platen 608 by setting the lever 211 in position II, because, in the case of using the recording paper having a worse capability in absorbing ink, the surface of recording paper waves so that the waved surface of recording papers may scratch or damage the ink outlet part of the recording head chip. By means of selecting the position of the position lever 211 to be position II, the above problem may be avoided. On the other hand, in using the recording paper composed of materials having a relatively good capability in absorbing ink, the position of the position lever 211 may be selected to be position I.

Position III for the position lever 211 is used for preventing the carriage part 200 from moving in the right direction while the carriage part is being fixed at the home position. As shown in FIG. 2B, as a protrusion part 211D at the lower end of the position lever 211 and a hole 613B located to be adjacent to the left end of the carriage rail 613 are linked to each other, the movement of the carriage part 200, not shown in FIG. 2B, in the right direction may be prohibited.

Additionally, it may be allowed that the position of the position lever 211 is informed by means of a visual display and/or a sound. The position lever 211 is manipulated by the operator of the apparatus with his or her hand in order to move and fix the position of the position lever 211. Thus, for example, in case that the carriage part 200 is located at the home position and the operator tries to start the operation of the apparatus for recording information while the position lever 211 remains located at position III, it may be allowed that a message is displayed for requesting the operator to release the position lever and set the position lever in position I or II.

And also, it may be allowed that in positions I, II and III, the current position of the position lever 211 is informed by a visual display.

And furthermore, it may be allowed that an abnormal handling status of the apparatus is alarmed by an audible apparatus like a buzzer in such cases that an excess amount of vibration is applied to the apparatus in transporting the apparatus and that the position of the position lever 211 is not position III, that is, not in the proper position for fixing the carriage part 200 in detecting application of the excess amount of vibration force to the apparatus.

According to the above described structure for fixing the position of the carriage part 200, it will be appreciated that mechanical damage to the carriage part 200 and the recording head part 1 due to unfavorable movement of these parts 200 and 1 in transporting the recording apparatus may be reduced or even prevented.

In FIG. 2A, a cover 230 is fixed on the apparatus frame so that the cover 230 protects an ink supply tube, a flexible cable and so on by which the carriage part 200 in moving is followed.

In FIGS. 2A and 2B, ink cartridge 901BK, 901C, 901M and 901Y are mounted within an ink supply unit to be described later. These ink cartridges include an ink reservoir for storing ink, each color of which is black (BK), cyan (C), magenta (M) or yellow (Y), respectively, and a wasted ink reservoir for storing wasted ink used for an ink ejection recovery process. An ink absorber 911 is disposed under the ink supply unit having an ink cartridge. The ink absorber 911 has a restoring force with respect to an applied force from outside the ink absorber 911 and is installed between an concave part of a frame 913 forming the ink supply unit and a base plate 2015 forming a part of the apparatus frame with being compressed. By means of the ink absorber 911, spilled ink from the ink cartridge 901 can be absorbed in the ink absorber. Additionally, the vibration, which is generated by the rotation of the motor and is propagated through the base plate 2015 and so on, may be cushioned by the ink absorber 911 so that the noise accompanied with the operation of the apparatus may be reduced.

The location of the absorber as used for cushioning the vibration is not restricted to be under the ink supply unit as described in the above example but selected to be an arbitrary position which is effective for reducing the noise from the apparatus.

FIG. 3 is a cross-sectional side view of the carriage part 200 and the head part 1 for showing a detail of the recording head 1 mounted in the carriage body 201 as described above. In FIG. 3, a head chip or member 10 is provided in correspondence to each ink color, and hence four head chips 10 are disposed in the direction perpendicular to the FIG. 3 sheet while only one head chip is shown in FIG. 3. The head chip 10 is formed as described below. A silicon substrate is layered on the Aluminum base board shaped as shown in FIG. 3. On the silicon substrate, there is formed an electro-thermal conversion element 10H for generating thermal energy used for ejecting ink droplets, electrode wirings for supplying electric power to the electro-thermal conversion element and a head driver circuit for driving the electro-thermal conversion element in accordance with recording signals. And furthermore, a top plate having concave portions for forming ejection outlets, ink passages connecting to the ejection outlets respectively and a common ink chamber joins to the silicon substrate with its concave portion inside. In the embodiment of the present invention, the recording head chip 10 has 64 ejection outlets on an outlet disposed face formed at the end thereof. A front plate 11 having an opening in corresponding to the region on the outlet disposed face of the head chip 10 is provided. In each of ink passages connected to each of the ejection outlets, electrothermal conversion element is disposed, and the electrothermal conversion element imparts thermal energy to ink in accordance with the input electric pulse so that film boiling in the ink generates bubbles which cause ink droplets to be ejected from the ejection outlet.

The carriage cover 203 forming one of members for mounting the head chips holds four connectors 207 corresponding to the four head chips 10 to be connected electrically to electric terminals of the head chips 10, respectively. In closing the cover 203, by moving the cover 203 from the position illustrated by two-point dotted lines to the position illustrated by solid lines in FIG. 3, each of four connectors 207 connects its corresponding head chip 10 with its electric terminal. This connection is established by means of inserting the electric terminals of the head chips 10 into concave portions of their corresponding connectors 207.

In the above insertion work, four head chips 10 are fixed and mounted on the predetermined positions on the carriage body 201 so that the connectors 207 move along the head chips 10, respectively. In order to establish smooth insertion of the electric terminals of the head chips 10 into the connectors 207, openings of the concave portions of the connectors 207 are shaped into curved surfaces.

The movement of the carriage cover 203 is guided by an elongate groove 223 formed on a part of the carriage cover 203 that engages with a shaft 221 provided on the carriage body 201. The carriage cover 203 protects especially head chips 10 and their electric terminals.

Figure 4A:
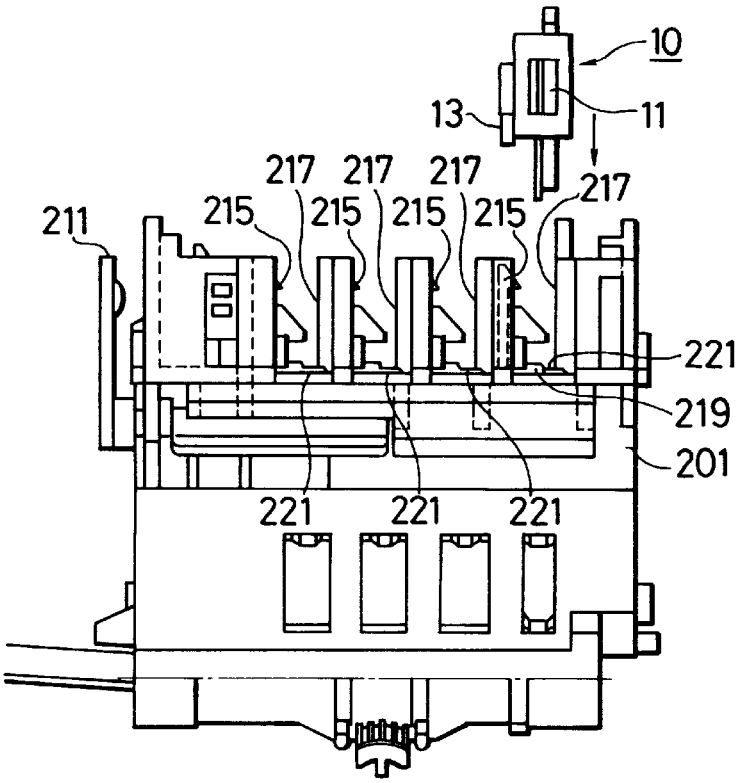
FIG. 4A is a front view of a carriage and a recording head chip for explaining installation of the recording head chip in the recording head unit shown in FIG. 3.
Figure 4B:
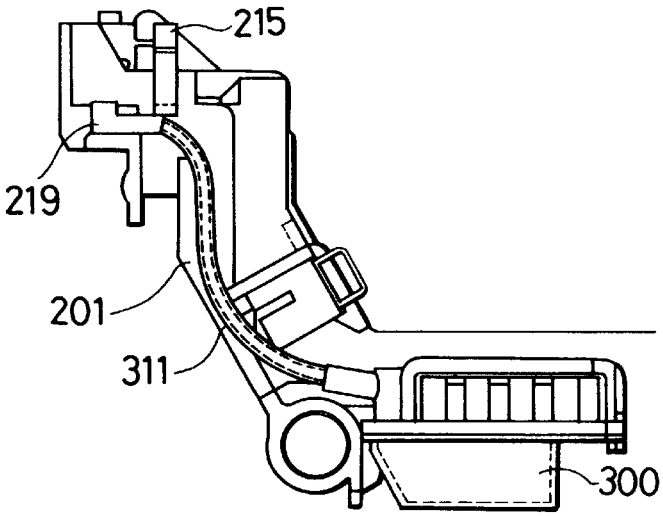
FIG. 4B is a side view of the carriage shown in FIG. 4A.
Figure 4C:
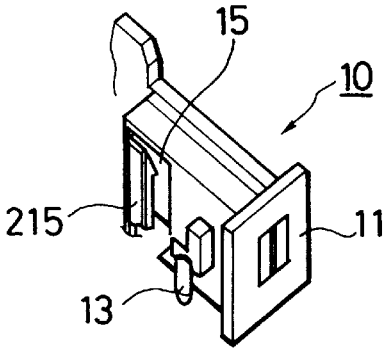
FIG. 4C is a perspective view of the recording head chip shown in FIG. 4A.

FIGS. 4A, 4B and 4C explain the manner how the head chips 10 are mounted. FIG. 4A is a front view of the carriage body 201 and one of the head chips 10. FIG. 4B is a cross-sectional side view in part of the carriage body 201. FIG. 4C is a perspective view of the head chip 10.

In FIGS. 4A to 4C, a guide channel 15 is formed on the head chip 10 and fits with the guide 215 formed at the head mount part of the carriage body 201 when the head chip 10 is mounted on the carriage body 201. An ink supply tube 13 used for supplying ink fluid into the common ink chamber in the head chip 10 is inserted into an ink supply port 219 provided on the carriage body 201 in mounting the head chip 10. With the above described structure, ink is supplied from an intermediate tank 300 to the common ink chamber in the head chip 10 through a ink supply tube 311, the ink supply port 219 and the ink supply tube 13.

Now referring to FIG. 4A, explained will be that the manner how the head chip 10 is mounted in the carriage body 201. In mounting the head chip 10 in the carriage body 201, at first, the guide channel 15 of the recording head chip 10 is engaged with the guide 215 on the carriage body 201. The head chip 10 is moved downward in accordance with the engagement of the guide 215 with the guide channel 15, and the ink supply tube 13 is inserted into the ink supply port 219 of the carriage body 201. The insertion of the inkisupply tube 13 into the ink supply port 2 be established smoothly by means of the guiding action of guide grove 15. The movement of the head chip 10 in the above described mounting is terminated when a bottom part of the head chip 10 reaches a bottom part of the head mount part of the carriage body 201. During the above described mounting work, a protrusion as a part of the aluminum supporting member for the head chip 10 is inserted in a concave portion formed in the carriage body 201 as shown in FIG. 3 so that the head chip 10 may be positioned in the direction in ejecting ink. After that, the position of each of the head chips 10 and the interval between adjacent head chips are fixed by means of mounting the head cover 205 which will be described in detail in FIGS. 5A to 5C.

Figure 5C:
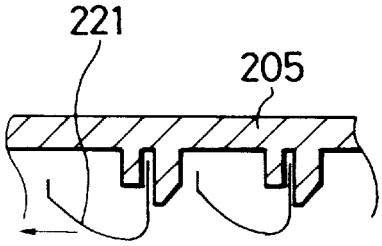
FIGS. 5A, 5B and 5C are, respectively, a back plan view, a cross-sectional side view and a cross-sectional upper and broken view of a head cover for the recording head unit shown in FIG. 3.
Figure 5B:
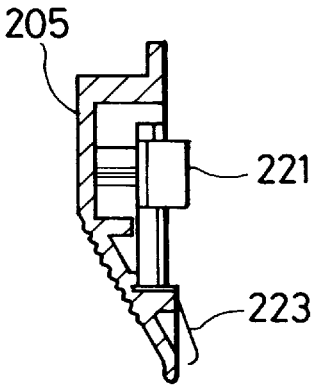
Figure 5A:
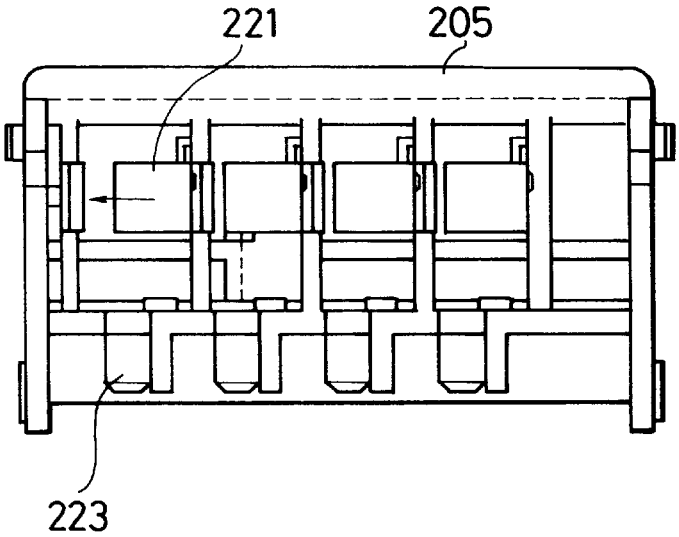

FIGS. 5A, 5B and 5C illustrate detailed structures of the head cover of first cover member 205; FIG. 5A is a back plan view of the head cover 205, FIG. 5B is a crosssectional side view of the head cover 205 and FIG. 5C is a cross-sectional upper view of a part of the head cover 205.

In the following, referring to FIGS. 3, 4A, 5A, 5B and 5C, positioning of the head chips 10 by the head cover 205 will be described.

As shown in FIG. 3, the head cover 205 is mounted in the carriage body 201 so as to cover the side part of the head chips 10 mounted in the carriage body 201 as described in FIGS. 4A, 4B and 4C. By mounting the head cover 205 in the carriage body 201 as described above, leaf springs 221 and 223 of the head cover 205 shown in FIGS. 5A to 5C, press the head chips 10 by means of elastic forces of the springs against a standard surface or mount member 217 and a standard surface or mount portion 218 defined on a bottom face of the head chip mounting part, respectively. As a result, the position of the recording head chips 10 can be fixed in the directions of the array of the head chips 10 (in the horizontal direction in FIG. 4A) and of the arrays of the ejection outlets of the respective head chip 10 (in the vertical direction in FIG. 4A). Thus, as the relative position between four standard surfaces 217 and 218 are respectively established precisely, the distances between the arrays of the ejection outlets of the recording head chips 10 and the relative positions of the arrays of the ejection outlets in the vertical direction are defined precisely.

Figure 6:
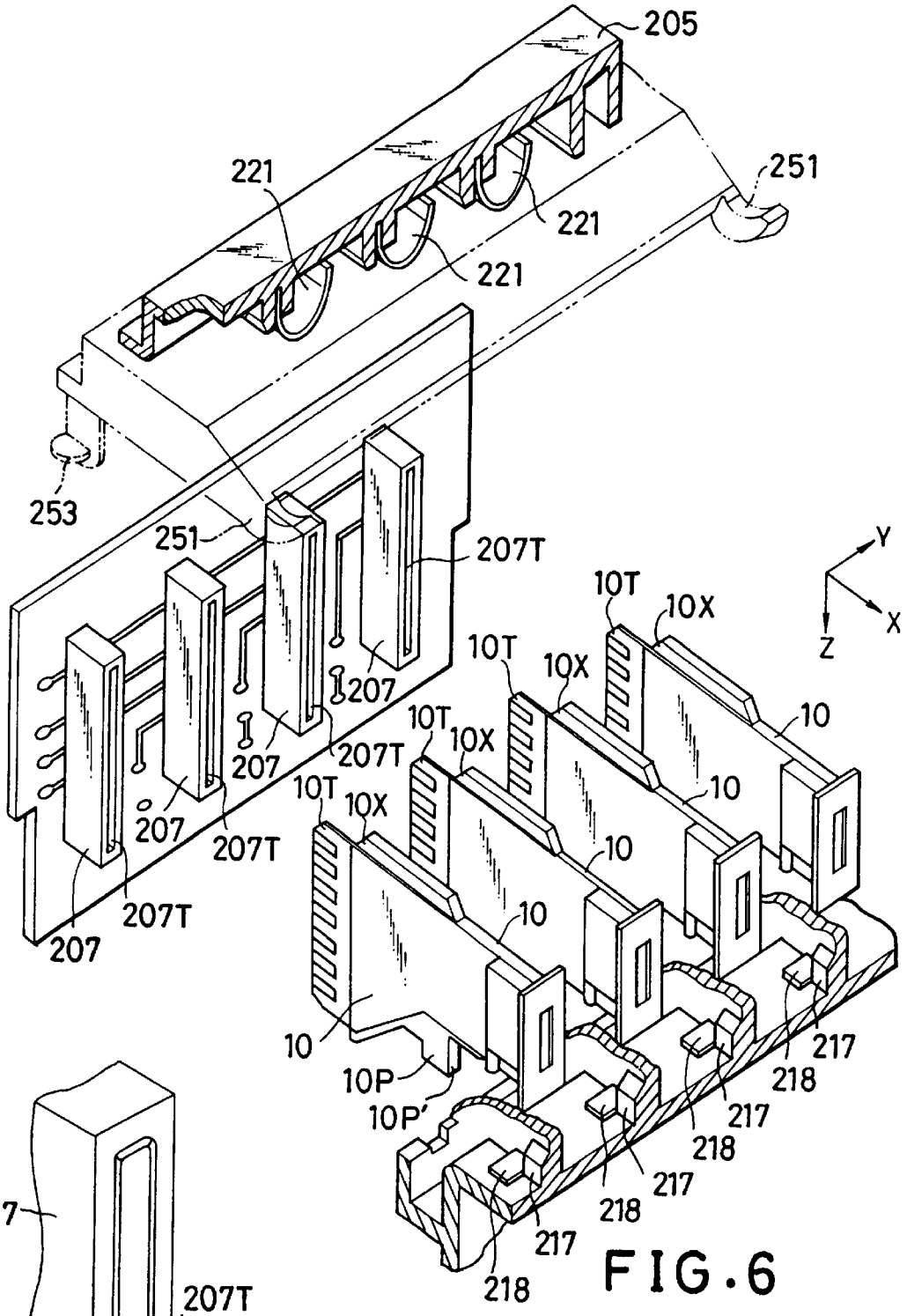
FIG. 6 is an exploded view of a carriage body, the head chip, the head cover, and a connector in the embodiment of the present invention.
Figure 6A:
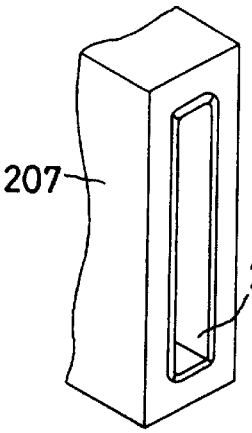
FIG. 6*a* is an enlarged view showing the rounded or tapered corners and edges of the connector.
Figure 7A:
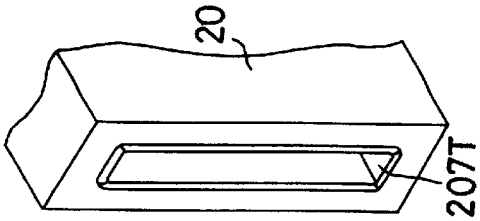
FIG. 7*a* is an enlarged view showing the rounded or tapered corners and edges of the electrical connector portion of the carriage cover.
Figure 7:
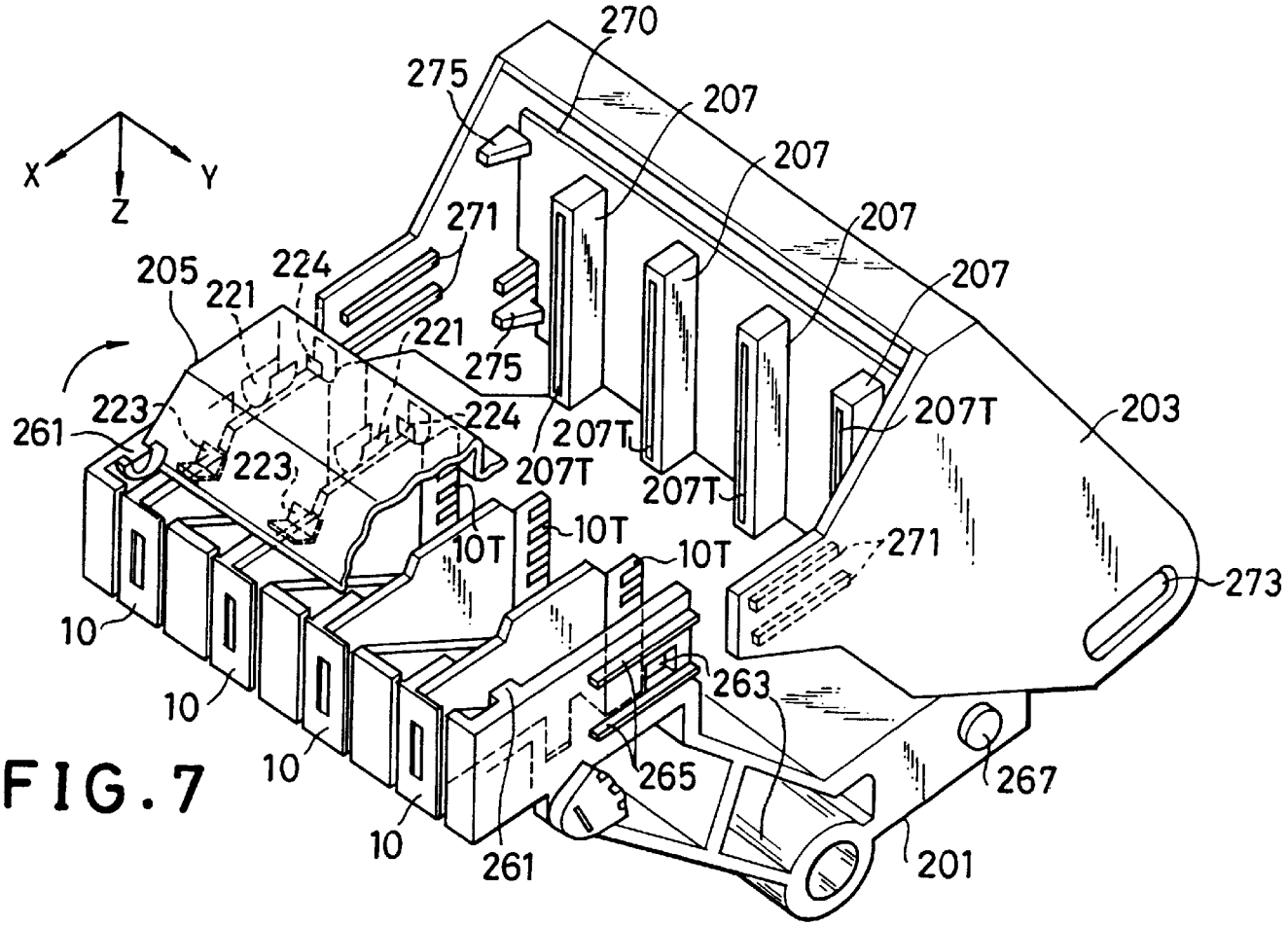
FIG. 7 is a perspective view of a carriage cover and the carriage body for explaining the installation of the carriage cover to the carriage body.
Figure 8:
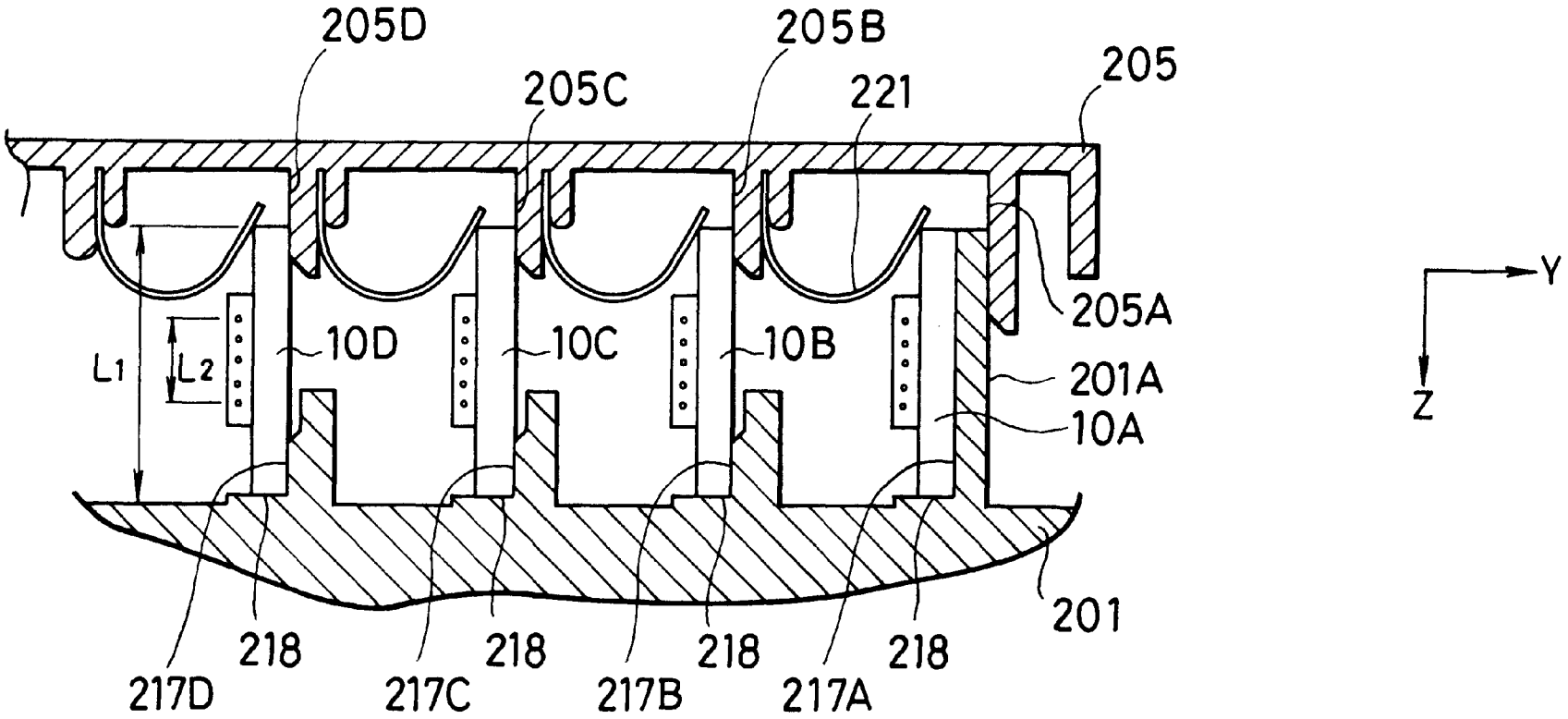
FIG. 8 is a cross-sectional upper and broken view of a part of the head chip and the carriage body, explaining the positioning of the head chip in the carriage body.

Referring to FIGS. 6, 7 and 8, explained will be the installation of the head cover 205 and the positioning of the head chips 10 accompanied with the installation of the head cover 205, and the installation of the carriage cover or second cover member 203 and the connection between the head chips 10 and the connector 207 accompanied with the installation of the carriage cover 203. FIG. 6 is a perspective view of a connector board having the electric connection portion connector 207, the carriage body 201, the head chips 10 and the head cover 205, showing the connector board disassembled into parts, FIG. 7 is a perspective view for explanation of installing the head cover 205 in the carriage body, and FIG. 8 is a schematic front view for explanation of positioning the head chips 10, showing a view from the side of an ejection outlet forming face of the head chip.

Referring to FIGS. 6 and 7, the head cover 205 has a hook 251 and a latch 253 on each side thereof. On the carriage body 201, protruding parts 261 and latch holes 263 are formed at the positions corresponding to hooks 251 and latches 253 of the head cover 205. In mounting the head cover 295 on the carriage body 201, by hooking the hooks 251 with the protruding parts 261 and rotating the head cover 205 around the protruding parts 261 in the clockwise direction designated by the arrow shown in FIG. 7, and coupling the latches 253 and the latch holes 263, the installation state as shown in FIG. 7 is established. In this state, springs 221 and 223 press the head chip 10 almost in the direction normal to datum faces 217 and 218, respectively, and hence, the head chips 10 may be positioned in the y direction of FIGS. 6 and 7 along which the head chips 10 are arrayed, and in the z direction of FIG. 6 and 7 along which ink ejection outlets in each recording head chip 10 are arrayed. And furthermore, on the head cover 205, a plurality of springs 224 are provided, each corresponding to each head chip 10 as shown in FIG. 7. In the installation state of the head cover 205 onto the carriage body 201. The springs 224 press the head chips 10 correspondingly at each part 10X on aluminum base board of the respective head chip 10 in the x direction of FIGS. 6 and 7 in which ink is ejected so that the face 10P' on the protruding part 10P of each recording head chip 10 may be pressed against the datum face 231' in the concave part 231. The springs 224 also generate a reactive force when caps, which are described later and are used for or ejection recovery operation, contact with the recording head chips and the springs 224 are used when the head chip is moved back to the datum face 231' after removing the caps from the recording head chips. With the structure described above, responsive to the installation of the head cover 205 in the carriage body 201, a plurality of recording head chips 10 are fixed securely in the carriage body 201 with respect to their x, y and z directions.

Now referring to FIG. 8, positioning of the head chips 10 is further explained in detail. The head chip 10A is pressed to the datum faces 217A and 218 of the carriage body 201 by the springs 221 and 223. The other three head chips 10B, 10C and 10D are also pressed to the datum faces 217B, 217C, 217D and 218, respectively. On the other hand, datum faces 205A to 205D are formed at the head cover 205. The datum face 205A and the spring 221 support the head chip 10A and the datum face 201A of the carriage body 201 between them. Owing to this structure, the positioning accuracy is maintained without producing a bending moment at the datum face 201A. Each pair of the datum faces 205B to 205D and the springs 221 also support the end parts of the head chips 10B to 10D between each pair of them, respectively. Therefore, in fabricating the carriage body 201, by controlling the tolerance in determining the distances between datum faces, 217A and 201A, 217A and 217B, 217A and 217C, and 217A and 217D, and in fabricating the head cover 205, by controlling the tolerance in determining the distances between datum surfaces, 205A and 205B, 205A and 205C, and 205A and 205D, the relative gradient between every pair of the head chips 10A to 10D may be maintained to be deviated within a required allowance value. And also, by means of determining the front height L1 of the head chip 10 to be greater enough than the range L2 of the array of the ink ejection outlets, the gradient of the array of the ink ejection outlets, which gives influence over the recording quality, may be further less than that of the over all head chip, and hence the recording quality may be improved.

Next, referring mainly to FIG. 7 again, described is the installation of the carriage cover 203 and the connecting the connector 10T of each of the head chips 10 and the connector 207 of the carriage cover 203 accompanied by the installation of the carriage cover 203.

A pair of rails 271 and a elongate groove 273 are formed at each side part of the carriage cover 203; each pair of rails 271 and each elongate groove 273 are coupled with the guide parts 263 and the protruding parts 267 of the carriage body 201 respectively so that the carriage cover 203 may be guided in the x direction of FIG. 7 and mounted on the carriage body 201. In this installation operation, the connectors 10T are caught by the catcher part 207T of the connector 207 respectively and the coupling between the connectors 10T and parts 207 are established.

The catcher part 207T of each of the connectors 207 is shaped in a rectangular opening thereof with its corners and edges rounded or with its edges tapered so that the connector 10T may be inserted smoothly into the catcher part 207T. In addition, as described above, as the head chips 10 are so positioned as a result of the installation of the head cover 205, the connector 207 can be movable in relative to the carriage cover 203, so that an unfavorable external force due to correcting the displacement between the connectors 207 and 10T when coupling the connectors 207 and 10T may not be directly applied to the head chip 10. In order to make the connector 207 movable relative to the carriage cover 203, it may be supposed to be effective that the material used for the connector 207 is selected to be relatively flexible or that the connector 207 is mounted on the connector base board 270 with a little displacement of the connector 207 being allowed or that elastic bonding materials are used for fixing the connector 207 onto the connector base board 270. In this embodiment, the connector base board 270 itself is loosely supported by the support part 275 formed on the carriage cover 203 so that a little displacement of the connector base 270 itself may be allowed with respect to the movement of the connector 207.

According to the above described embodiment of the present invention, as the electric connectors of the carriage cover 203 can have a small displacement in accordance with a gap between the electric connectors of the head chip 10 and the electric connectors of the carriage cover, even if the connector 10T of the head chip 10 and the connector 207 of the carriage cover 270 do not face exactly to each other, the coupling of the connectors with each other is performed securely and easily. And also, as an unnecessarily excess amount of external force is not applied to the head chip, it will be appreciated that the accuracy in positioning the head chip can be maintained to a predetermined degree.

Figure 9:
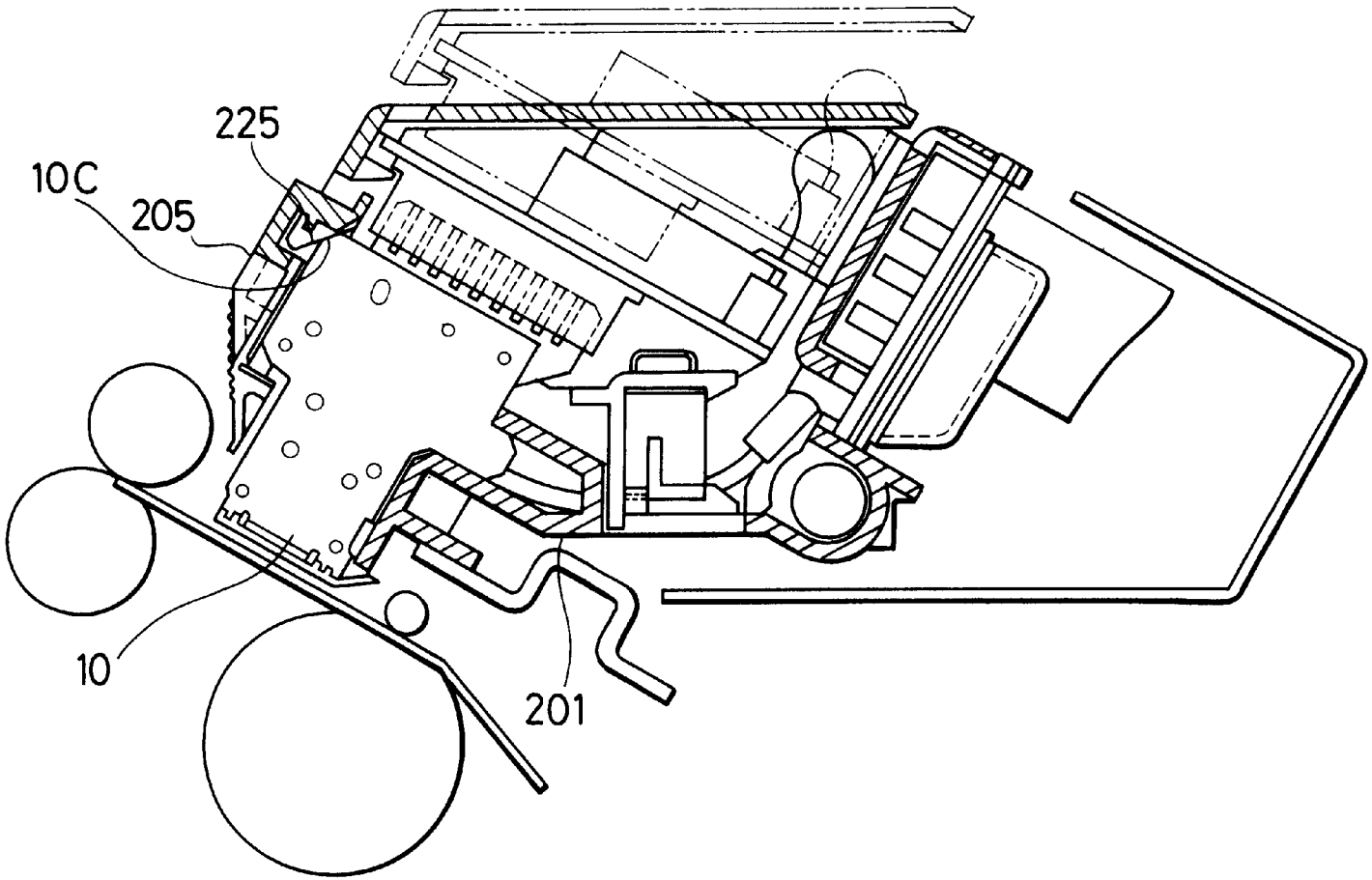
FIG. 9 is a cross-sectional side view of the recording head, for explaining unit positioning of the recording head unit with the head cover in another embodiment of the present invention.

Incidentally in this embodiment, though the number of springs pressing the head chips 10 to the datum faces used for positioning the head chips 10 in the x, y and z directions is taken to be three, it is allowed that a single spring is used for pressing the head chip in two or three directions in the three-dimensional coordinate and the number of springs pressing the head chip 10 may be taken to be two or one by means of determination of the shape and the gradient of the head chip 10 and the spring constant in designated values. Referring to FIG. 9, one embodiment using two springs will be explained below.

FIG. 9 is a cross-sectional side view of the head chip 10 and the carriage body 201, showing another embodiment for positioning the head chip 10 by means of the head cover 205.

As shown in FIG. 6, springs 225, the elasticity of each of which are properly determined, is provided in correspondence to each of the head chips 10 instead of using the leaf springs 224 and further by omitting the leaf springs 223, the springs being shown in FIGS. 5A to 5C. The leaf springs 225 are attached at the respective end part of the head cover 205 and press the surface 10C formed on the corner of the head chip 10. With this structure, the forces, which are generated by the leaf springs 225 and are applied to the surface 10C, include one component parallel to the direction in which ink droplets are ejected from the ejection outlets and another component parallel to the direction in which the ejection outlets are arrayed, and the recording head chip 10 can be positioned in the above two directions.

Figure 10A:
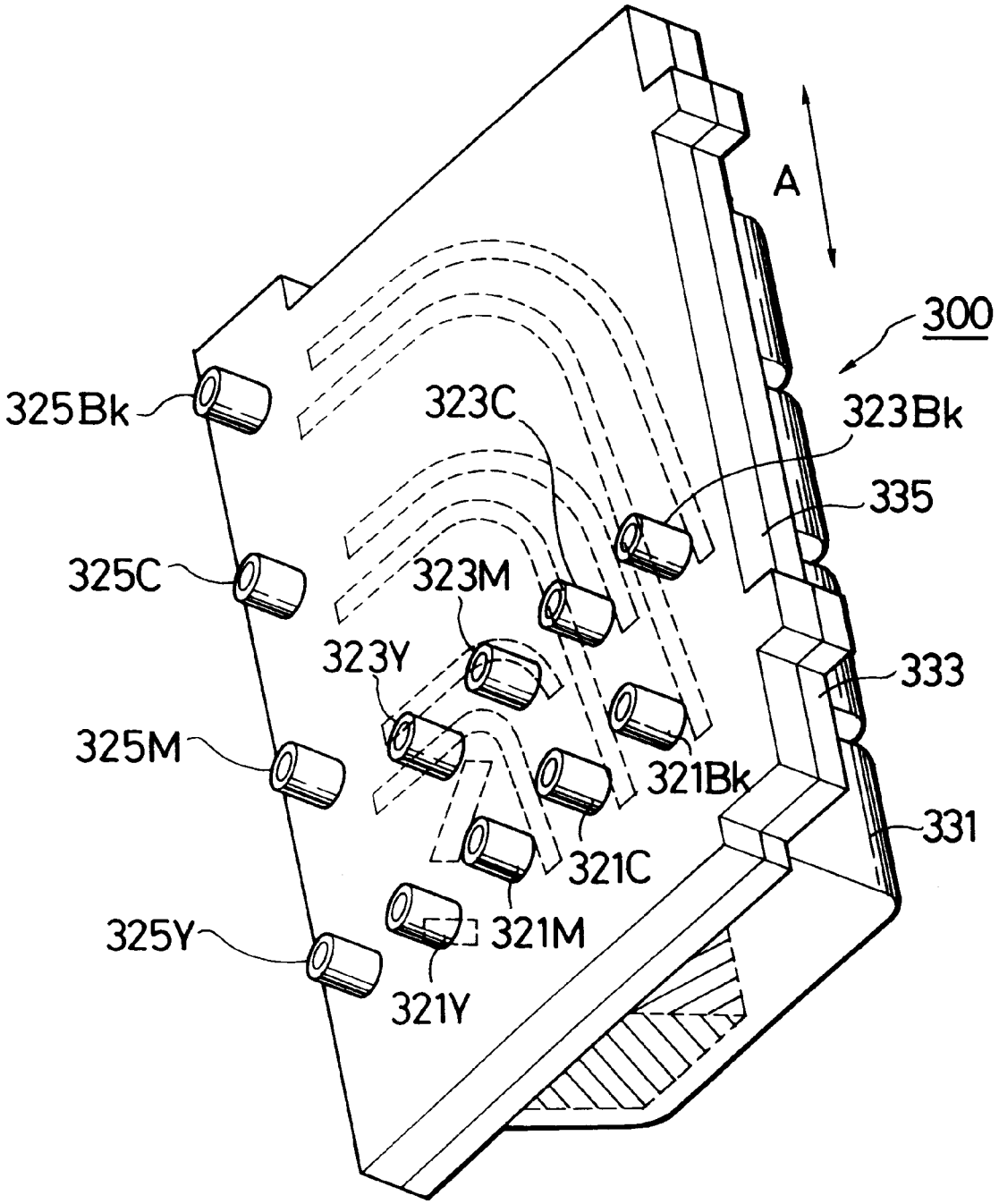
FIGS. 10A and 10B are perspective views of an intermediate tank shown in FIG. 2A, each being viewed in a different direction to each other.
Figure 10B:
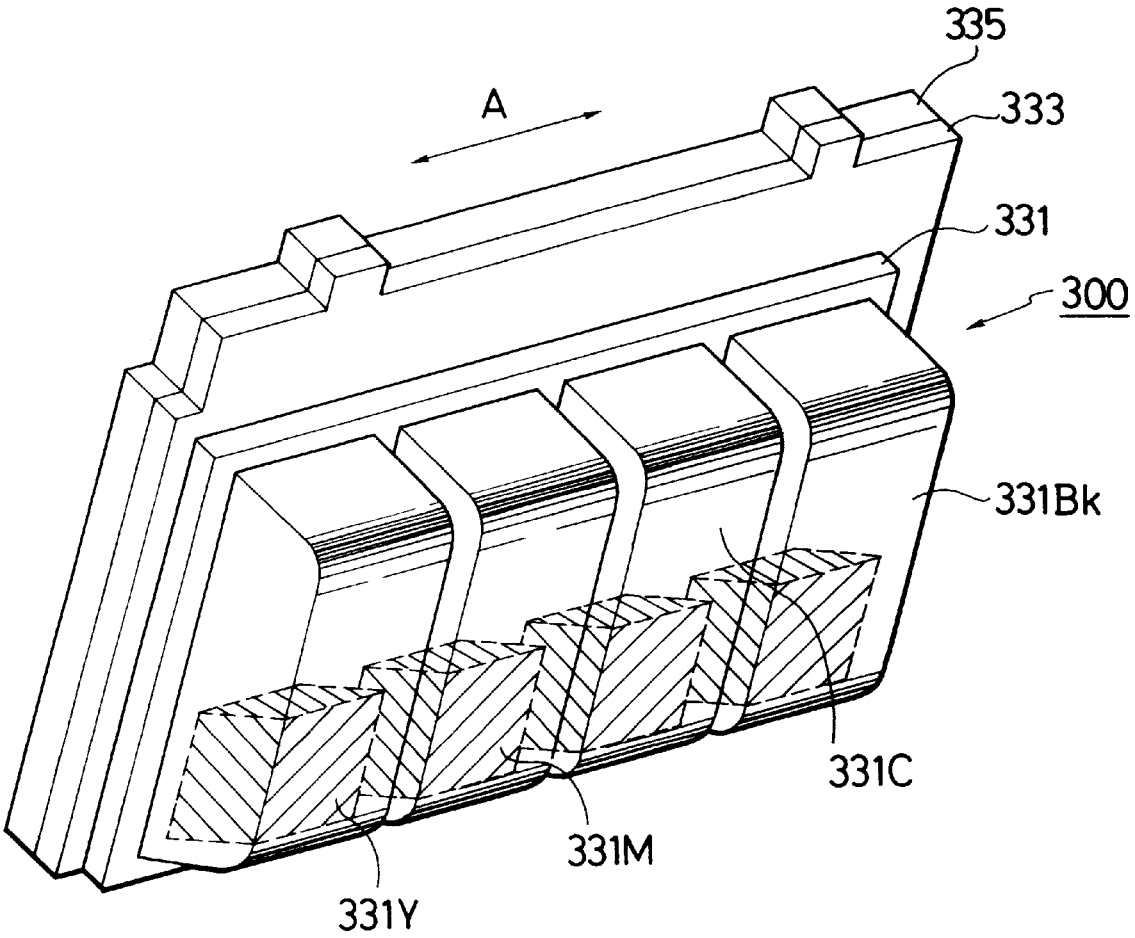

FIGS. 10A and 10B are perspective views for illustrating detailed structures of the intermediate tank 300 shown in FIG. 2A and so on; FIG. 10A shows the face of the intermediate tank 300 on which the carriage body 201 contacts for attachment thereof and FIG. 10B shows the opposite face of the face shown in FIG. 10A. And furthermore, FIG. 8 is an perspective view of a part of the intermediate tank with its components shown to be disassembled.

Figure 11:
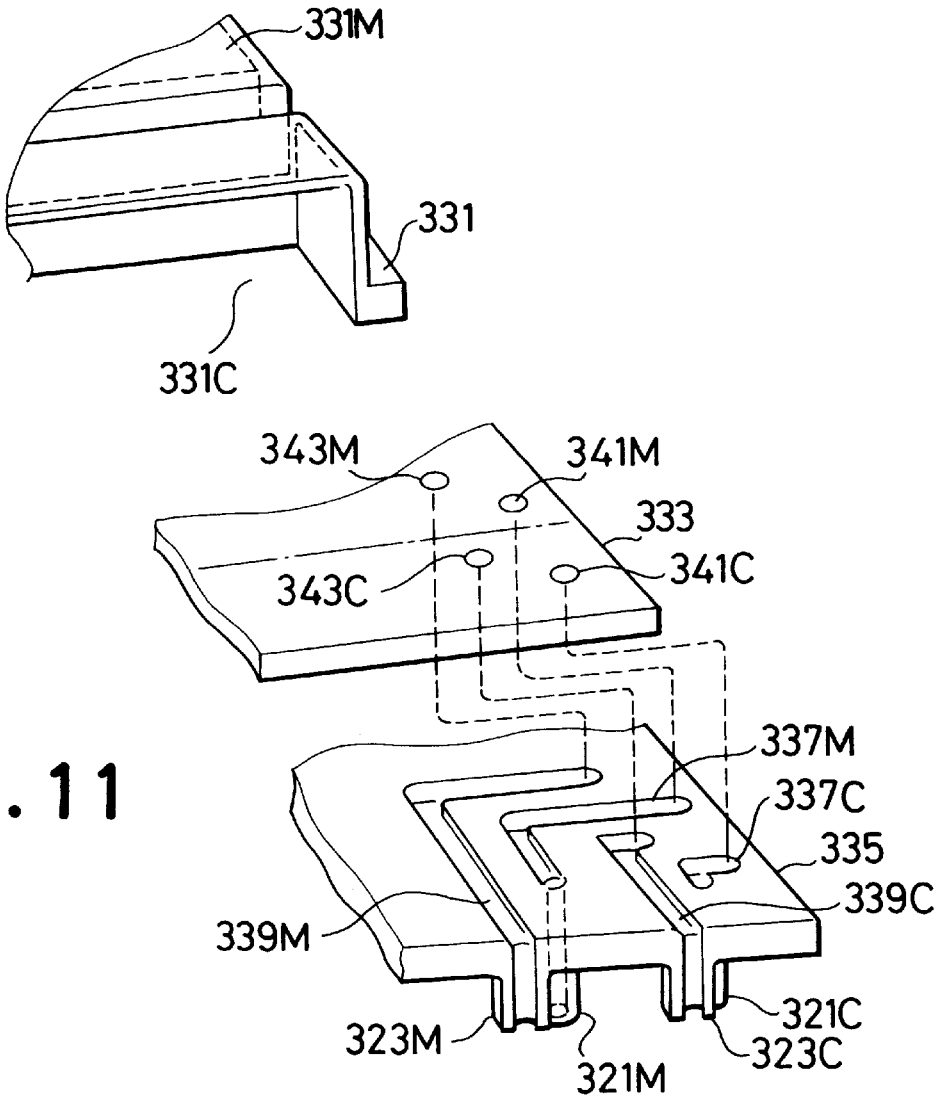
FIG. 11 is a perspective view of a part of the intermediate tank with its components seperated.

As shown in FIGS. 10A, 10B and 11, the intermediate tank 300 has three parts. More specifically, the intermediate tank 300 is composed of a tank member 331 forming an ink room (or chamber) and an air room (or chamber), an intermediate plate 333 at which a linking holes are formed and a connection plate 335 on which a linking channel (or chamber) and a connection pipe are formed. These parts are obtained, for example, by forming synthetic polymer materials molded in a designated shape, and these parts are bonded to each other by a supersonic melting and bonding method.

The tank member 331 has four rooms 331BK, 331C, 331M and 331Y, each corresponding to an individual ink color.

In the intermediate plate 333, as shown in detail in FIG. 11, linking holes for linking each of rooms 331BK, 331C, 331M and 331Y and the corresponding linking channels on the connection plate 335 are formed. Among these linking holes, the linking holes 341Y, 341M, 341C and 341BK, while 341Y and 341BK being not shown in FIG. 11, connect to connection pipes 321Y, 321M, 321C and 321BK, respectively as shown in FIG. 10A, and further form a part of ink routes (or paths) for flowing of ink from the ink cartridge 901. And also, remaining linking holes, 343Y, 343M, 343C and 343BK, while 343Y and 343BK being not shown in FIG. 11, link to connection pipes 323Y, 323M, 323C and 323BK, respectively, and form a part of air routes for flowing of air sucked from each of the four rooms by the ejection recovery unit to be described later. Not shown in FIG. 11 but on the intermediate plate 333, linking a hole for forming a part of an ink supply route to the head chips 10 from each of the four rooms described above is formed in corresponding to each position of the connection pipes 325Y, 325M, 325C and 325BK on the connection plate shown in FIG. 10A.

On the connection plate 335, as shown in FIG. 10A, three kinds of connection pipes described above are formed. More specifically, an ink supply tubes from the ink cartridges 901 described above is connected to the connection pipes 321Y, 321M, 321C and 321BK, and the tubes to the suction pump in the ejection recovery unit are connected to the connection pipes 323Y, 323M, 323C and 323BK, and also, the ink supply tubes to the head chips 10 are connected to the connection pipes 325Y, 325M, 325C and 325BK.

And furthermore, the above described pipes are arranged in the following manner. For example, as shown in FIGS. 4A and 4B, the intermediate tank 300 is attached to the carriage body 201 so that the direction in which the longer side of the intermediate tank 300 is expanded may be parallel to the direction in which the head chips 10 are arrayed. In this arrangement, each of the connection pipes 325Y, 325M, 325C and 325BK is arranged on the connection plate 335 so as to be located below its corresponding head chip 10. With this structure, it will be appreciated that, as shown in FIG. 4B, four ink supply tubes 311 for connecting each of the connection pipes 325Y, 325M, 325C and 325BK and its corresponding head chip 10 are only bent within one plane which are parallel to the plane of FIG. 4B so that smooth ink supply can be attained. Additionally, as the bend of the tubes 311 is restricted within the plane described above, the movement of the carriage may give less effect on the ink supply work. Furthermore, in the above described arrangement of connection pipes, in order to minimize the length of pipe routes from each of the rooms of the tank member 331 to each of connection pipes and to reduce the adverse effect brought by the movement of the carriage body 201, it is desirable to select the arrangement of the connection pipes 325Y, 325M, 325C and 325BK to be expanded in the direction along the longer side of the intermediate tank 300 as shown in FIG. 10A. In order to realize the above arrangement, on the intermediate plate 333, a linking hole, not shown in FIG. 10A, is formed at the position corresponding to each of the connection pipes 325Y, 325M, 325C and 325BK.

As for the connection pipes which are designated by letters with numerals 321 and 323, hereinafter designated by only numerals 321 or 323, the arrangement is defined in the following manner.

At first, the positions of the connection pipes are fixed so that tubes connected to the connection pipes may be expanded in the direction along which the longer side of the intermediate tank 300 is defined, that is, the direction along which the carriage body moves toward the arrow A shown in FIGS. 10A and 10B. Second, the arrangement of the connection pipes is determined so that sets of tubes, each set of tubes corresponding to an individual ink color tone of four color tones, may be connected to the connection pipes by group. According to the above described first and second manner of positioning the connection pipes 321 and 323, the arrangement of the connection pipes 321 and 323 is established along the direction vertical to the direction in which the carriage body moves.

Figures 13A, 13B:
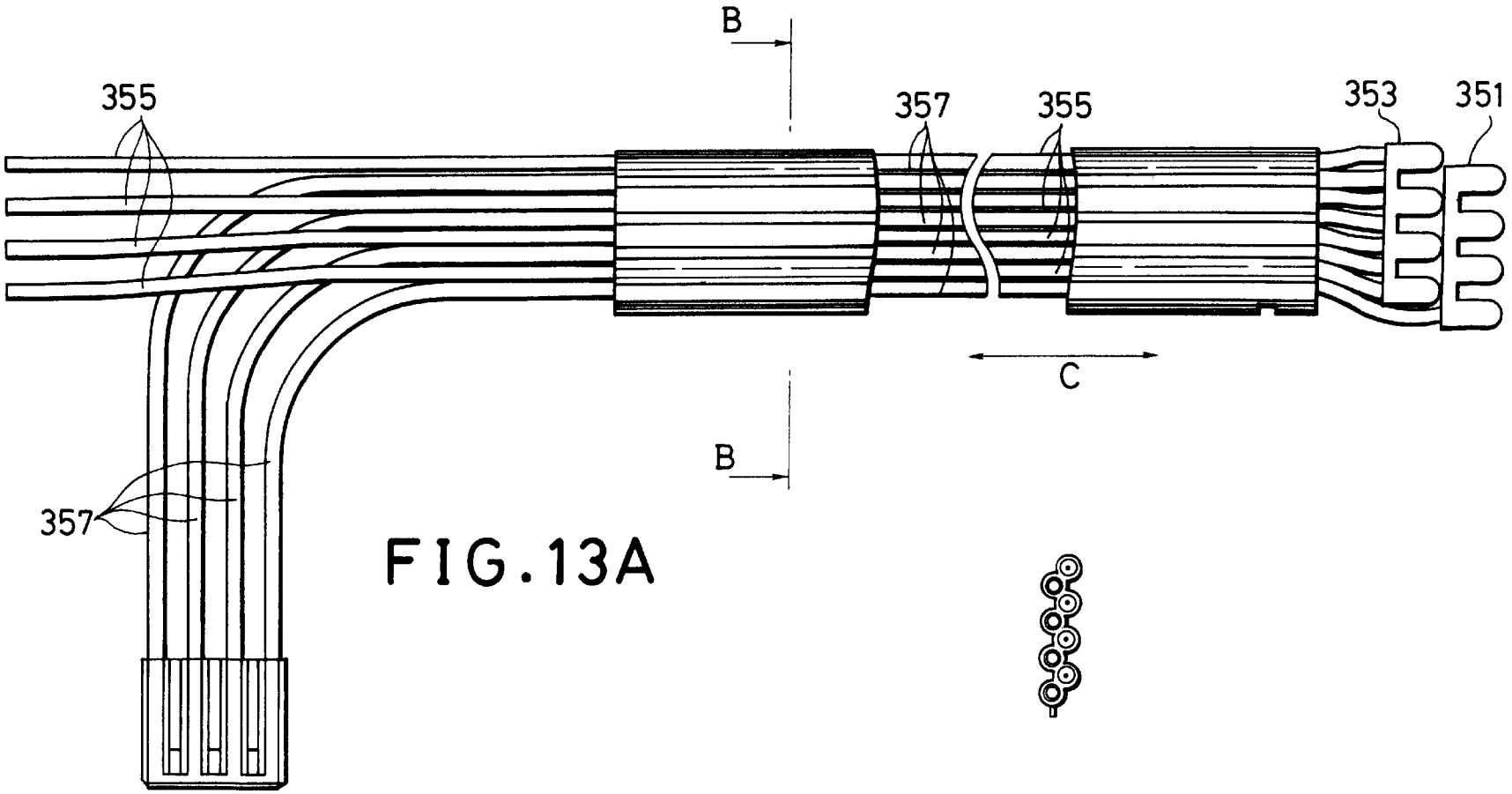
FIG. 13A is a top plan view showing an example structure of a connection tube and a tube unit used for an ink supply system of the ink jet recording apparatus of the present invention.
FIG. 13B is a cross-sectional view taken along line B—B in FIG. 13A.

FIG. 13A is an plan view of the tube unit connected to the connection tubes 321 and 323. FIG. 13B is a cross-sectional view taken along line B—B in FIG. 13A. In FIG. 13A, joints 351 and 353 are shown, each connecting to the connection pipes 321 and 323, respectively. In response to the movement of the carriage 200 in the direction designated by the arrow C in FIG. 13A, the tubes 355 and 357 move flexibly, and according to the above described arrangement of the connection pipes, the tubes 355 and 357 may be extended toward the designated direction, that is, the direction of the movement of the carriage 200. In the tubes 355 and 357 following the movement of the carriage 200, the tubes 355 and 357 only bend in a designated direction. With this arrangement, the movement of the carriage 200 may give less effect on ink supply by the tubes 355 and 357.

In accordance with the above described arrangement of the connection pipes 321 and 323, as shown in FIG. 11, channels 337Y, 337M, 337C and 337BK and 339Y, 339M, 339C and 339BK, while 337Y, 337BK, 339Y and 339BK being not shown in FIG. 11, are formed on the connection plate 335, so that each of the connection pipes and each of the tank rooms 331Y, 331M, 331C and 331BK are connected to each other through these channels.

Figure 12:
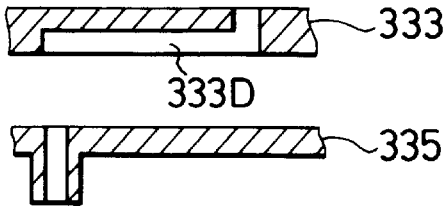
FIG. 12 is a partial cross-sectional view illustrating the intermediate tank in another embodiment of the present invention.

FIG. 12 is a cross-sectional view of the intermediate tank 300, showing another embodiment of the present invention. As shown in FIG. 12, a channel 333D for connecting ink tank rooms and connection tubes may be formed on the intermediate plate 333.

Incidentally, the above described structure and arrangement of the intermediate tank 300 is effective and applicable generally to a sub-ink-reservoir member installed in the ink supply route of the ink jet recording apparatus and used for reserving ink or air temporarily. In addition, by means of the above described structure and arrangement of the intermediate tank 300, in installing the sub-ink-reservoir in the unit including a moving member such as the carriage, it will be appreciated that the layout of ink route members such as tubes can be simplified. As a result, the above described structure and arrangement of the intermediate tank 300 may be applicable, for example, to an ink-reservoir disposed in an ink fluid route for exhausted ink or to the structure of the ink tank established as an ink supply source.

Figure 14A:
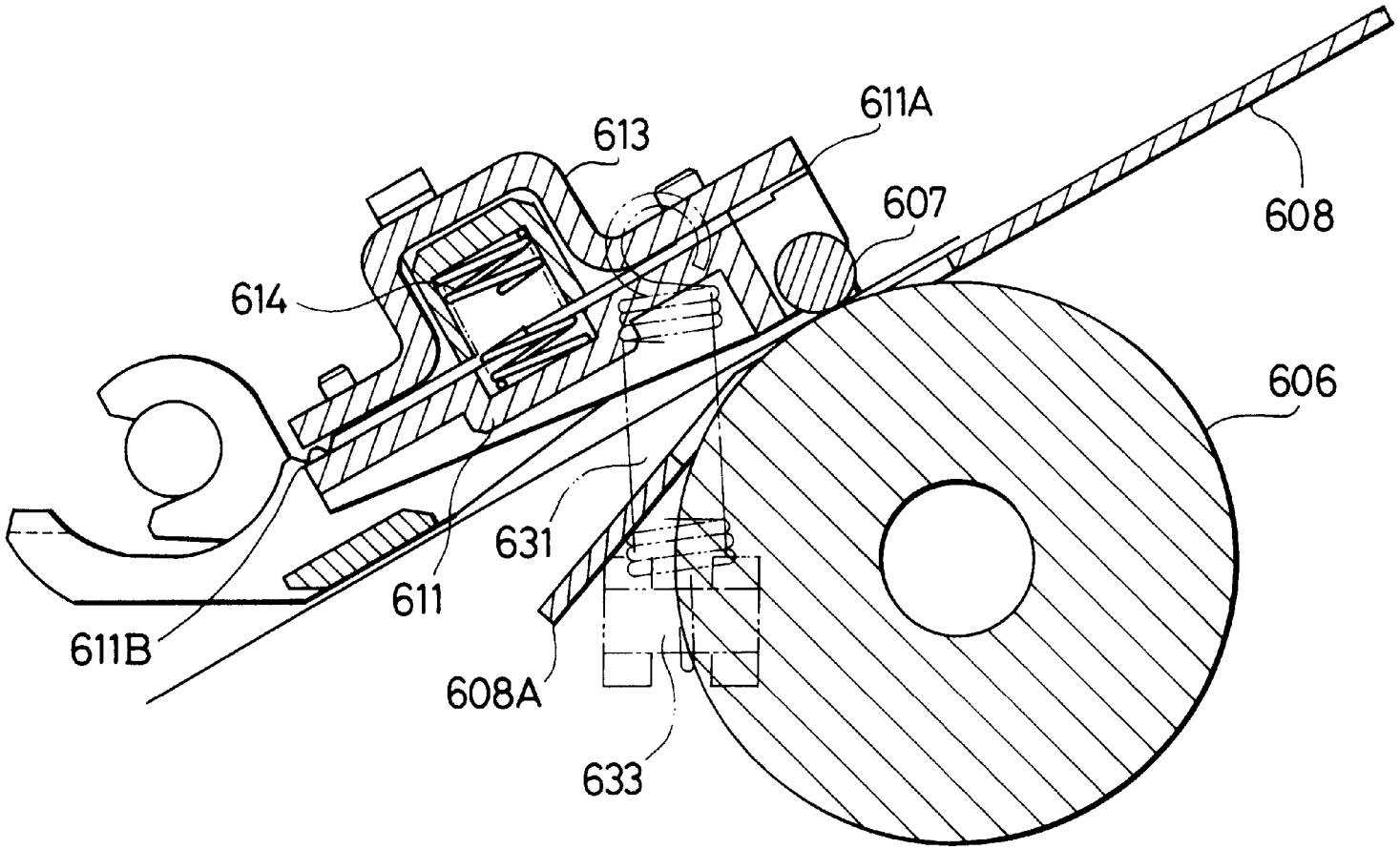
FIGS. 14A and 14B are sectional side views of a paper transport mechanism of the ink jet recording apparatus of the present invention, showing cases of transporting a thin sheet paper and a thick sheet paper, respectively.
Figure 14B:
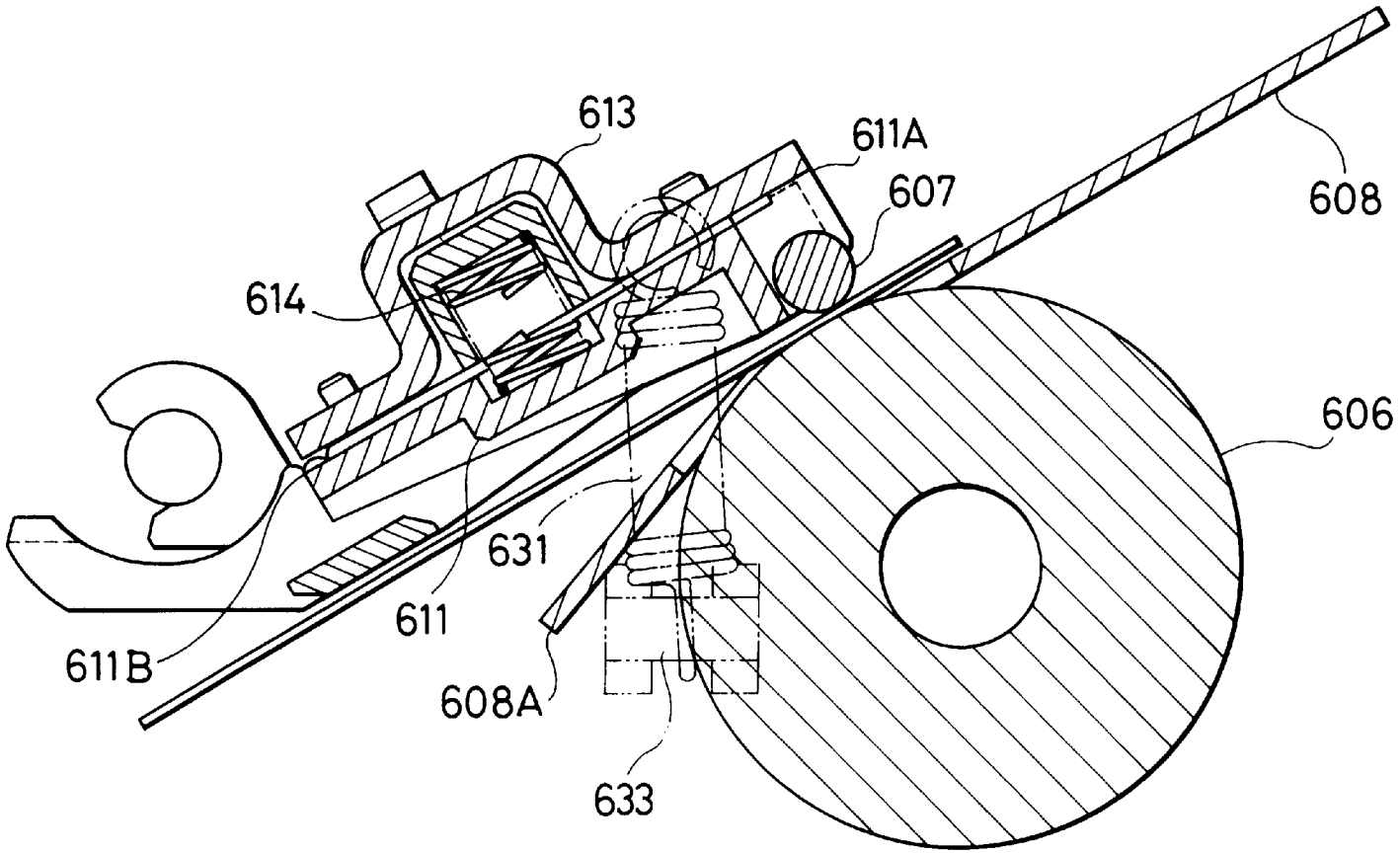

FIGS. 14A and 14B are cross-sectional views of the paper transport mechanism, each shown in FIGS. 2A and 2B; FIG. 14A shows a case in transporting a thin sheet of the recording paper and FIG. 14B shows a case in transporting a thick sheet of the recording paper.

In FIGS. 14A and 14B, the pinch rollers 607 are rotatably supported by the pinch roller holders 611, the end part 611B of which are engaged with the carriage rail 613 so as to rotate freely in relative to the carriage rail 613. The coil springs 614 are respectively inserted between the each of pinch roller holders 611 and the carriage rail 613. The carriage rail 613 is pushed downward in FIGS. 14A and 14B by the coil springs 631 hung on hang portions 613A formed at the both ends of the longer side of the carriage rail 613 so that the carriage rail 613 may contact a part of the apparatus frame. As a result, by means of the elastic force produced by the coil spring 614, the pinch rollers 607 are pressed against the paper transport roller 606 through the recording paper inserted between rollers 606 and 607.

In the above described structures shown in FIG. 14A, in the case of supplying the recording paper with a relatively small thickness, the displacement of the pinch rollers 607 due to insertion of the recording paper between the pinch roller 607 and the paper transport rollers 606 are absorbed by translating the displacement to the displacement in rotating movement of the pinch roller holder 611 around its end part 611B in the counterclockwise direction as shown in FIG. 14A.

On the other hand, as shown in FIG. 14B, in the case of supplying the recording paper with a relatively large thickness, the displacement of the pinch rollers 607 can not be absorbed only by the above described angular displacement of the pinch roller holders 611, and hence the pinch roller holders 611 are further displaced in rotation to make their respective other end contact with the carriage rail 613 in accordance with the displacement of the pinch roller 607. And furthermore, the pinch roller holders 611 push up the carriage rail 613 against the elastic force produced by the coil spring 631. That is, in the case of transporting the relatively large thickness paper, the displacement of the pinch roller 607 is absorbed by the rotating movement of the pinch roller holder 611 and the following linear movement of the carriage rail 613.

As the carriage rail 613 contacts with the carriage body 201 or the press member 211A at the positions in accordance with the positions of the above described position lever 211, the carriage part 200, and hence, the recording head part 1 are displaced in accordance with the displacement of the carriage rail 613.

According to the above described paper transport mechanism, in the case that the thickness of the recording paper is relatively small, the pinch roller 607 can apply a desirable amount of pressing force on to the paper transport roller 606 through the recording paper in accordance with the thickness of the recording paper only by means of the rotating movement of the pinch roller holder 611. In the case that the thickness of the recording paper is relatively large, the pinch roller 607 can apply pressing force with a desirable intensity in accordance with the thickness of the recording paper onto the paper transport roller 606 by both of the rotating movement of the pinch roller holder 611 and the linear movement of the carriage rail 613. In addition, the distance between the plane of the recording paper and the recording head may be maintained to be desirable with respect to the thickness of the recording paper. The above described paper transport mechanism works effectively in both cases in selecting the position of the position lever to be position I or position II.

Figure 15A:
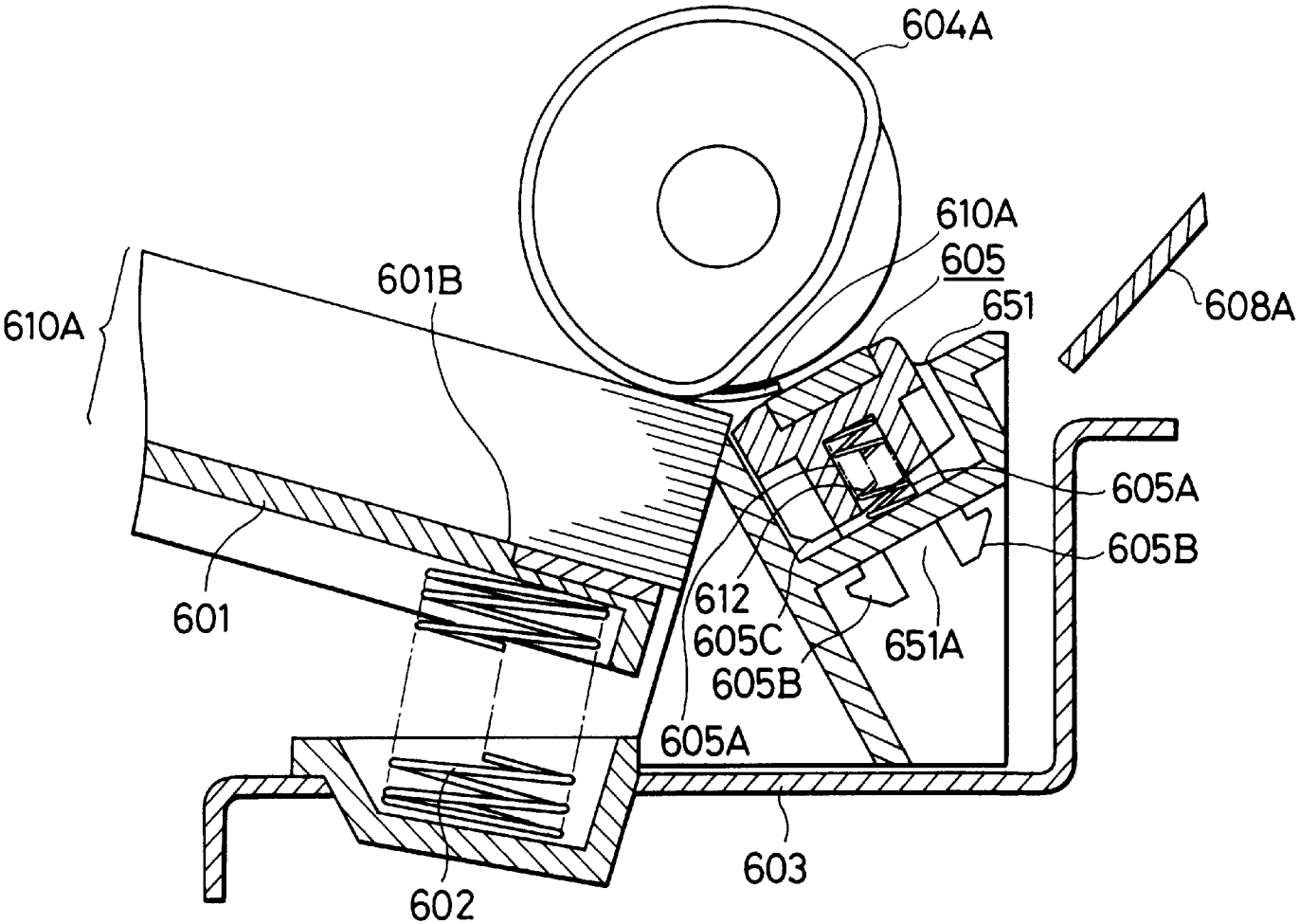
FIGS. 15A and 15B are sectional side views of a paper feed mechanism of the ink jet recording apparatus of the present invention, showing cases of feeding a thin sheet paper and a thick sheet paper, respectively.
Figure 15B:
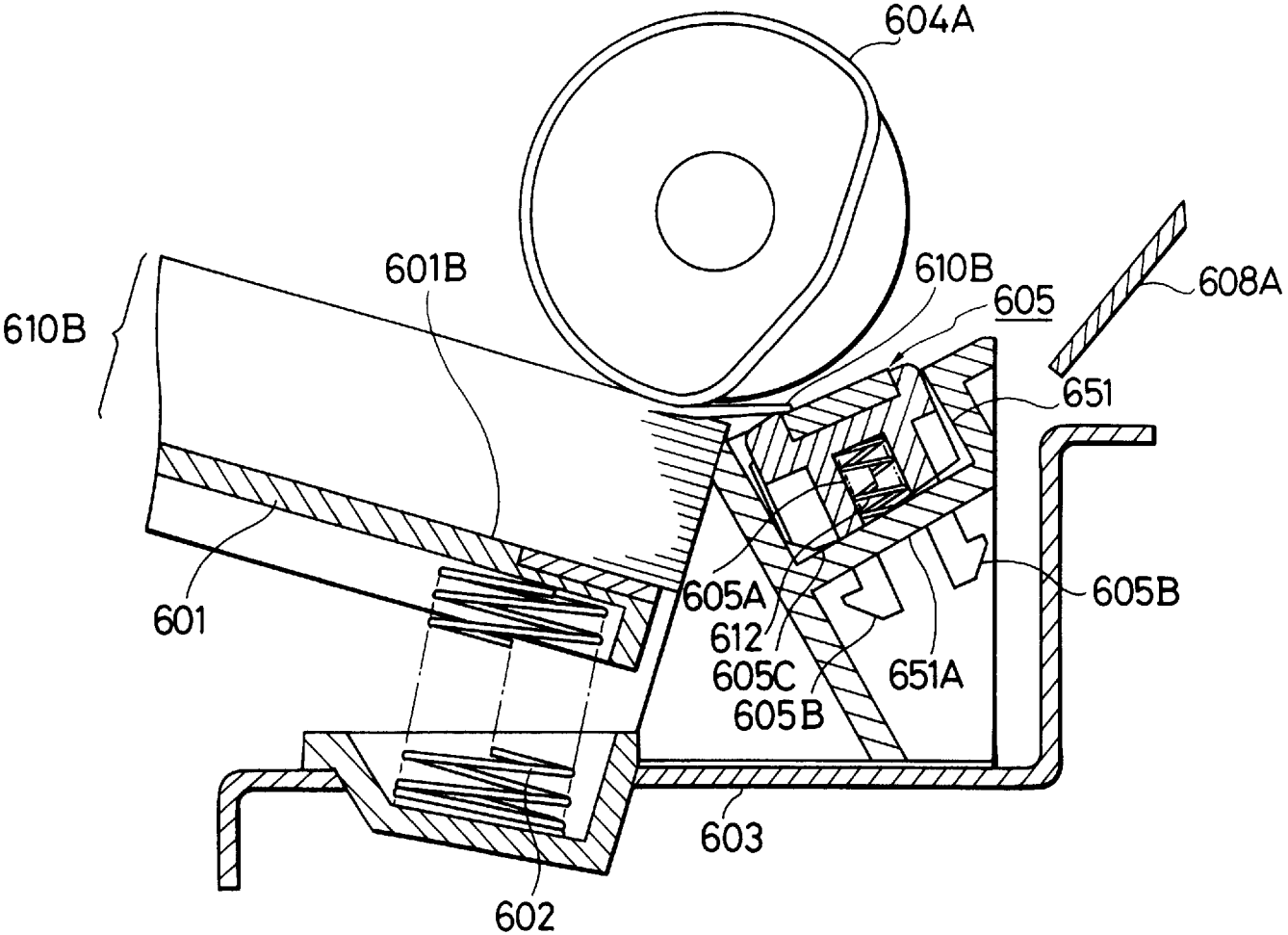

Now referring to FIGS. 15A and 15B, the structure and working mechanisms of the paper supply unit of one embodiment of the present invention will be disclosed in detail. FIG. 15A shows the action of the separation plates 605 in the case of using a recording paper 601A, or called simply a sheet, with its thickness being relatively small. FIG. 15B shows the action of the separation plates 605 in the case of using a recording paper 601B, or called simply a sheet, with its thickness being relatively large. In FIGS. 15A and 15B, channels 651, which are provided on support members 603 forming a part of the apparatus frame, respectively support loosely the separation plates 605 (only one separation plate 605 is shown in FIGS. 15A and 15B). The opening of the channels 651 points to the center of the axis of the pick roller 604.

Each of the separation plates 605 is provided with a coil spring 612 supported between a channel 605A of the separation plate 605 and the bottom of the channel 651. A part of the separation plate 605 is composed of click parts 605B forming the channel 605A for supporting the spring coil 612. By making coupling holes 651A formed at the bottom of the respective channels 651 catch these click parts 605B, the separation plates 605 are respectively locked in the channels 651. In the above structure of the separation plates 605, each of the separation plates 605, being supported by the coil spring 612, can swing freely and can move up and down within the channel 651, being guided in the channel 651. The coil spring 612 is selected so as to have a desirable elasticity relative to the stiffness of the materials used for the recording paper.

In the paper supply unit formed in the above described manner, as shown in FIG. 15A, there may be the case that a plurality of thin sheets 610A of recording papers composed of the material with lower stiffness are stacked on the paper supply tray 601. In this case, at the time when the pickup roller 604 is driven in response to the signal for controlling paper supply actions of the apparatus, the top sheet of the sheets 610A is picked up and forwarded. Next, the front edge of the picked up sheet 610A reaches and contacts to the separation plates 605. In response to this contact, each of the separation plates 605 is moved to a position which is determined in accordance with a balance of the elasticity of the coil spring 612 supporting the separation plate with the stiffness of the sheet 610A. Thus, the approach angle of the sheet 610A to the separation plates 605, the angle being defined as a angle between the direction in which the sheet 610A approaches to the separation plates 605 and the plane of the separation plates 605, can be made suitable. As a result, the frictional force (the transporting force) produced between the half-moon roller 604A and the recording sheet 610A may be maintained to be in a good condition.

As shown in FIG. 15B, there will be described another case that a plurality of thick sheets 610B of recording papers composed of the material with relatively higher stiffness are stacked on the paper supply tray 601. When the sheet 610B is forwarded between the pickup roller 604 and the separation plates 605, each of the separation plates 605 is pushed down by the edge of the sheet 610B and the edge part 605C thereof contacts the bottom of the channel 651, so that each of the separation plates 605 moves rotationally about the contacting point of the edge part 605C as a fulcrum. As a result, in the case of FIG. 15B, the approach angle defined between the recording sheet 610B and the top plane of the separation plate 605 is less than the approach angle shown in FIG. 15A, and hence, the friction force produced between the half-moon roller 604A and the recording sheet 610B is prevented from increasing excessively so that failures in supplying thick recording sheets can be avoided.

Figure 16:
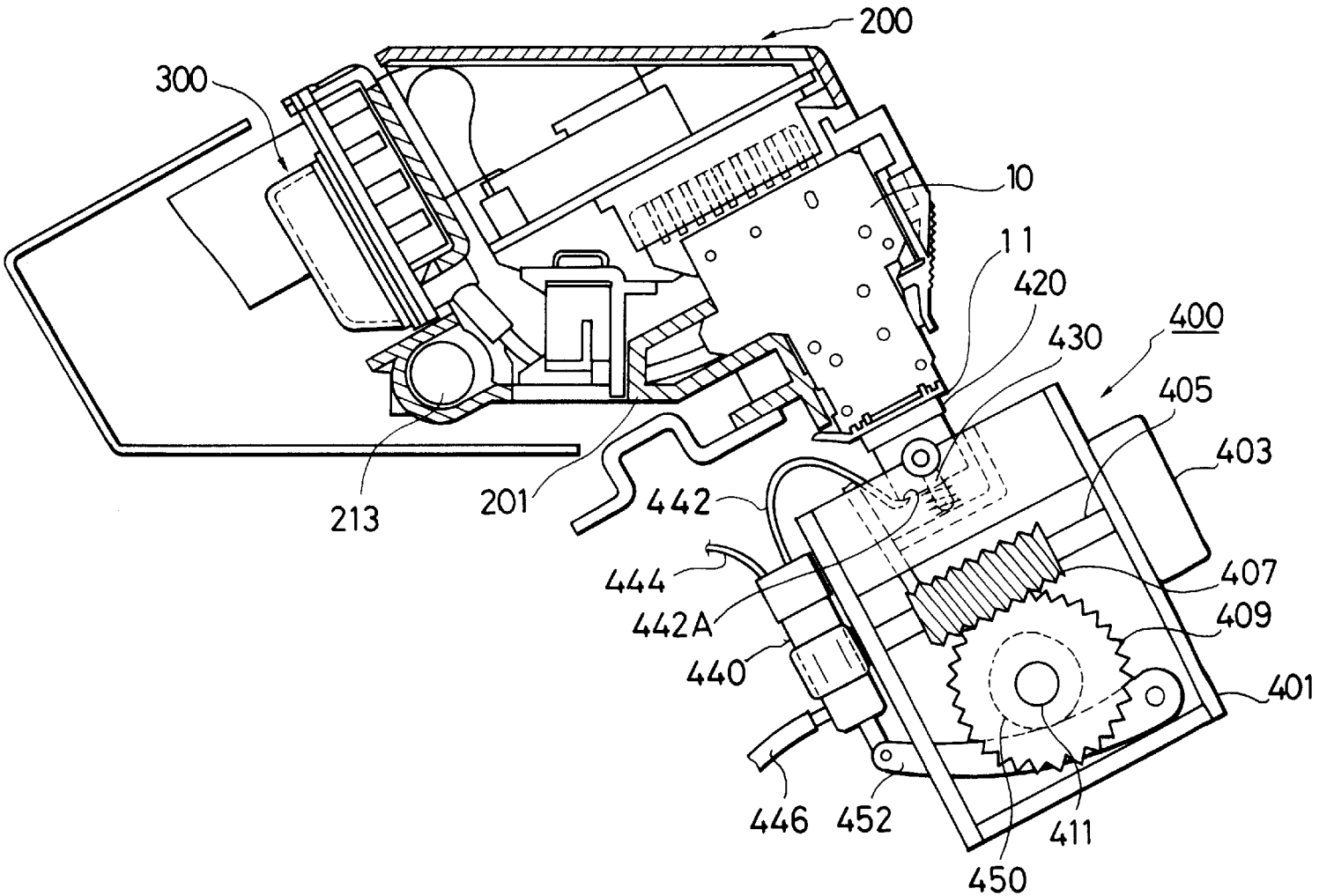
FIG. 16 is a cross-sectional side view of an ejection recovery unit and a recording head unit of the ink jet recording apparatus of the present invention.

FIG. 16 is a cross-sectional view showing an overall structure of an ejection recovery unit 400 of one embodiment of the present invention.

A unit housing 401 forming the body of the recovery unit includes the following parts; a motor 403 is a source for supplying driving power to each of components in the recovery unit 400, and the driving power is transmitted to the worm wheel shaft 411 through the worm 407 mounted on the motor drive shaft 405 and the worm wheel 409 geared with the worm 407.

A cap 420 contacts the ejection outlet formed face 1A of the head chip 10 and can cover up the neighboring area around the ejection outlets. The part of the cap 420, the part contacting the ejection outlet formed face 1A, is made of an elastic member such as rubber and so on. A cap pressing and equalizing part 430 pushes the cap 420 towards the ejection outlet forming face 1A and establishes the close contact between the cap and the ejection outlet formed face 1A. A pump 440 generates a driving force for sucking ink or air through a suction tube 442 connecting with the cap 420 and a suction tube 444 connecting with the above described intermediate tank 300. With this structure, the wasted ink can be sucked through the wasted ink tube 446 and absorbed in the wasted ink absorber, not shown in FIG. 16, in the ink cartridge. The pump 440 is driven by the pump driving cam 450 mounted on the worm wheel shaft 411 and by the pump driving lever 452 contacting with the pump driving cam 450.

In this embodiment of the present invention, the suction tube 442 expanded between the cap 420 and the pump 440 starts from the connecting hole 442A of the cap 420, bends vertically upward and downward to draw an arc outside the unit housing 401 and connects to the pump 440. According to this structure of the suction tube 442, if the suction work is not executed at all or executed incompletely while the cap 420 is not contacting to the ejection outlet formed surface 1A after the wasted ink was expelled from the ejection outlets by using the cap 420, a small amount of wasted ink remains within the tube 442. This is because the existence of the curved part of the suction tube 442 makes a small amount of wasted ink remained within the suction tube 442 from the curved part and the connecting hole 442A. Making the best use of this suction work mechanism, in the capping state in which the cap 420 is maintained to be contact with the ejection outlet formed face 1A when the recording head is not used, for example, at the interruption of recording or at the rest of recording, the ejection outlet formed face 1A can be maintained covered by humidified atmosphere to prevent the ejection outlet from drying and being clogged. According to the structure of the suction tube 442, it will be appreciated that the suction work to the ejection outlets when restarting recording information with the recording head can be eliminated or simplified. In addition, when the apparatus is stopped for a long term or the electric power supply is turned off, using the recovery unit 400 in order to remove the sucked ink remained in the suction tube 442, the solidification of the remained ink in the suction tube may be prevented.

In this embodiment of the present invention, in the state in which the unit 400 is mounted in the apparatus, as the pump 440 is arranged so that the outlet port of the pump 440 may open downward in the vertical direction, and the ink extraction route flows downward. With this structure, the wasted ink is smoothly discharged from the pump 440 by using gravitational force.

Figure 17B:
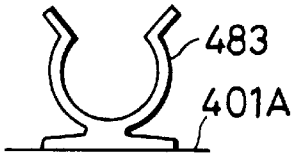
FIG. 17B is a front view of a pump support part of the ejection recovery unit shown in FIG. 16.
Figure 17A:
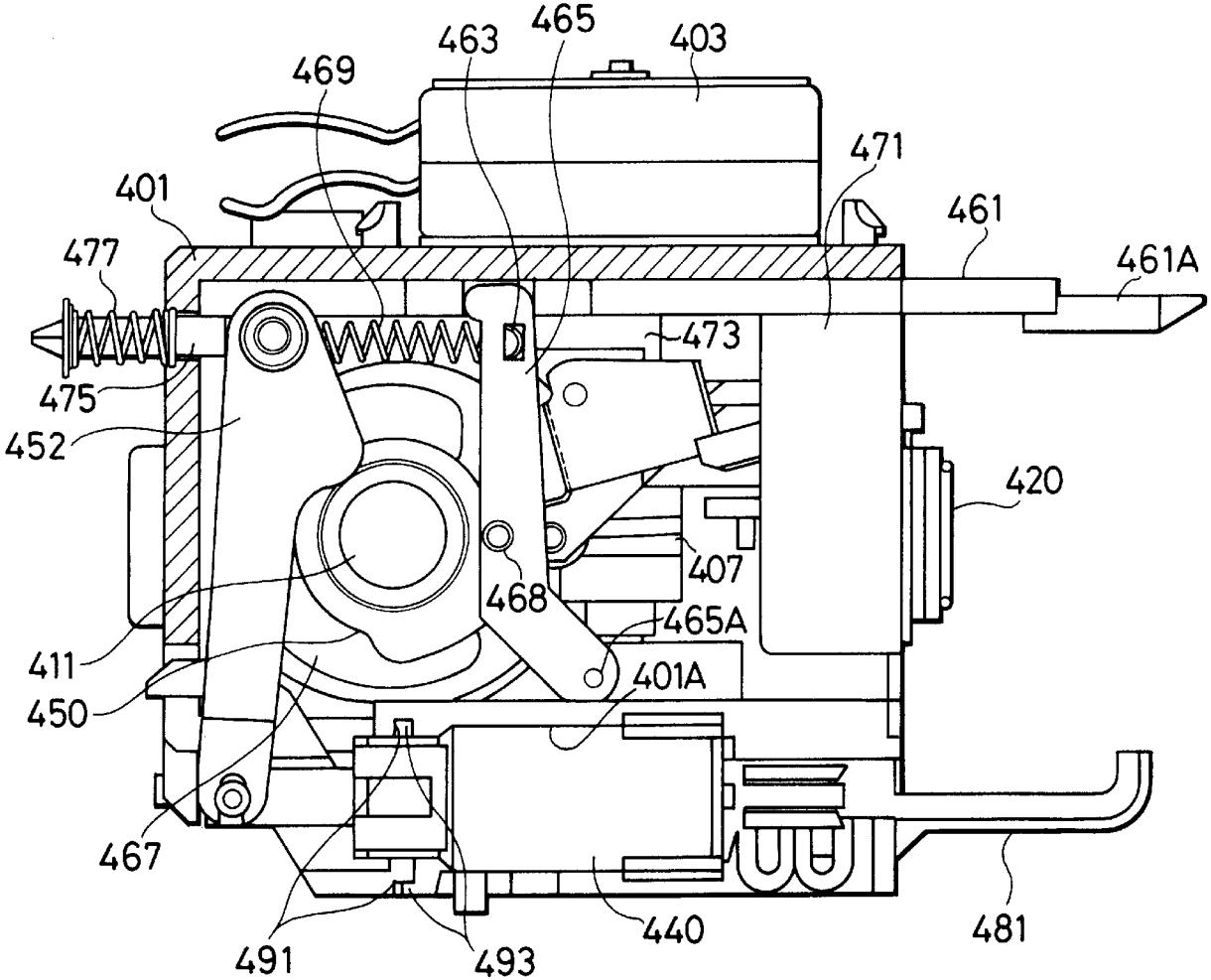
FIG. 17A is a detailed cross-sectional front view of the ejection recovery unit shown in FIG. 16.

FIG. 17A is a cross-sectional side view of the ejection recovery unit 400. The top of the access lever 461 is inserted in the concave portion 205H formed in the head cover 205 so that the cap 420 may face to the ejection outlet formed face 1A. At least the top of the access lever 461 can move or be reformed in the direction along which the recording headpart scans, the direction perpendicular to the plane on which FIG. 14A is drawn. The access lever drive arm 465 is engaged with the access lever 461. The access lever drive arm 465 can rotate around the axis 465A at the end part of the arm 465. The cam 467 is provided on the axis 411 and engaged with a pin 468 on the arm 465. The spring 469 is used for restricting the movement of the arm 465 by guiding the pin 468 around the outer face of the cam 467. The spring 469 is expanded between the housing 401 and the protruding part 463 formed on the access lever 461 and generates a force for rotating the arm 465 toward the cam 467.

A cap holder 471 supports the cap 420. A holder guide lever 473 is integrally formed with the cap holder 471, and the top part 475 of the holder guide lever 473 penetrates the hole formed on the housing 401. The cap holder 471 supporting the cap 420 is installed so as to being able to move in the forward and backward directions, and in accordance with the forward movement of the cap holder 471, the cap holder 471 establishes the contact between the cap 420 and the ejection outlet formed face 1A, and in accordance with the backward movement of the cap holder 471, the cap holder 471 releases the established contact between the cap 420 and the ejection outlet formed face 1A. In addition, the cap 420 or the cap holder 471 can move slightly in the direction in which the recording head scans. The spring 477 is mounted on the top end 475 of the holder guide lever 473, and the coupling part of the holder guide lever 473, with which a cam, not shown in FIG. 14A, used for restricting the movement of the cap holder 471 is contacted, is pressed by the spring 477 so that the coupling part of the holder guide lever 473 may be moved and guided in response to the outer shape of the cam.

An air vent to be described later is formed in the cap 420 and the air vent is opened and closed by the cam and the drive lever, both of which are not shown in FIG. 17A. The opening and closing mechanism for the air vent, the forward and backward moving mechanism of the cap 420 and the forward and backward moving mechanism for the access lever 461 will be described later in FIGS. 18, 19 and 20.

In FIG. 17A, the rock part 480 is provided for establishing the rock state of the recovery unit 400 and the carriage part 200 at the time of ejection recovery work.

In this embodiment of the present invention, the pump 440 is supported by the support part 483 mounted on the pump attaching part 401A on the housing 401 as shown in FIG. 14B. The support part 483 is shaped in a letter "C" and supports the pump 440 by an elastic deformation of the support part 483. The components 491 and 493 are coupling parts at the unit housing and at the pump, respectively, both being used for defining the position of the pump 440 relative to the unit housing 401 and maintaining the above defined position of the pump 440.

Figure 18:
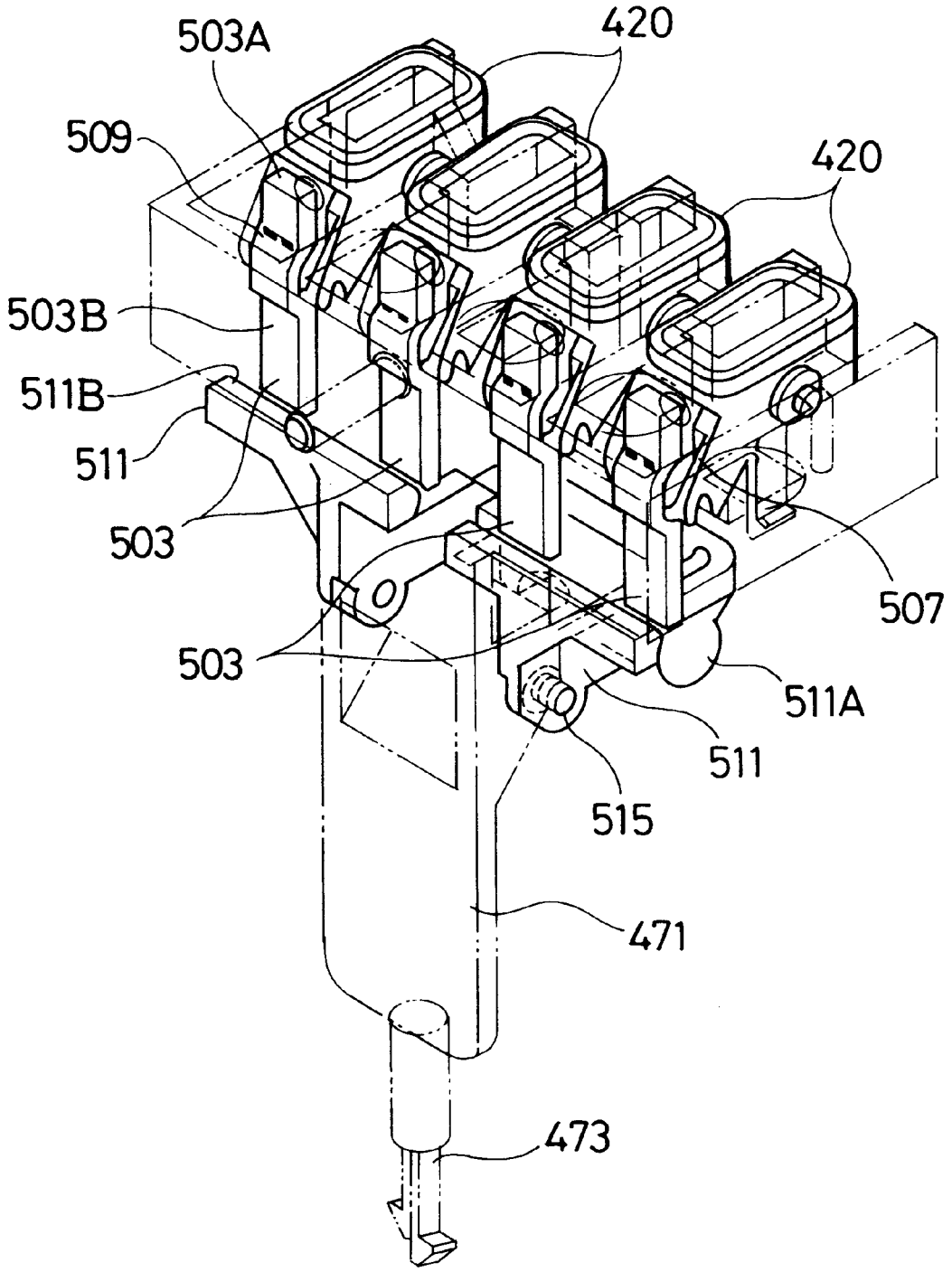
FIG. 18 is a perspective view illustrating a mechanism for opening and closing an air-port of the cap of the ejection recovery unit shown in FIG. 16.
Figure 19:
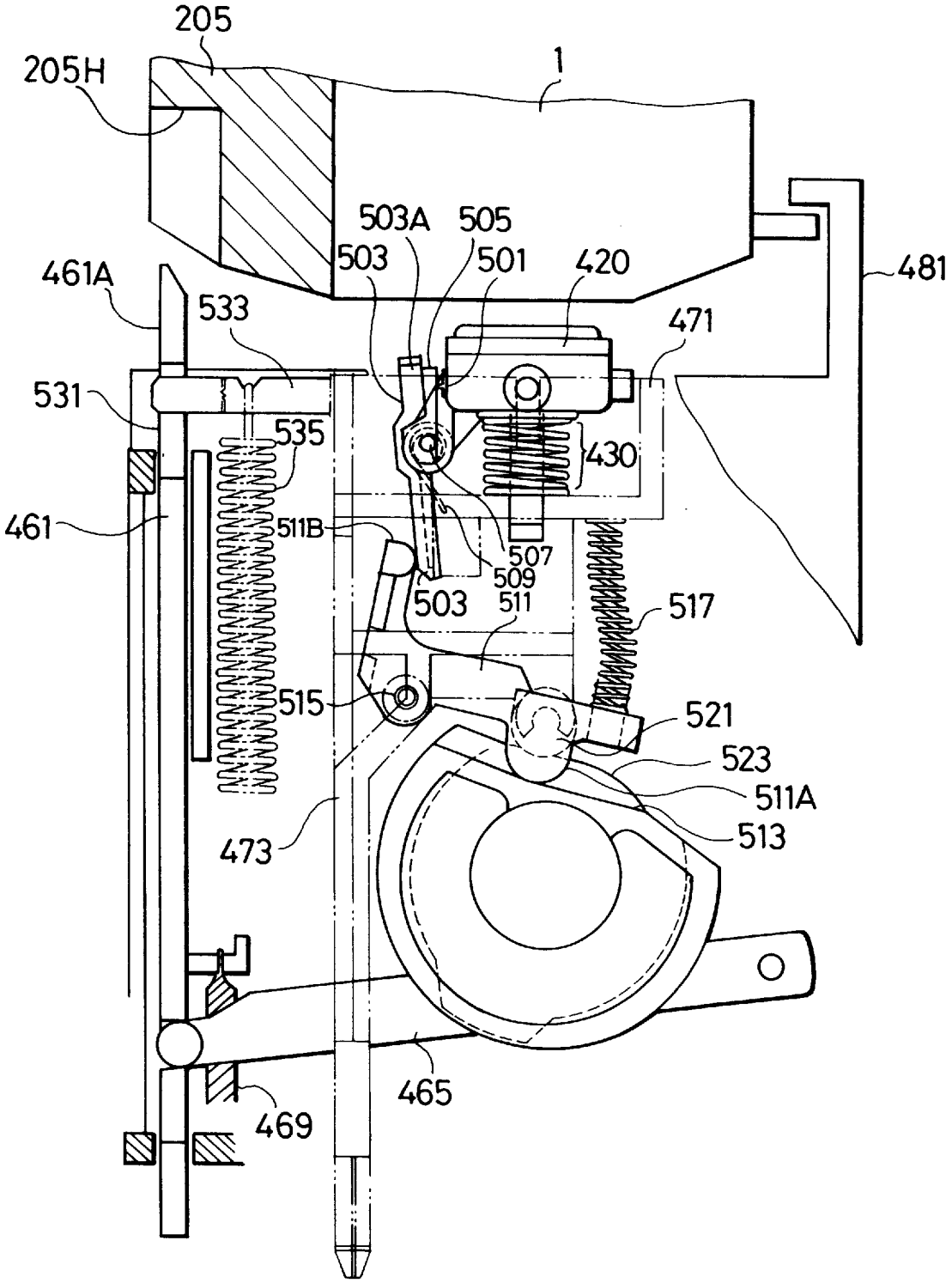
FIG. 19 is a cross-sectional upper view of the ejection recovery unit, emphasizing the mechanism for opening and closing the air-port of the cap part.

FIG. 18 is a perspective view of the ejection recovery unit 400, emphasizing the structure of the opening and closing mechanism for the air vent. FIG. 19 is a cross-sectional side view of the recovery unit 400, emphasizing the opening and closing mechanism for the air vent, the forward and backward moving mechanism for the cap 420 and the forward and backward moving mechanism for the access lever 462.

Now, referring to FIGS. 18 and 19, the structure of the opening and closing mechanism for the air vent will be explained.

In FIGS. 18 and 19, the lever 503 has the arm 503A having the pad 505 for closing the air vent 501 and the arm 503B linked with the action lever 511. The lever 503 is rotatably installed on the axis 507. The spring 509 gives a rotationally reactive force to the lever 503 in the direction corresponding to closing the air vent.

The action lever 511 has a part 511A contacting to the cam 513 used for opening and closing the air vent and a part 511B contacting to the arm 503B of the lever 503, and furthermore the action lever 511 can rotates on the axis 515. The spring 517 gives a rotationally reactive force to the action lever 511 for moving the part 511A forward to the cam 513 and maintaining the contact between the part 511A and the cam 513. With this structure, in response to the movement of the cam 513, the air room of the cap 420 may be linked or not linked to the air in the out of the cap 420 through the air bend.

Next, the structure of the forward and backward mechanism for the cap 420 will be described, referring to FIG. 19.

In FIG. 19, the cap holder 471 and the holder guide lever 473 are drawn in imaginary lines, that is, two-point chained broken lines. The roller 521 is mounted on the holder guide lever 473 and contacts with the cap forwarding cam 523. The elongate groove 531 is formed in access lever 461 along the longer side thereof, on which the pin 533 provided on the cap holder 471 is fitted. According to this structure, the forward and backward movement of the cap 420 is governed by the pin 533 guided by the elongate groove 531. In addition, the movement of the cap 420 in the direction along which the recording head scans is cooperative with the movement of the access lever 461. The spring 535 pulls backward the cap 420 in cooperation with the spring 477 shown in FIG. 17A. And furthermore, the concave portion 205H of the head cover 205 receives the top of the access lever 461.

In FIG. 19, for simplifying the drawing, the access lever drive arm 465 is placed in the different position from that in FIG. 17A.

And next, referring also to FIG. 19, the forward and backward movement of the access lever 461 and the cap 420 will be described.

In general, it is difficult to locate the carriage precisely at the position so that the ejection outlet formed face of the recording head may face up to the cap exactly. It may be one way to overcome this difficulty that a protruding part is formed on the recovery unit side and a concave part for receiving this protruding part is formed on the recording head side, and that the exact position matching between the recording head and the cap is established by means of locating the carriage at a designated position by making the concave part of the recording head side receive the protruding part of the recovery unit side. In this solution, there is still another problem that, as the carriage with four recording heads is relatively heavy, a large amount of external force is required to move the carriage as well as a large amount of external force is applied to the protruding parts and the cap and so on.

In this embodiment of the present invention, there is used a structure where the cap 420 is moved in relative to the ejection outlet formed face of the recording head so that the cap 420 faces exactly to the ejection outlet formed face of the recording head. Now referring to FIGS. 20A, 20B and 20C, this structure will be described in detail.

Figure 20A:
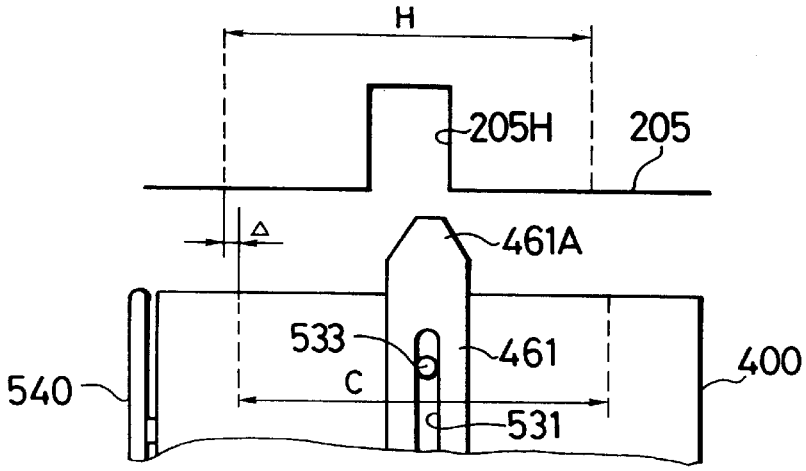
FIGS. 20A, 20B and 20C are explanation diagrams showing a moving mechanism for the cap part of the ejection recovery unit shown in FIG. 16.

In FIG. 20A, H is the region on the recording head side where four recording head chips are placed so that the cap 420 may cover recording heads, and C is the region on the recovery unit side where four caps 420 respectively cover the ejection outlet formed face of the respective recording head chips. In FIG. 20A, assumed is that the carriage part 200 stops with the difference Δ between the region H and the region C.

Figure 20B:
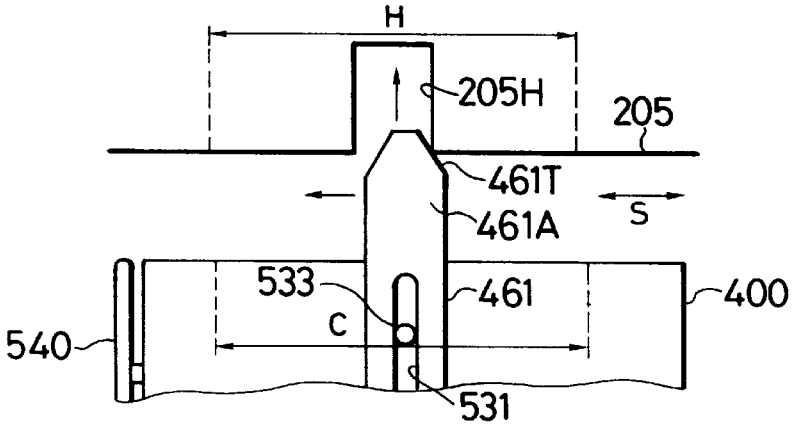

As the access lever 461 moves forward to the head cover 205 from the position shown in FIG. 20A, a tapered part 461T formed at the top 461A of the access lever 461 gets to contact with the concave portion 205H of the head cover 205. As the access lever 461 is supported so as to move in the direction S along which the carriage moves, the access lever 461 can be inserted into the concave part 205H as moving in the direction S as shown in FIG. 20B. And furthermore, this movement of the access lever 461 in the direction S is propagated to the movement of the cap holder 471 and the cap 420 in the same direction S. This is because the pin 533 is linked to the elongate groove 531 formed on the access lever 461.

Figure 20C:
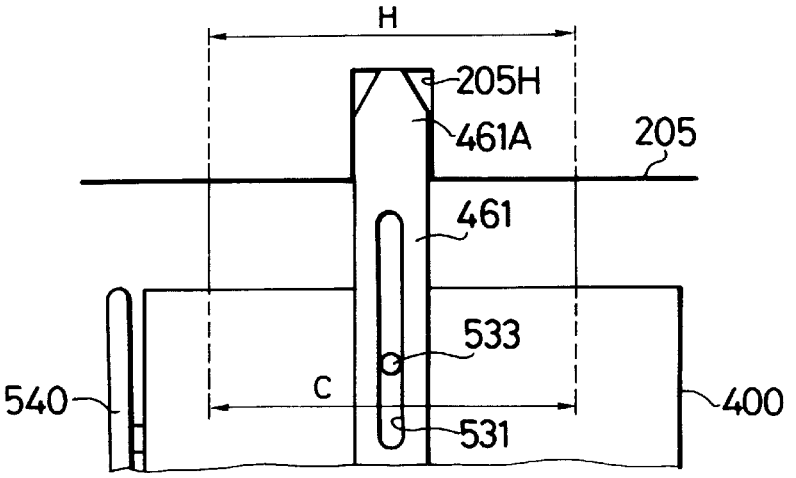

So far, in the state shown in FIG. 20C where the insertion of the top part 461A of the access lever 461 into the concave part 205H is established, the region H and the region C are completely overlapped with each other, that is, the cap 420 completely faces to the recording head, and as a result, the forward movement of the cap 420 brings a precise capping work of the recording head.

In the embodiment of the present invention, if a certain degree of accuracy in position control for stopping the carriage is established, the access lever 461 may be inserted in the concave part 205H by adjusting the position difference between the access lever 461 and the concave part 205H. Therefore, the shape and the size of the top of the access lever 461 and the shape and the size of the concave part 205H may be determined properly in accordance with the accuracy in controlling the stop position of the carriage.

In addition, in order to establish a smooth insertion of the top part of the access lever 461 into the concave part 205H, there may be some modifications and their combinations of the method for moving the access lever 461. One is that the access lever is mounted on the unit housing so that the access lever may be movable in the direction S along which the recording head scans. The other is that the access lever 461 is mounted on the unit housing so that the access lever 461 may be moving rotationally on the pivot formed at the bottom end of the access lever 461. The other is also that the top part 461A of the access lever 461 is formed with the materials having an elastic flexibility. The combination of the above described methods for moving the access lever 461 may be allowed. In any way, it is allowed that a route used for guiding the cap 420 into a designated position, that is, the exact capping position, is established by means of binding the pin 533 in the elongate groove 531 at the time when the access lever 461 is completely inserted into the concave part 205H. For example, in the case that the access lever 461 is mounted on the unit housing so that the access lever 461 may be moving rotationally on the pivot formed at the bottom end of the access lever 461, the access lever 461 inserted into the concave part 205H is inclined which configuration is different from that shown in FIG. 20C at the time when the access lever 461 is completely inserted into the concave part 205H, and the region H and the region C are not completely overlapped at the time when the cap 420 is apart from the recording head. In this case, as the elongate groove 531 formed on the access lever 461 is inclined in accordance with the inclined configuration of the access lever 461, the cap 420 can cover the ejection outlet formed face completely after the pin 533 is guided by the elongate groove 531.

It is desirable that the cap 420 is installed on the unit housing with a looseness so that the cap may not restrict the movement and/or deformation of the access lever 462 and the elongate groove 531 but accept this movement at the time when the top part 461A of the access lever 461 is inserted into the concave part 205H, and that the cap 420 may move forward and backward as being guided along the elongate groove 531 which is moved and/or deformed as above.

In FIGS. 20A to 20C, a component 540 is a blade which can move forward and backward by the cam mounted on the recovery unit 400 and is used for cleaning the ejection outlet formed face by contacting with the ejection outlet formed face in accordance with the scanning action of the carriage.

FIGS. 21A, 21B and 21C illustrate the structure of the pump 440 of one embodiment of the present invention.

The pump 440 has a cylinder body 551, cylinder heads 553 and 555, a piston 557 and a valve unit 559. The valve unit 559 is mounted on the cylinder head 553 which has a part 563 which is snap fastened at the protruding part 561 on the cylinder body 551. According to this structure, the valve unit 559 and the cylinder head 553 can be easily mounted on the cylinder body 551.

The valve unit 559 has a valve body 565 which can open and close the ink leading ports from the cap and the intermediate tank, and a coil spring 567 for pushing the valve body 565 in the direction for closing the valve body 565.

The piston 557 has a piston shaft 557A in a part of which an ink fluid route 556 is formed, a valve 571 and a flange 573 mounted on the piston shaft 557A, and a roller 570 which is disposed between the valve 571 and the flange 573 with being mounted to the piston shaft 557A loosely and has an ink fluid route 570A. The cylinder head 555 has a seal ring 555A and is mounted in the cylinder body 551 in the same manner as the cylinder head 553.

In the above described structure of the pump 440, as shown in FIG. 21B, in the case that the piston 557 is located and moved downward in the figure, the pressure decrease generated in the cylinder room above the piston 557 makes the valve 565 move against the force produced by the coil spring 565 so that the value 565 may lead to open the ink fluid leading port. According to this, ink is sucked from the cap and the intermediate tank. At this time, as the valve 571 close the ink fluid route 570A, the sucked ink stored in the cylinder room below the valve 571 can be discharged from the pipe 575 without flowing back to the cylinder room above the valve 571. After that, when the piston 557 moves upward in the cylinder body 551 as shown in FIG. 21C, the valve 571 opens the ink fluid route 570A. The ink fluid stored in the cylinder room above the valve 571 flows downward into the cylinder room below the valve 571 through the ink fluid routes 570A and 556. At this time, as the valve 565 closes the ink fluid leading port, the ink stored in the cylinder room never flows back to the cap and the sub-inktank.

The pump 440, the structure and action of which is described above, is installed in the recovery unit housing 401 and supported by the support member shown in FIG. 17B. In this embodiment, the pump 440 is installed in correspondence to an individual cap, that is an individual recording head chip, and hence the number of the pump 440 is four. This configuration brings the following advantage.

In this embodiment, four recording head chips are installed, each corresponding to one of ink colors, yellow, magenta, cyan and black. As the occurrence of ink ejecting actions and the composition of the ink of the recording head chips with an individual ink color is different from one another, the required amount of ink fluid to be evacuated for the recovery process for the recording head chips varies from one ink color to another ink color. If a single pump is used commonly for the recovery process for all of the recording head chips, assuming that an identical sucking pressure is applied to all the recording head chips, the power of the pump to be used is determined so as to cope with the amount of wasted ink from the recording head having the highest ink consumption rate. In using a single pump for all the recording head chips, a pump with an unnecessarily large power may be used and the excess amount of ink is sucked from the recording head chip which consumes the relatively small amount of ink to be required to be sucked for recovering the ink ejection. In contrast to the above case in using a single pump, in this embodiment which uses four pumps, each corresponding to an individual recording head chip, the power of each pump is determined to be a suitable value in accordance with the necessary amount of ink to be sucked, and therefore, the disadvantageous aspect of the case in using a single pump may be avoided.

Figure 22:
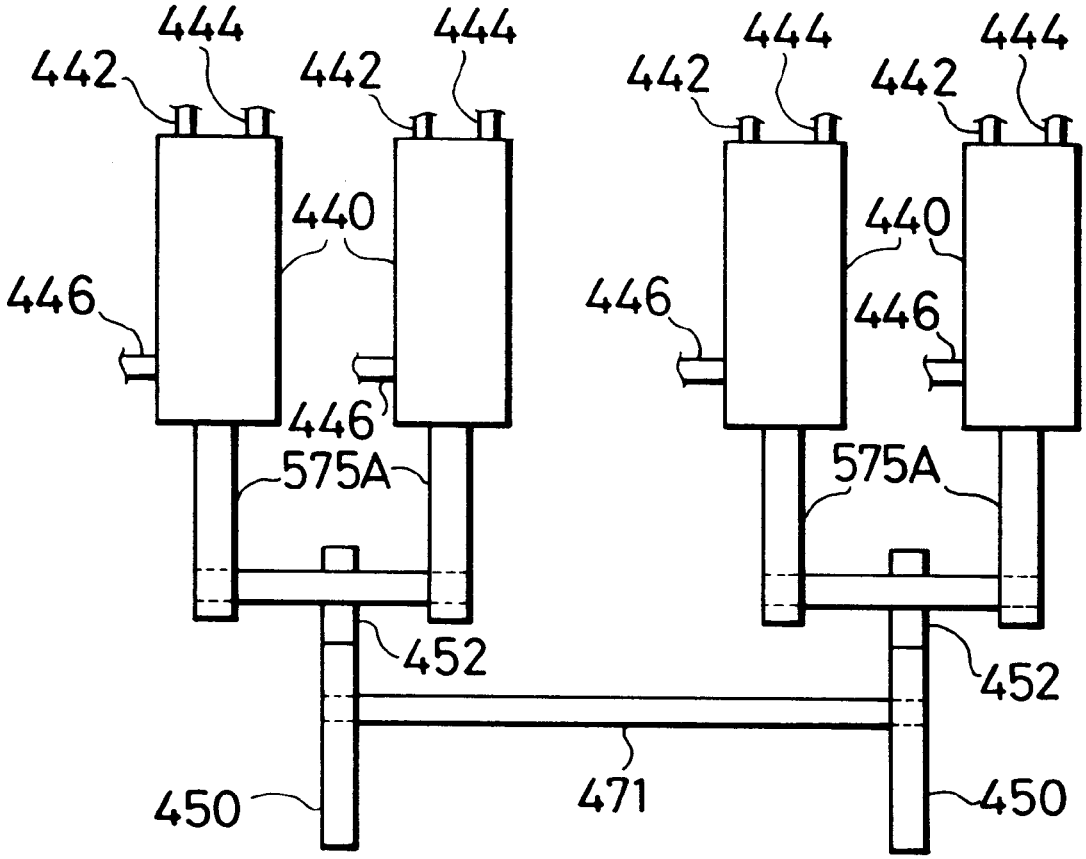
FIG. 22 is a diagram illustrating a driving system of the pump of the ejection recovery unit.

FIG. 22 is a diagram illustrating the driving system of four pumps in one embodiment of the present invention.

As shown in FIG. 22, a couple of pumps 440 are formed to be a pair, and each pair of pumps 440 is driven by the cam 450 fixed at the shaft 470 and by the lever 452. In this embodiment, the phase of the cams of each pair is determined to be identical to each other so that four pumps 440 may be driven in the synchronized phase. Therefore, the fabrication process for the pumps is facilitated by the above described structure.

However, it may be allowed that the phase of the cams of each pair is not determined to be identical to each other, and that the cams and the levers are installed with respect to an individual pump 400 and driven in the different phases. This structure is favorable from the viewpoint of distributing the pump load suitably over four pumps.

Figure 23:
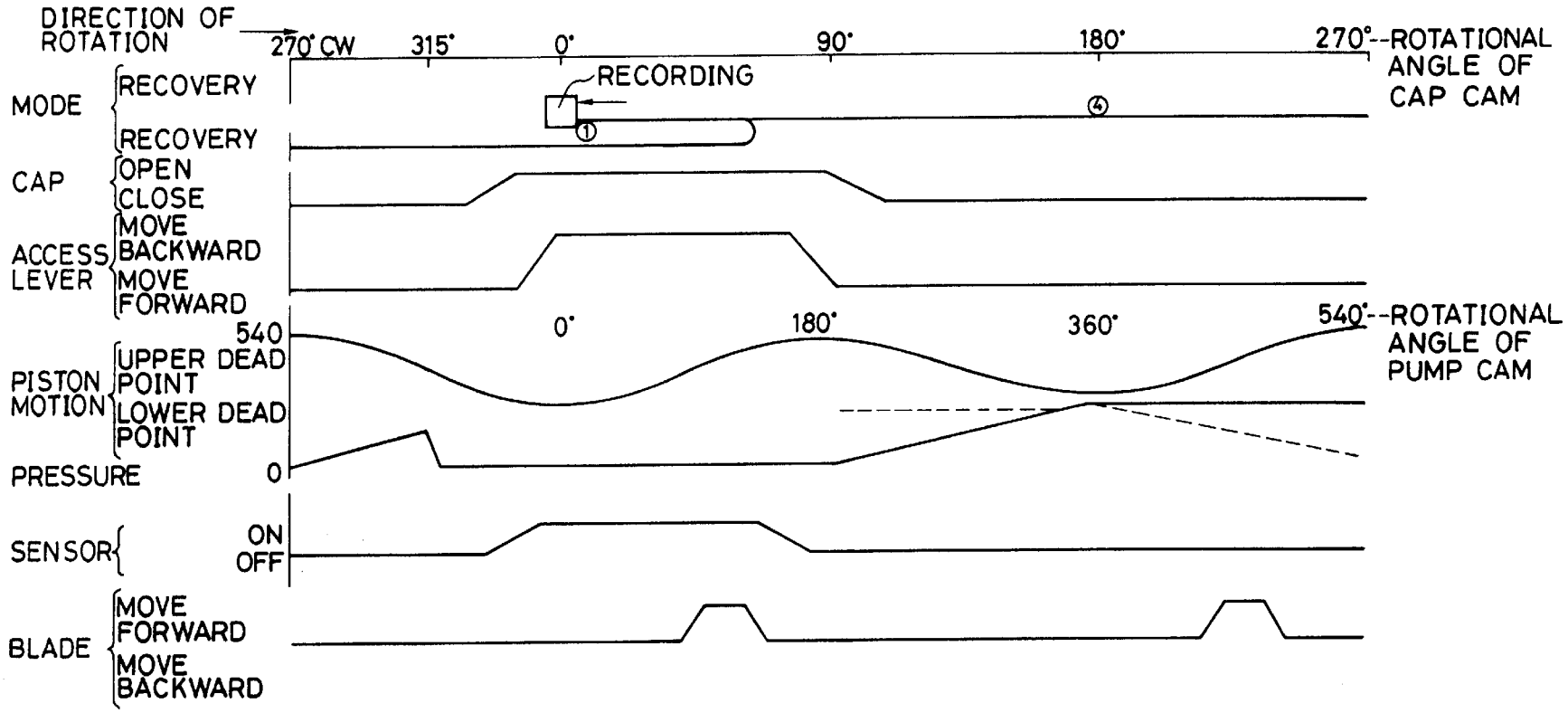
FIG. 23 is a timing chart showing working sequences of each part of the ejection recovery unit.

The controlled actions of cams in the recovery unit and components driven by these cams in the time domain can be stated as in FIG. 23. In FIG. 23, "sensor" denotes a sensor for detecting the open state of the cap 420, and "pre-recovery mode" and "main-recovery mode" denote the operational conditions of the recovery unit where the amount of sucked ink is varied in a plurality of ink projecting actions including a preliminary ink ejection. In addition, it is preferable that the ejection outlet formed face is cleaned by the blade after recovery operations.

And furthermore, in this embodiment, the access lever 461 is moved forward prior to the capping action of the cap 420, and the capping action of the cap 420 is terminated prior to the backward movement of the access lever 461. This is because the cap 420 is moved forward and backward and guided by the above described elongate groove 531 at the access lever 461. In applying the cap 420 on the recording head chips and removing the cap 420 from the recording head chip, the air vent of the cap 420 is opened at a suitable timing. This action of the air vent prevents effectively the generation of unfavorable pressure deviation in the cap 420 when the cap 420 touches the recording head chip and leaves from the recording head chip and an invasion of air into the ejection outlets of the recording head chip, and furthermore a leakage of ink outside the ejection outlets.

Figure 24:
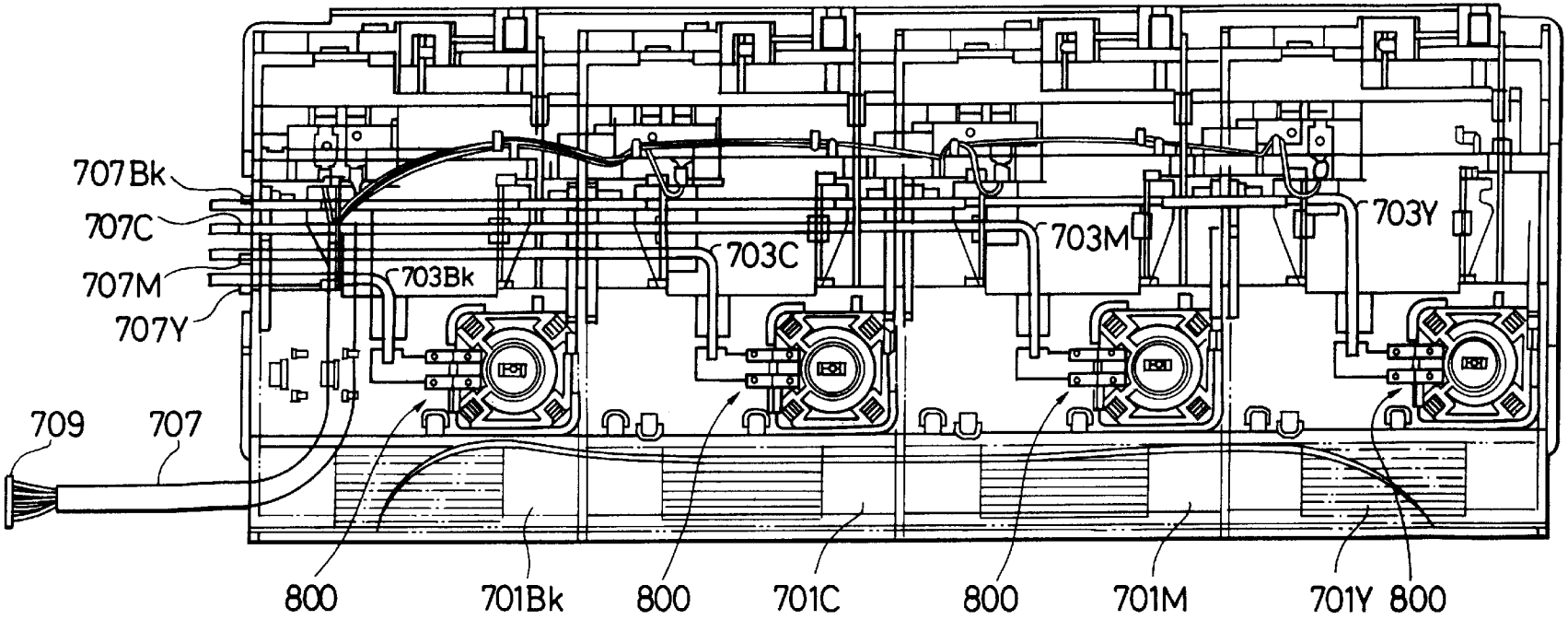
FIG. 24 is a plan view of an ink tank housing part, showing an arrangement of ink tanks of the ink jet recording apparatus of the present invention.

FIG. 24 is a plan view of the ink tank housing part of the apparatus of one embodiment of the present invention.

In FIG. 24, components 701BK, 701C, 701M and 701Y are ink tanks formed as a cartridge type tank having a supply ink reservoir part used as an ink supply source an a waste ink reservoir part used for storing waste ink, and the ink tanks are attachable on and removable from the apparatus. Each of the ink supply tubes 703BK, 703C, 703M and 703Y is connected to the corresponding supply ink reservoir part installed in the above described ink tanks 701BK, 701C, 701M and 701Y. Each of the waste ink tubes 707BK, 707C, 707M and 707Y is connected with and extended between the above mentioned respective ink pump and the corresponding waste ink reservoir part in the ink tank.

As for the layout of the ink tanks, the following points are emphasized in this embodiment.

The viscosity of ink depends on color tones of ink. The viscosity and solidification property of ink is getting stronger in the order of color tones of black (BK), cyan (C), magenta (M) and yellow (Y). The stickiness of ink may increase or the ink may be even solidified in the ink supply tube. No matter what the material of the pipe is, even in this embodiment where the material used for forming the ink supply tube is polyethylene, air is slightly and inevitably penetrated into the pipe through the pipe wall and a solvent fluid for ink is evaporated through the pipe wall. The longer the ink supply tube is, the more air is penetrated into the pipe and the solvent fluid of ink is evaporated.

In this embodiment, all the ink supply tubes are expanded in the identical direction, and the ink tank storing ink having the stronger property of stickiness and solidification is disposed at the closer to the position of its corresponding recording head. That is, the ink supply tube for supplying ink having the stronger property of stickiness and solidification is made to be shorter. In FIG. 24, the layout order of the ink tanks, from the left to the right, is determined so that the ink tank for black ink may be placed at the left end, the ink tank for cyan ink may be placed next and the ink tank for magenta ink may be placed next to the ink tank for yellow ink which is placed at the right end. With this layout for the ink supply tubes, the ink having a stickiness property and a solidification property can be effectively prevented from air penetration and ink evaporation.

This layout can be applied to the waste ink pipes connected between the recording heads and the waste ink reservoir part.

In FIG. 24, each of components 800 is an unit for detecting the amount of ink in the ink tank 701, which is placed between the ink supply tube 703 and the ink reservoir part formed in the ink tank 701. Components 707 are a set of cables which are wired for the ink amount detecting unit 800 and wired for detecting the mounting of the ink tank 701 on the apparatus. A component 709 is a connector part for the cables 707.

Figure 25A:
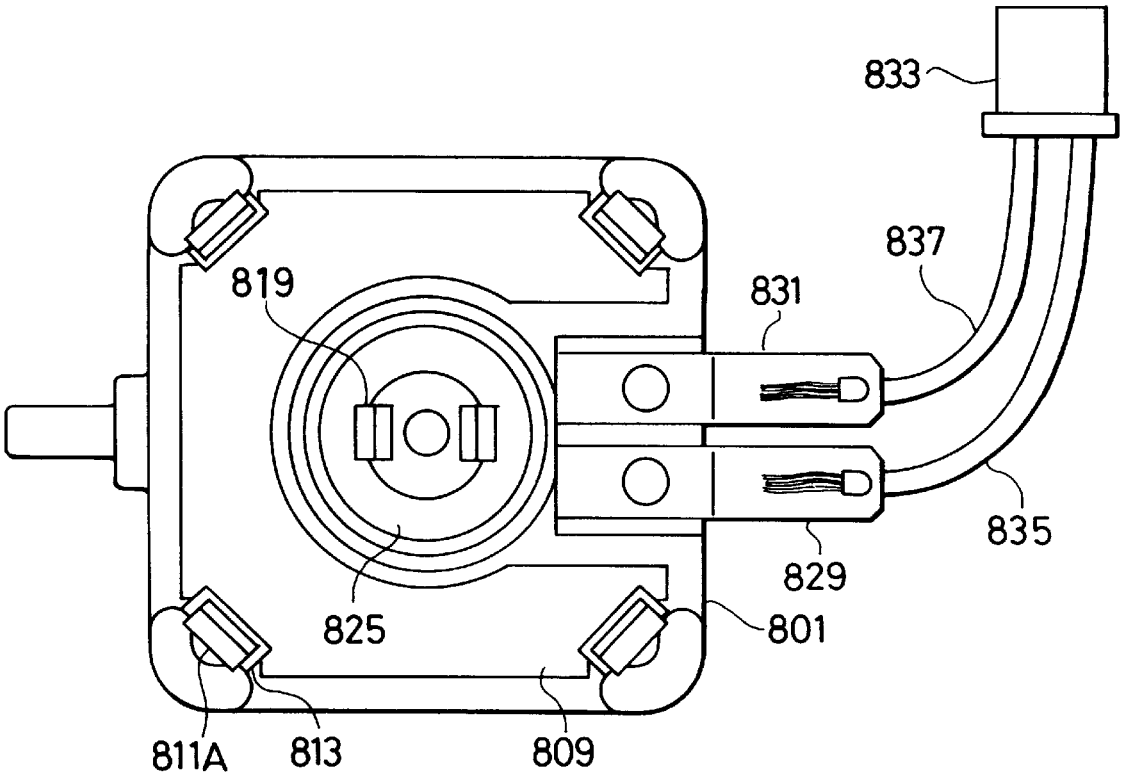
FIGS. 25A and 25B are, respectively, a plan view and a vertical cross-sectional view of an ink pressure sensing unit of the ink jet recording apparatus of the present invention.
Figure 25B:
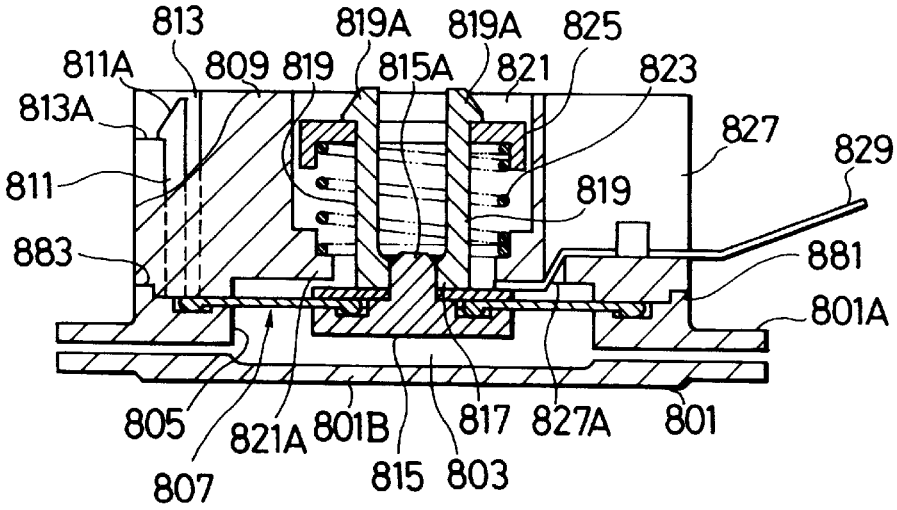

FIG. 25A is a plan view of the ink amount detecting unit and FIG. 25B is a vertical cross-sectional view of the ink amount detecting unit. The fluid route member 801 has an ink fluid route 803 in it and is composed of a pair of an upper member 801A and a lower member 801B. The upper member 801A has an open circle part 805. The peripheral part of a ring shaped diaphragm 807, being held between the upper member 801A and a press member 809, and the diaphragm 807 covers the peripherals of the open part 805. Lock members 811 are provided at the four corners on the upper members 801A. Vertical penetration holes 813 are formed at the four corners of the lock member 809, and a notch part 813A is formed above and outside the vertical penetration hole 813. The lock member 811 is made of elastic materials, and a clutch part 811A is formed outside the top part of the lock member 811. The upper face of the clutch part 811A is tapered.

Each of the lock members 811 is placed inside each of the vertical penetration hole 813 on the press member 809. The press member 809 is fixed in the upper member 801A by the clutch part 811A of the lock member 811 being locked with the notch part 813A. And also, the diaphragm 807 is held between the upper member 801A and the press member 809. Protruding parts 881 are formed on the peripheral of the upper face of the upper member 801A, and cut parts 883 are formed on the peripheral of the lower face of the press member 809 in correspondence to the protruding parts on the upper member 801A. Thus, the press member 809 is positioned on the upper member 801A by means of the cut part 883 catching the protruding part 881.

At the center of the diaphragm 807, the support member 815 is disposed so as to cover the open port 805, and the base part of a clutch member 817 is fixed, for example, by being screwed, at the support member 815 so that the base part of the clutch member 817 may be caught by the protruding part 815A at the upper center of the support member 815 which is located at the center of the open port 805. The clutch member 817 has two pieces of clutches 819 made of elastic materials, and a clutch part 819A is formed at the top part of each of the clutches 819. The upper face of the clutch claw 819A is tapered. A couple of clutches 819 are placed symmetrically with respect to the center of the open port 805.

A vertical penetration hole 821 is formed at the center of the press member 809, and the couple of clutches 819 are disposed inside the vertical penetration hole 821. A coil spring 823 and a spring stopper ring 825 are disposed in the vertical penetration hole 821. The coil spring 823, being located outside a couple of clutches 819, is supported by the spring holder 821A at the bottom of the vertical penetration hole 821. The spring stopper ring 825 is caught by the clutch parts 819A of the clutch 819, and pushes downward the top part of the coil spring 823. The coil spring 823 is pressed by both of the spring holder 821A and the spring stopper ring 825. According to this structure, owing to the reactive force produced by the coil spring 823, the diaphragm 807 and the support member 815 are moved upward so that the peripheral part of the upper face of the support member 815 may contact with the lower face of the spring holder 821A.

A cut part 827 is formed at one side of the press member 809, and at the bottom of the cut part 827, the intermediate part of the contacting members 829 and 831, both made of electrically conductive materials, is fixed. The top part of the contacting members 829 and 831 contacts with the bottom face of the spring holder 821A, penetrating through the hole 827A formed at the bottom of the cut part 827. The bottom end part of the contacting members 829 and 831 is connected to the lead wires 835 and 837 extended from the connector 833 to the electric circuit to detect the signal for indicating the ink amount in the ink tank. The peripheral part of the upper face of the support member 815, which is pressed upward by the coil spring 823, contacts with the bottom face of the top end part of a pair of contacting members 829 and 831, and the electric contact is established between the support member 815 and the contacting members 829 and 831.

The ink amount detecting unit, the structure of which was described above, is fabricated in the following manner.

At first, let the diaphragm 805 be placed on the open port 805 of the upper member 801A, and let the press member 809 be installed downward on the upper member 801A so that the clutch members 811 may be placed inside the vertical penetration holes 813 at the corners of the upper member 801A. And then, the tapered face on the top part of the clutch part 811A of the lock member 811 contacts with the inner wall of the vertical penetration hole 813 of the press member 809. The lock member 811 is pushed by the inner wall of the vertical penetration hole 813 and the lock member 811 is tilted inside the vertical penetration hole 813 and moved downward into the vertical penetration hole 813; this means that the press member 809 moves downward. In the state in which the press member 809 presses downward on the diaphragm 805, the clutch part 811A of the lock member 811 is moved back and locked at the notch part 813A of the vertical penetration hole 813, and the press member 809 is positioned and fixed on the upper member 801A.

Next, let the coil spring 823 be inserted in the vertical penetration hole 821 and let the bottom of the coil spring 823 be placed on the spring holder 821A, and let the spring stopper ring 825 be placed above the two clutches 819 and be pushed downward. And then, the tapered face of the clutch part 819A contacts with the inner wall of the spring stopper ring 825 and is pressed by the inner wall of the spring stopper ring 825. Then, the two clutches 819 are bent inward and the spring stopper ring 825 moves downward. When the contact of the tapered face of the clutch part 819A with the inner wall of the spring stopper ring 825 terminates, the two clutches 819 are respectively bent outward and the two clutch parts are latched on the upper face of the spring stopper ring 825. In this manner, the spring stopper ring 825 is locked with the two clutches 819 and the coil spring 823 is compressed between the spring stopper ring 825 and the spring holder 821A. Incidentally, the contacting members 829 and 831 are previously mounted on the press member 809 before fabrication.

According to the above described structure of the ink amount detecting unit, the distance between the spring stopper ring 825 and the spring holder 821A can be maintained to be constant, and the reactive force produced by the compressed coil spring 823 can be also maintained to be within a predetermined range of force. The diaphragm 807 moves in response to the pressure drop of the ink in the ink fluid route 803 and this movement makes the support member 815 opens the electric contact between the contacting members 829 and 831.

Figure 27:
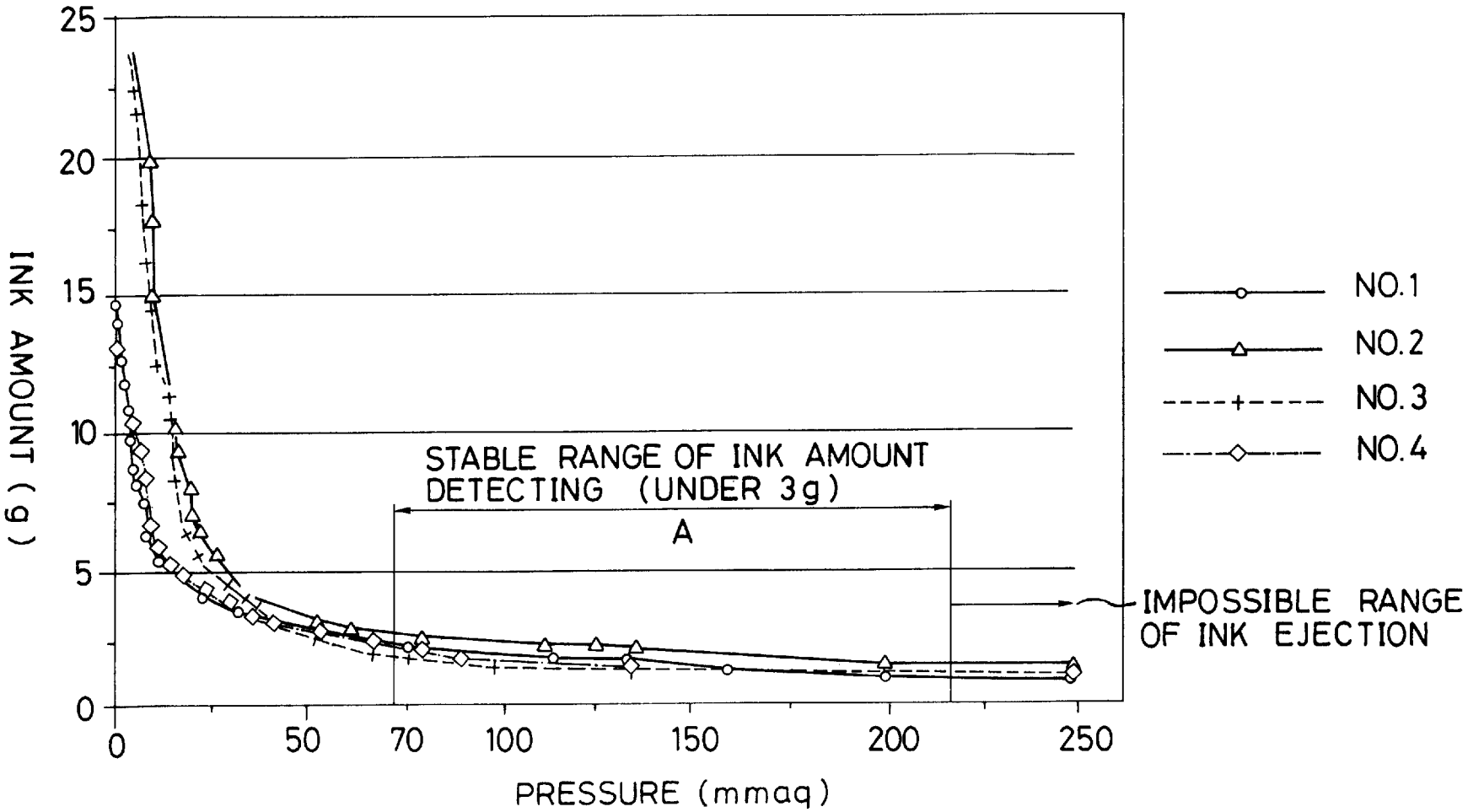
FIG. 27 is a diagram showing the relation between the amount of a remaining ink and the pressure in an ink route.

Therefore, according to the ink amount detection unit of the embodiment of the present invention, it will be appreciated that the detected ink pressure can be maintained within the range which is designated by an arrow A in FIG. 27 with which the detected ink amount is stabilized without adjusting the ink amount detection unit.

Figure 26B:
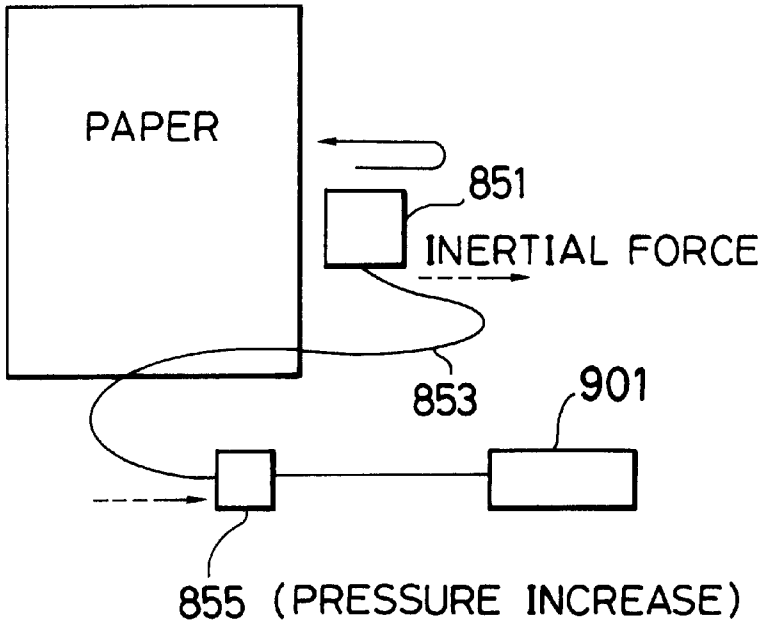
FIGS. 26A and 26B are explanation diagrams illustrating deviation of ink pressure due to a carriage movement in the ink jet apparatus of the present invention.
Figure 26A:
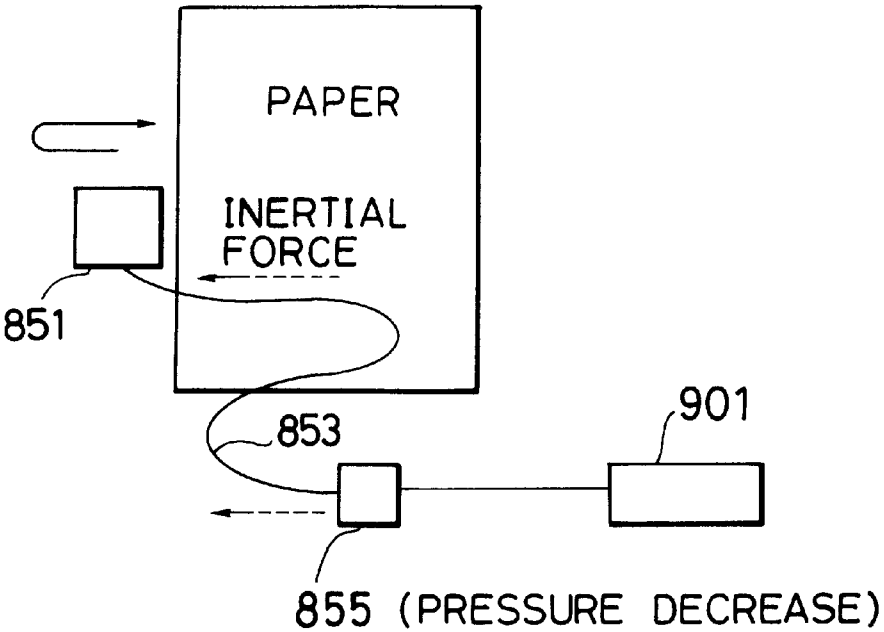

The ink fluid pressure in the ink fluid route 803 is measured by the ink sensor at the proper operation of the apparatus when the carriage is stopped or driven for recording information on the recording sheet and except when the carriage is returned. More specifically, as shown in FIGS. 26A and 26B, when the carriage 851 returns back at both side ends of the recording paper or the platen, the force of inertia is applied to the ink in the ink fluid route 853. As a result, in the carriage return action, the ink pressure decreases when the carriage moves rapidly to the right as shown in FIG. 26A, and the ink pressure increases when the carriage moves rapidly to the left as shown in FIG. 26B. Thus, the ink sensor 855 estimates the ink pressure to be lower than the actual pressure in case of FIG. 26B and to be higher than the actual pressure in case of FIG. 23A, and hence the ink sensor 855 can not detect the actual ink amount in the ink cartridge 901 when the carriage moves for carriage return actions.

Figure 28A:
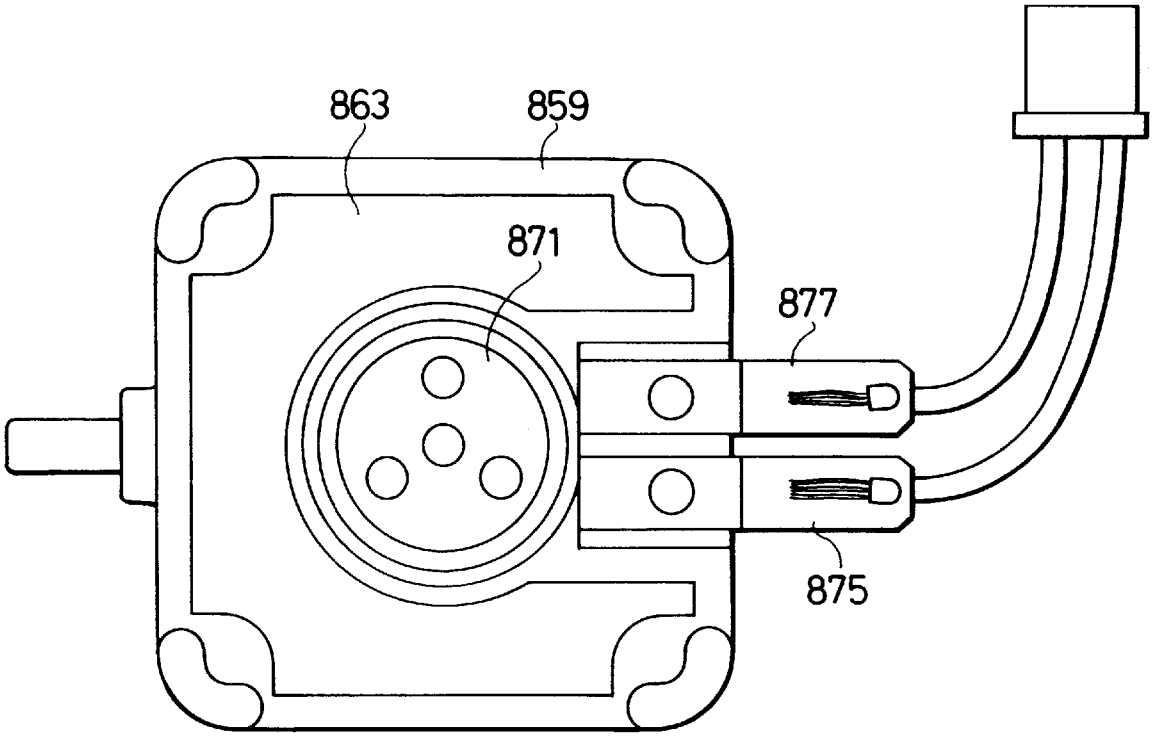
FIG.28A (PRIOR ART)
FIGS. 28A and 28B are respectively a plan view and a vertical cross-sectional view of a prior art ink pressure sensing unit.
Figure 28B:
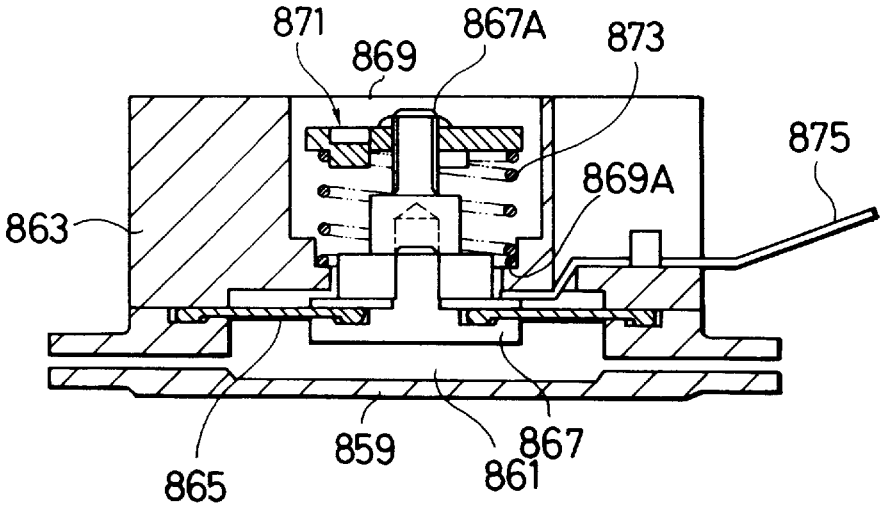
FIG.28B (PRIOR ART)

FIG. 28A is a plan view of the ink amount detecting unit of the prior art apparatus, and FIG. 28B is a vertical cross-sectional view of the ink amount detecting unit of the prior art apparatus. A component 859 is a fluid route member having an ink fluid route 861 inside it and a component 863 is a press member. A diaphragm 865 is held between the members 859 and 863. The central part 867A of a support member 867 mounted at the center of the diaphragm 865 is extended into a penetration hole 869 formed at the center of the press member 863. An adjuster ring 871 is screwed in the upper part of the center part 867A. A coil spring 873 is compressed between the adjuster ring 871 and the spring holder 869A formed at the bottom of the penetration hole 869, and, if the ink pressure in the ink fluid route 861 is greater than a predetermined value, the diaphragm 865 and the support member 867 are lifted by the reactive force produced by the coil spring 873. Thus, as the upper face of the peripheral part of the support member 867 pushes upward and contacts with both of the contacting members 875 and 877, and electric contact between the contacting members 875 and 877 is established.

In the above described structure of the prior art ink amount detection unit, if the ink pressure in the ink fluid route 861 decreases under a predetermined value, the diaphragm 865 pushes downward the support member 867. As a result, the electric contact established between the support member 867 and the contacting members 875 and 877 is canceled, and therefore, the predetermined ink pressure can be detected. The ink pressure threshold detected as an establishment of the electric contact between the contacting members 875 and 877 can be determined by the reactive force produced by the coil spring 873.

In the above described prior art ink amount detection unit, the adjustment of the coil spring 873 in order to determine the ink pressure threshold is, however, rather difficult at the time of fabrication. More specifically, as rotating operation of the adjuster ring 871 by hand is not defined so precisely that the pressure to be detected is defined inevitably to be discontinuous values. The maintenance operator of the apparatus may feel difficulty in adjusting finely the adjuster ring 871 within designated and exact positions corresponding to the pressure to be detected within 65±5 mmaq as shown in FIG. 27, in which illustrated is the relation between the mass amount of the ink in the ink tank and the detected pressure in the ink fluid route.

Figure 29B:
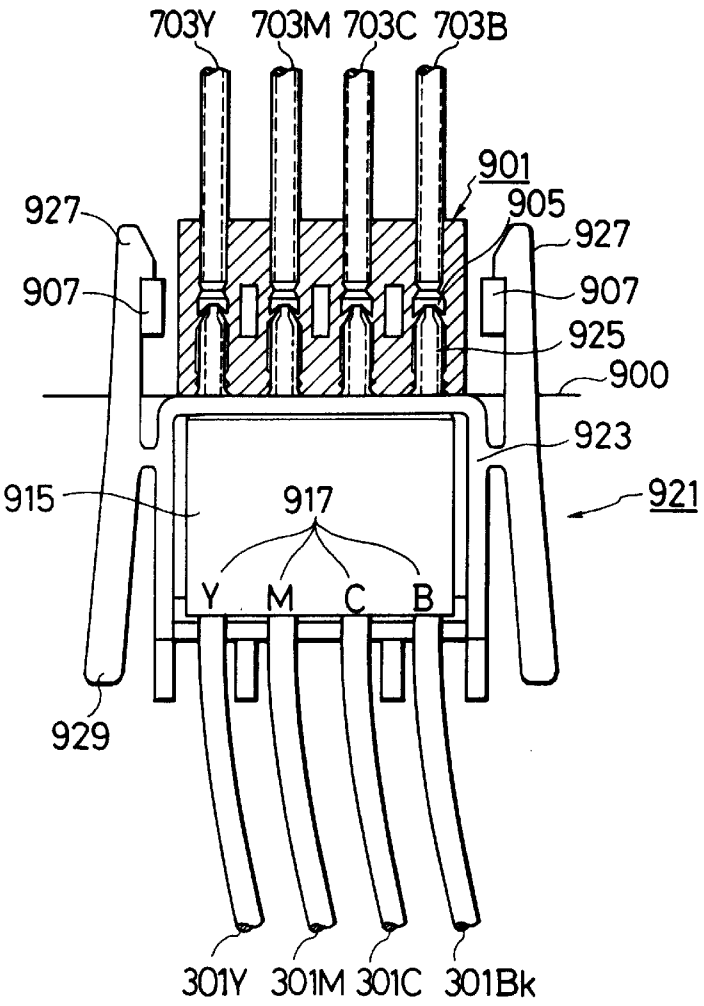
FIGS. 29A and 29B are plan views, partly in section, showing the structure of an ink supply pipe connection part and its movements.
Figure 29A:
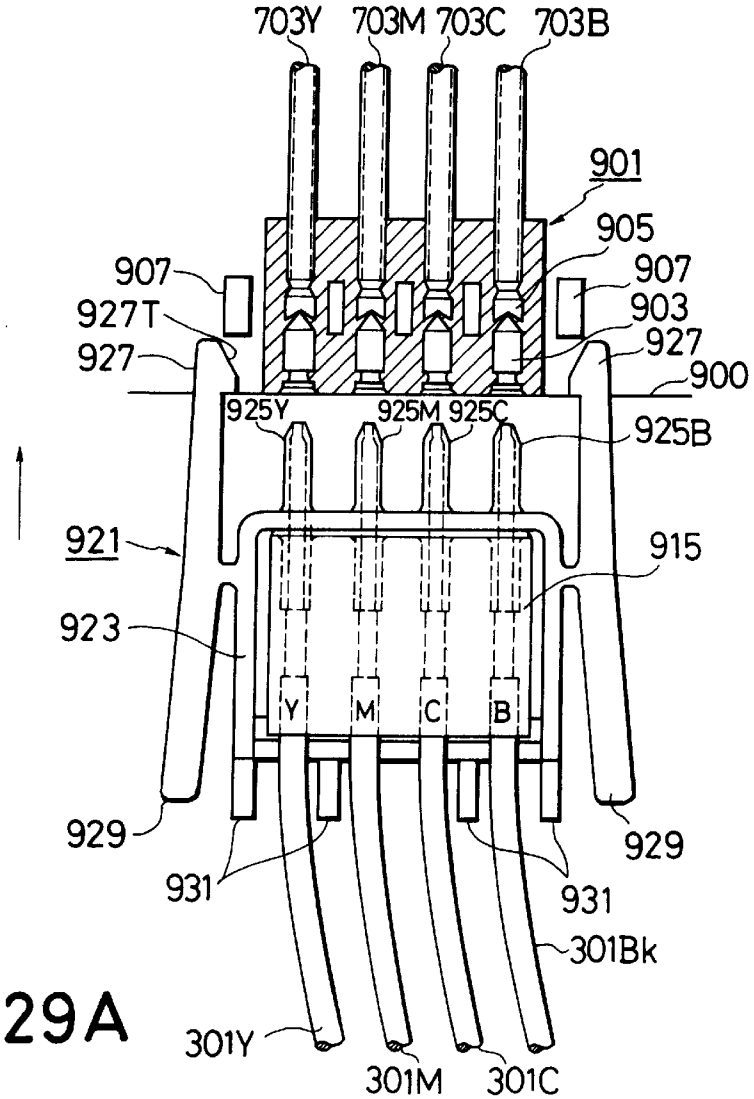

FIGS. 29A and 29B are plan views of the ink supply tube connection part of the apparatus of the present invention, showing partly cross-sectional views of the ink supply tube connection part. FIG. 29A relates to the state in which the supply tubes 301Y, 301M. 301C and 301BK are not connected, and FIG. 29B relates to the state in which the supply tubes 301Y, 301M, 301C and 301BK are connected.

In FIGS. 29A and 29B, the joint 901 is made of, for example, rubber and mounted on the apparatus frame 900. Ink supply tubes 703BK, 703C, 703M and 703Y extended from the ink tank 701BK, 701C, 701M and 701Y are inserted into the joint 901. The joint 901 has a connector catch part 903 in which the tube connectors 925BK, 925C, 925M and 925Y are inserted. Valves 905 are formed inside the connector catch parts 903 used for making closed or narrower the ink fluid route in the joint 901 when the tube connectors 925BK, 925C, 925M and 925Y are not inserted in the connector catch parts 903 of the joint 901 and for making open the ink fluid route in the joint 901 when the tube connectors 925BK, 925C, 925M and 925Y are inserted in the connector catch parts 903 of the joint 901.

A component 921 is a joint coupled to the joint 901 for leading ink from the ink tank to the recording head. The joint 921 is integrally formed as a molded member composed of the tube connectors 925BK, 925C, 925M and 925Y, a latch part 927, an operation part 929, a protruding part 931 to be described with FIG. 31, and a frame part 923. Each of the tube connectors 925BK, 925C, 925M and 925Y has a top part to be inserted the connector catch part 903 of the joint 901 and a pipe part extended downward in FIGS. 29A and 29B. The latch part 927 is locked with the lock part 907 formed in the apparatus frame 900. The operation part 929 is used for release the locked state of the latch part 927 and the lock part 907. The joint member 915 is supported on the frame part 923 and made of, for example, rubber. Four ink fluid routes are formed inside the joint member 915. On one end of each of the ink fluid routes in the joint member 915, the backward extended part of each of the tube connectors 925BK, 925C, 925M and 925Y is inserted, and on the other end of each of the ink fluid routes, each of the ink supply tubes 301BK, 301C, 301M and 301Y is inserted. Components 917 are letters "B", "C", "M" and "Y" as symbols printed on the labels to be stuck or printed directly in the positions corresponding to the ink supply tubes 301 on the joint member 915. By observing these indicating letters, each corresponding to each ink colors, the ink supply tubes 301BK, 301C, 301M and 301Y may be inserted to their corresponding tube connectors 925BK, 925C, 925M and 925Y without erroneous connections.

In coupling the joint 921 with the joint 901, as the joint 921 moves from the position shown in FIG. 29A in the direction designated by the arrow in FIG. 29A, the tapered face 927T of the latch part 927 contacts with a coupling part 907, and the latch part 927 moves outside as the joint 921 moves further in the above described direction. After the tapered face 927 gets over the coupling part 907, the latch part 927 moves inside so as to maintain the original shape of the latch part 927 itself, and the joint 921 is coupled with the joint 901 as shown in FIG. 29B. In the state shown in FIG. 29B, the tube connectors 925 are inserted inside the connector catch part 903 so as to open the valve 905. As a result, the ink fluid route from the joint 921 to the joint 901 is established, that is, the ink fluid route from the ink tank to the recording head is established.

In the above described operation for coupling the joint 921 with the joint 901, there may be an erroneous operation in which the joint 921 is coupled with its back side up. In order to avoid this erroneous operation surely with an easier structure of the apparatus, the following structure is used in this embodiment of the present invention.

Figure 30:
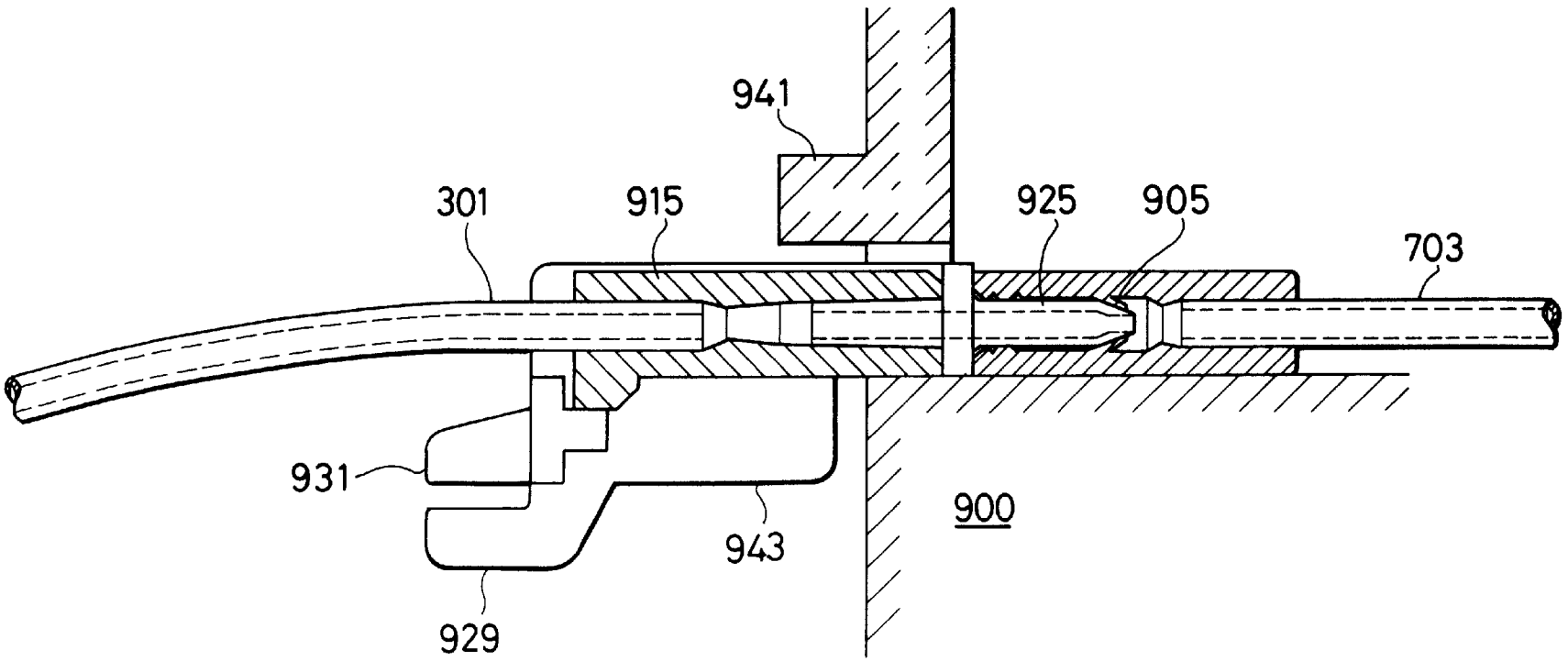
FIG. 30 is a longitudinal sectional view of the ink supply pipe connection part shown in FIGS. 29A and 29B.

FIG. 30 is a cross-sectional side view of the ink supply tube connection part. In this embodiment, the operation part 929 and the protruding part 931 is disposed on the back side of the joint 921, and a protection part 943 for avoiding erroneous connection operations is integrally formed with the operation part 929. On the apparatus frame 900, formed is a coupling part 941 which does not intersect with the protection part 983 when the joint 921 is properly coupled with the joint 901 and which intersects with the protection part 983 in order to avoid the erroneous operation in which the joint 921 is coupled with its back side up when trying to insert the joint 921 with its back side up. Owing to this structure, an erroneous operation in which the joint 921 is coupled with its back side up is avoided, and, as a result, avoided is the accidental case that mismatched color ink is led to the recording head with its ink color specified or that after mismatched color ink is led to the recording head, mixed-colored ink is used of recording information on the recording paper.

Incidentally, the protection part 983 may be allowed to be disposed on the side of the apparatus frame 900, or to be formed by extending the protruding part 931 into the frame part 900 and mounting the protruding part 931, on the frame part 900 .

According to this embodiment of the present invention, the ink supply tube can be connected from the ink tank to the recording head with an easier operation without an erroneous operation for coupling the joints, and in addition, it will be appreciated that the joint 921 can be easily separated from the joint 901 only by manipulating the operation part 929 at the state shown in FIG. 29B in order to cancel the coupled state between the latch part 927 and the lock part 907. The ease in separating the ink supply tubes from the recording head side further brings an advantage for maintaining the apparatus. And furthermore, in separating the ink supply tubes with the joint 921 from the joint 901, as the valve 905 is closed as shown in FIG. 29A, it will be appreciated that ink leakage from the recording head side can be prevented.

Now, considering further increase in ease of maintaining the apparatus with respect to separating the joint 921 form the joint 901, it is desirable to prepare the space for the separated joint 921.

Figure 31A:
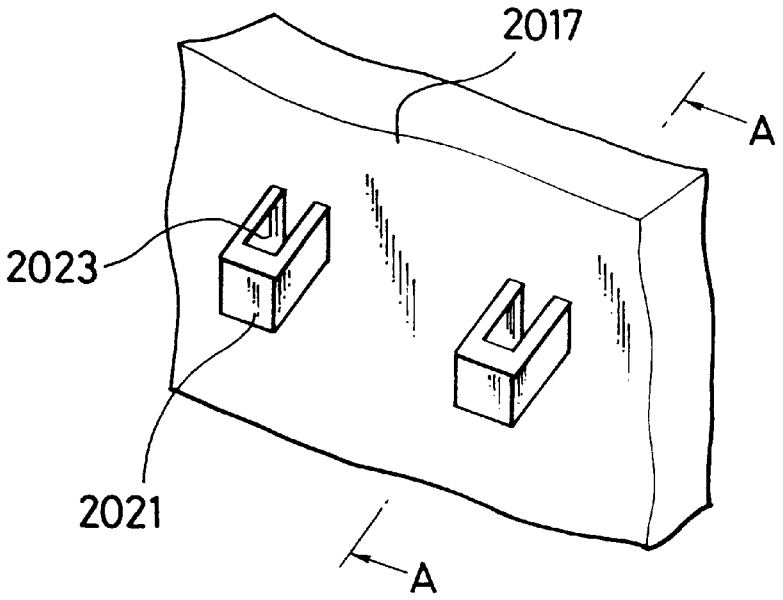
FIGS. 31A and 31B are, respectively, a perspective view and a sectional view showing the structure for supporting one joint part of the ink supply pipe connection part on the side wall of the ink jet recording apparatus of the present invention.

In this embodiment, as shown in FIG. 31A, a hanger part 2021 having a hole 2023 for catching the protruding part 931 of the joint 921 is provided on the side panel 2017 of the apparatus. The hanger part 2021 can be used as a set of parts for supporting the joint 921 with its number of parts being equivalent to the number of the protruding parts 931 of the joint 921, or can be used as a couple of parts for supporting the joint 921 on two balanced positions. The position of the hanger parts 2021 on the side panel 2017 may be taken to be arbitrary; a single designated position or a plurality of positions desirable for maintenance operations.

Figure 31B:
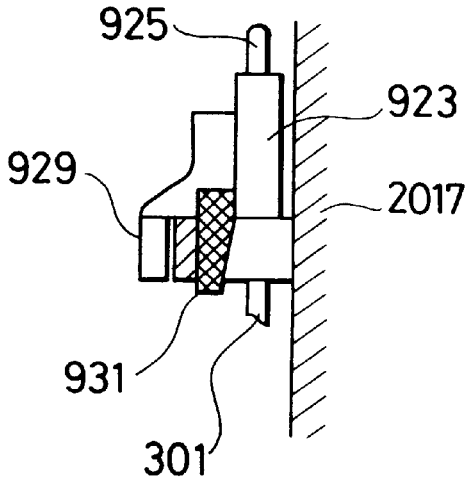

FIG. 31B is a cross-sectional view taken along line A—A in FIG. 31A, in which the joint 921 is hung on the hunger part 2021. As shown in FIG. 31B, as the protruding part 931 is caught by the hole 2023 and the bottom face of the frame part 923 of the joint 921 is placed on the upper face of the hanger part 2021, the joint 921 is supported stably. Additionally, as the top part of the tube connector 925 directs upward, it will be appreciated that ink leakage may never occur.

There may be some modifications of the support structure for the joint 921 on the side panel 2017. For example, using the gap between the operation part 929 and the protruding part 931, instead of hanging the joint 921 on the above defined hanging part 2021, the joint 921 may be hung on a bar member or a edge part of the side panel. In this case, the joint 921 is supported in the state different from the state shown in FIG. 31B, that is the operation part 929 is inserted inside the hole formed by the bar member or the edge part of the side panel. This is because the hole formed by the bar member or the edge part of the side panel can not catch both of the protruding part 931 and the tube 301. In order to avoid effectively and easily the joint 921 hung on the bar member or the edge part of the side panel 2017 from coming off from its proper position, for example, it is allowed that the operation part 929 is extended downward in FIG. 31B. With this structure, even in case that the joint 921 hung on the hole is leaning to one side, the extended portion of the operation part 929 may contact with the side panel 2017 and the leaning movement of the joint 921 is prevented.

In the above described embodiment of the present invention, with respect to the ink supply system, a ink fluid route is established by coupling a couple of joints; the former joint is installed at the upper stream side of the ink fluid route and the latter joint is installed at the down stream side of the ink fluid route and has a check valve which is normally closed and is opened when the former joint is coupled with the latter joint. In another embodiment, it is allowed that the former joint has a check valve which is normally closed and is opened when the former joint is coupled with the latter joint.

In another embodiment, the above mentioned combination of joints can be applied to the ink discharge system for transporting waste ink from the recording head to the waste ink storage part which is disposed in the ink tank in the above described embodiment as well as the ink supply system.

And furthermore, though in the above embodiment, in corresponding to an individual ink dyed in the different color from each other, a single recording head, a single ink tank, a single ink supply system, a single ink discharge system and an ink pipe connection member are defined, it is allowed that ink having an identical color with different brightness from each other may be used, stored in all the ink tanks and ejected from all the recording heads.

So far, having above described embodiments of the present invention, it will occur to those skilled in the art that modifications and alternatives can be practiced within the spirit of the invention. It is accordingly intended to define the scope of the invention only as indicated in the following claims.

The present invention achieves distinct effect when applied to a recording head or a recording apparatus which has means for generating thermal energy such as electrothermal transducers or laser light, and which causes changes in the ink by the thermal energy so as to eject ink. This is because such a system can achieve a high density and high resolution recording.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet recording system, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy correspondent to recording information; second, the thermal energy induces sudden temperature rise that exceeds nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 123670/1984 and 138461/1984 in order to achieve similar effects. The former discloses a structure in which a slit common to all the thermoelectric transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type recording head whose length equals the maximum length across a recording medium. Such a recording head may consists of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. As examples of the recovery system, are a capping means and a cleaning means for the recording head, and a pressure or suction means for the recording head. As examples of the preliminary auxiliary system, are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording head members to be mounted on a recording apparatus can be also changed. For example, only one recording head member corresponding to a single color ink, or a plurality of recording head member corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as liquid or solid substances so that the ink faces the electrothermal transducers as described in Japanese Patent Application Laying-open Nos. 56847/1979 or 71260/1985. The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, as an output device of a facsimile apparatus having a transmission and receiving function, and as an output device of an optical disc apparatus for recording and/or reproducing information into and/or from an optical disc. These types of apparatus require means for outputting processed information in the form of hard copy.

Figure 32:
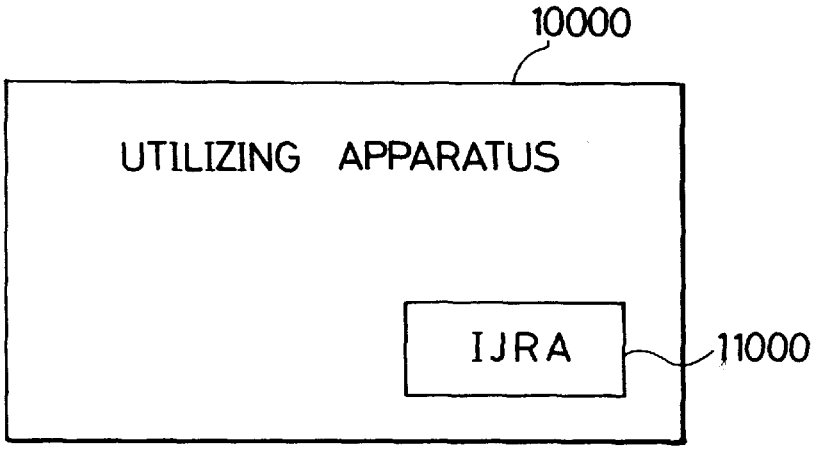
FIG. 32 is a block diagram of a utilizing apparatus in which the ink jet recording apparatus of the present invention is used.

FIG. 32 schematically illustrates one embodiment of a utilizing apparatus in accordance with the present invention to which the ink jet recording system shown in FIGS. 2A and 2B is equipped as an output means for outputting processed information.

In FIG. 32, reference numeral 10000 schematically denotes a utilizing apparatus which can be a work station, a personal or host computer, a word processor, a copying machine, a facsimile machine or an optical disc apparatus. Reference numeral 11000 denotes the ink jet recording apparatus (IJRA) shown in FIGS. 2A and 2B. The ink jet recording apparatus (IJRA) 11000 receives processed information form the utilizing apparatus 10000 and provides a print output as hand copy under the control of the utilizing apparatus 10000.

Figure 33:
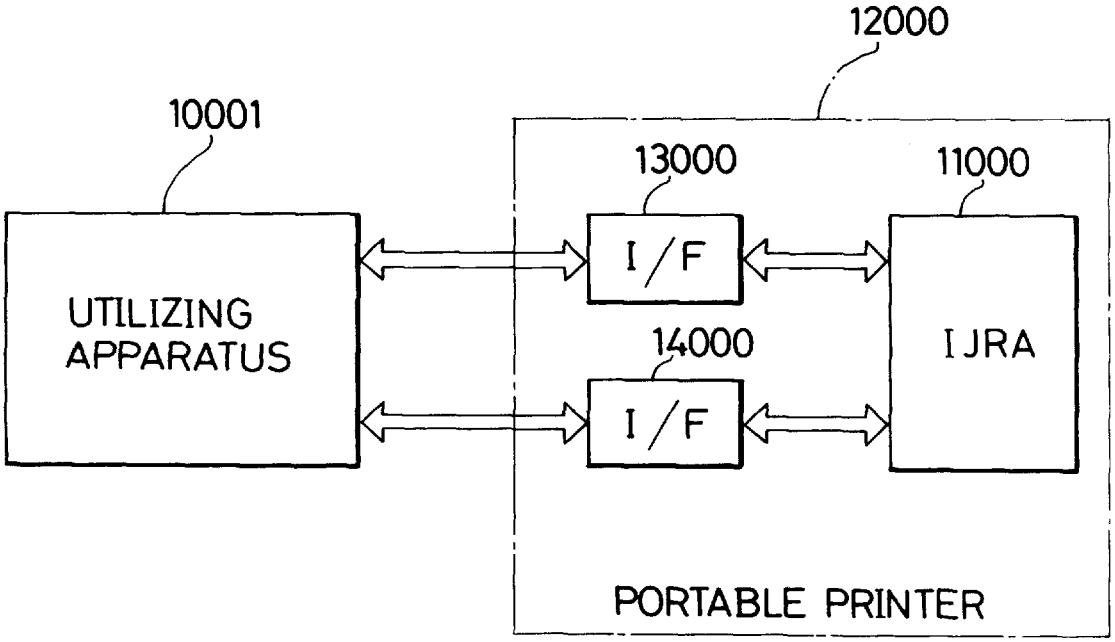
FIG. 33 is a block diagram of a utilizing apparatus and a portable printer to which the ink jet recording apparatus of the present invention is applied.

FIG. 33 schematically illustrates another embodiment of a portable printer in accordance with the present invention to which a utilizing apparatus such as a work station, a personal or host computer, a word processor, a copying machine, a facsimile machine or an optical disc apparatus can be coupled.

In FIG. 33, reference numeral 10001 schematically denotes such a utilizing apparatus. Reference numeral 12000 schematically denotes a portable printer having the ink jet recording apparatus (IJRA) 11000 shown in FIGS. 2A and 2B is incorporated thereinto and interface circuits 13000 and 14000 receiving information processed by the utilizing apparatus 11001 and various controlling data for controlling the ink jet recording apparatus 11000, including head shake and interruption control from the utilizing apparatus 11001. Such control per se is realized by conventional printer control technology.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A head mounting unit for mounting a plurality of head members, each having an electric connection part, said mounting unit comprising:

a first support member having a plurality of mount portions for respectively positioning the plurality of head members;

a first cover member attached to said first support member and having a pressing portion for pressing the head members into respective mount portions to thereby fix the head members to said respective mount portions; and a second cover member attached to said first support member and having a plurality of electric connection portions, each corresponding to the electric connection part of one of the head members, said second cover member being attached to said first support member and movable in a first direction relative to said mount portions so that movement of said second cover member in the first direction provides an electrical connection between the electric connection portions and the corresponding electric connection parts of said head members, and said second cover member having a second support member and a member which is loosely supported by said second support member and on which said plurality of electric connection portions of said second cover member are integrally provided, so that said plurality of electric connection portions are movable as one body relative to said second cover member in a second direction different from the first direction, wherein the electrical connection by movement of the second cover member in the first direction is facilitated by movement of said plurality of electric connection portions in the second direction.

2. A head mounting unit as claimed in claim 1, wherein each of said electric connection portions of said second cover member has an opening having corners and edges, the corners and the edges of said opening being rounded or tapered for accepting the corresponding electric connection part of one of the head members.

3. A head mounting unit as claimed in claim 1, wherein pressing the head members into said respective mount portions locates the plurality of head members in all directions of a three-dimensional coordinate system.

4. A head mounting unit as claimed in claim 3, wherein each of the head members includes an electro-thermal converting element for generating thermal energy used to cause film boiling in an ink for discharging the ink from the head members.

5. A recording apparatus having a head mounting unit for mounting a plurality of head members, each having an electric connection part, for acting on a sheet member disposed at a recording region in said recording apparatus, said recording apparatus comprising:

a signal supplying portion connected to the plurality of head members for supplying a driving signal to the plurality of head members to perform recording;

a first support member having a plurality of mount portions for respectively positioning the plurality of head members;

a first cover member attached to said first support member and having a pressing portion for pressing the plurality of head members into respective mount portions to thereby fix the head members to said respective mount portions; and a second cover member attached to said first support member and having a plurality of electric connection portions, each corresponding to the electric connection part of one of the head members, said second cover member being attached to said first support member and movable in a first direction relative to said mount portions so that movement of said second cover member in the first direction provides an electrical connection between the electric connection portions and the corresponding electric connection parts of said head members, and said second cover member having a second support member and a member which is loosely supported by said second support member and on which said plurality of electric connection portions of said second cover member are integrally provided, so that said plurality of electric connection portions are movable as one body relative to said second cover member in a second direction different from the first direction, wherein the electrical connection by movement of the second cover member in the first direction is facilitated by movement of said plurality of electric connection portions in the second direction.

6. A recording apparatus as claimed in claim 5, wherein each of said electric connection portions of said second cover member has an opening having corners and edges, the corners and the edges of said opening being rounded or tapered for accepting the corresponding electric connection part of one of the head members.

7. A head mounting unit as claimed in claim 5, wherein pressing the head members into said respective mount portions locates the plurality of head members in all directions of a three-dimensional coordinate system.

8. A recording apparatus as claimed in claim 7, wherein each of the head members includes an electro-thermal converting element for generating thermal energy used to cause film boiling in an ink for discharging the ink from the head members.

9. An electric connecting method comprising the steps of:

providing a head unit having a plurality of mount portions for respectively positioning a plurality of head members and a cover member having a support member and a member which is loosely supported by said support member and on which a plurality of electric connection portions are integrally provided, so that said plurality of electric connection portions are movable as one body, each of the electric connection portions corresponding to an electric connection part of each of the head members; and moving the cover member in a first direction relative to the head members positioned on the mount portions to provide an electrical connection of the electric connection portions of the cover member with the corresponding electric connection parts of the head members, wherein said plurality of electric connection portions move relative to the cover member in a second direction different from the first direction.

10. A head mounting unit for mounting a plurality of head members, each having an electric connection part, said unit comprising:

a first support member having a plurality of mount portions for respectively positioning the plurality of head members; and a cover member attached to said first support member and having a plurality of electric connection portions, each corresponding to the electric connection part of one of the head members, said cover member being attached to said first support member and movable in a first direction relative to said mount portions so that movement of said cover member in the first direction provides an electrical connection between the electric connection portions and the corresponding electric connection parts of said head members, and said cover member having a second support member and a member which is loosely supported by said second support member and on which said plurality of electric connection portions of said cover member are integrally provided, so that said plurality of electric connection portions are movable as one body relative to said cover member in a second direction different from the first direction, wherein the electrical connection by movement of said cover member in the first direction is facilitated by movement of said plurality of electric connection portions in the second direction.

11. A recording apparatus having a head mounting unit for mounting a plurality of head members, each having an electric connection part, for acting on a sheet member disposed at a recording region in said recording apparatus, said recording apparatus comprising:

a signal supplying portion connected to the plurality of head members for supplying a driving signal to the plurality of head members to perform recording;

a first support member having a plurality of mount portions for respectively positioning the plurality of head members; and a cover member attached to said first support member and having a plurality of electric connection portions, each corresponding to the electric connection part of one of the head members, said cover member being attached to said first support member and movable in a first direction relative to said mount portions so that movement of said cover member in the first direction provides an electrical connection between the electric connection portions and the corresponding electric connection parts of said head members, and said cover member having a second support member and a member which is loosely supported by said second support member and on which said plurality of electric connection portions of said cover member are integrally provided, so that said plurality of electric connection portions are movable as one body relative to said cover member in a second direction different from the first direction, wherein the electrical connection by movement of the second cover member in the first direction is facilitated by movement of said plurality of electric connection portions in the second direction.

12. A head mounting unit for mounting a plurality of head members, each having an electric connection part, said unit comprising:

a support member having a plurality of mount portions for respectively positioning the plurality of head members; and a cover member having a plurality of electric connection portions, each corresponding to the electric connection part of one of he head members, said cover member being movable in a first direction relative to said mount portions so that movement of said cover member in the first direction provides an electrical connection between the electric connection portions and the corresponding electric connection parts of said head members, and said cover member having a member which is loosely supported by said cover member and on which said plurality of electric connection portions of said cover member are integrally provided, so that said plurality of electric connection portions are movable as one body relative to said cover member in a second direction different from the first direction, wherein the electrical connection by movement of the cover member in the first direction is facilitated by movement of said plurality of electric connection portions in the second direction.

13. A recording apparatus having a head mounting unit for mounting a plurality of head members, each having an electric connection part, for acting on a sheet member disposed at a recording region in said recording apparatus, said recording apparatus comprising:

a signal supplying portion connected to the plurality of head members for supplying a driving signal to the plurality of head members to perform recording;

a support member having a plurality of mount portions for respectively positioning the plurality of head members; and a cover member having a plurality of electric connection portions, each corresponding to the electric connection part of one of the head members, said cover member being movable in a first direction relative to aid mount portions so that movement of said cover member in the first direction provides an electrical connection between the electric connection parts of said head members, and said cover member having a member which is loosely supported by said cover member and on which said plurality of electric connection portions of said cover member are integrally provided, so that said plurality of electric connection portions are movable as one body relative to said cover member in a second direction different from the first direction, wherein the electrical connection by movement of the cover member in the first direction is facilitated by movement of said plurality of electric connection portions in the second direction.

* * * * *

UNITED STATES PATENT AND TRADEMARK OFFICE

CERTIFICATE OF CORRECTION

PATENT NO. : 6,007,184

DATED : December 28, 1999

INVENTOR(S) : Koji Terasawa, et al.

It is certified that error appears in the above-identified patent and that said Letters Patent is hereby corrected as shown below:

ON THE COVER PAGE

After "Related U.S. Application Data", insert

--[30] Foreign Application Priority Data

October 3, 1990 [JP] ....2-266890

October 3, 1990 [JP] ....2-266891--.

COLUMN 1

Line 27, change "noises" to --noise--;

Line 32, change "microscepic" to --microscopic--; and

Line 51, change "device" to --devices--.

COLUMN 2

Line 1, delete "other";

Line 36, delete "in";

Line 46, change "to" to --used to--; and

Line 47, delete "used".

COLUMN 3

Line 25, delete "in".

UNITED STATES PATENT AND TRADEMARK OFFICE

CERTIFICATE OF CORRECTION

PATENT NO. : 6,007,184

DATED : December 28, 1999

INVENTOR(S) : Koji Terasawa, et al.

It is certified that error appears in the above-identified patent and that said Letters Patent is hereby corrected as shown below:

COLUMN 5

Line 55, delete "one"; and
Line 66, change "thereof" to --thereof excluding--

COLUMN 6

Line 8, change "injection recovery" to --in ejection recovery--; and
Line 13, change "across" to --for printing--.

COLUMN 7

Line 9, change "pair" to --a pair--; and
Line 10, delete "a".

COLUMN 8

Line 19, change "papers" to --paper--.

COLUMN 12

Line 26, change "member" to --portion--; and
Line 47, change "portion" to --portion or--.

UNITED STATES PATENT AND TRADEMARK OFFICE

CERTIFICATE OF CORRECTION

PATENT NO. : 6,007,184

DATED : December 28, 1999

INVENTOR(S) : Koji Terasawa, et al.

It is certified that error appears in the above-identified patent and that said Letters Patent is hereby corrected as shown below:

COLUMN 14

Line 53, change "are" to --is--.

COLUMN 15

Line 37, change "linking a" to --a linking--.

COLUMN 32

Line 54, change "member" to --members--.

COLUMN 33

Line 31, change "hard" to --a hard--.

COLUMN 36

Line 61, change "he" to --the--

COLUMN 38

Line 4, change "aid" to --said--.

Signed and Sealed this

Thirtieth Day of January, 2001

*Attest:*

Q. TODD DICKINSON

*Attesting Officer*

*Director of Patents and Trademarks*